US008225800B2

(12) United States Patent
Byrne

(10) Patent No.: US 8,225,800 B2
(45) Date of Patent: Jul. 24, 2012

(54) EYELASH ADORNMENT

(76) Inventor: Alexsandra Byrne, London (GB)

( * ) Notice: Subject to any disclaimer, the term of this patent is extended or adjusted under 35 U.S.C. 154(b) by 955 days.

(21) Appl. No.: 11/738,399

(22) Filed: Apr. 20, 2007

(65) Prior Publication Data

US 2007/0272264 A1 Nov. 29, 2007

(30) Foreign Application Priority Data

May 26, 2006 (GB) ..... 0610515.9

(51) Int. Cl.
*A45D 40/30* (2006.01)
*A41G 5/00* (2006.01)

(52) U.S. Cl. ..... 132/216; 132/53

(58) Field of Classification Search ..... 132/216, 132/217, 53–56, 200; D28/92, 36
See application file for complete search history.

(56) References Cited

U.S. PATENT DOCUMENTS

| | | | |
|---|---|---|---|
| 1,897,747 | A | 2/1933 | Birk |
| 2,421,432 | A | 6/1947 | Phillips |
| 3,559,657 | A | 2/1971 | Bau |
| 3,880,175 | A | 4/1975 | Hosokawa |
| 3,900,038 | A | 8/1975 | Masters |
| 4,018,336 | A | 4/1977 | Aylott |
| 4,299,242 | A | 11/1981 | Choe |
| 5,547,529 | A | 8/1996 | Woolf |
| 6,029,674 | A | 2/2000 | Han |
| 6,308,716 | B1 | 10/2001 | Han |
| D510,159 | S | 9/2005 | Song |
| 2002/0056465 | A1 | 5/2002 | Shin |
| 2002/0198597 | A1 | 12/2002 | Godfrey |
| 2003/0005941 | A1 | 1/2003 | Iosilevich |
| 2005/0061341 | A1 | 3/2005 | Choe |

FOREIGN PATENT DOCUMENTS

| | | |
|---|---|---|
| GB | 459930 | 1/1937 |
| JP | 10-77515 | 3/1998 |
| JP | 2000-27018 | 1/2000 |
| JP | 2002-363815 | 12/2002 |
| JP | 2005-113302 | 4/2005 |
| JP | 2005-146500 | 6/2005 |
| WO | WO 2002/085186 A2 | 10/2002 |

OTHER PUBLICATIONS

Internet Article entitled "False Eyelashes and Fake Eyelashes", dated Jan. 18, 2006, XP-002447241 Retrieved from the Internet: URL:http://web.archive.org/web/20060118030618/http://www.mydivacloset.com/fakeeyelashes.html> [retrieved on Aug. 17, 2007].

*Primary Examiner* — Rachel Steitz
(74) *Attorney, Agent, or Firm* — Tarolli, Sundheim, Covell & Tummino LLP

(57) ABSTRACT

An eyelid has a natural lash line containing natural eyelashes. An eyelash adornment apparatus for the eyelid includes a plurality of lash subassemblies. Each lash subassembly includes an elongated mounting portion and a plurality of elongated lash filaments. Each lash filament has a filament base and an oppositely disposed filament tip. The filament base is attached to the mounting portion with the filament tip extending from the mounting portion. The lash subassemblies are each adapted for affixation to the eyelid. A chosen one of the lash subassemblies, when affixed to the eyelid, is operative to provide at least one of a different visual impression than a visual impression provided by an other one of the lash subassemblies when affixed to the eyelid, and a different visual effect upon the natural eyelashes than a visual effect provided by the other one of the lash subassemblies when affixed to the eyelid. A method of adorning an eyelash of a wearer is also provided.

53 Claims, 13 Drawing Sheets

EYELASH ADORNMENT

RELATED APPLICATION

This application claims priority from UK Patent Application No. 0610515.9, filed on May 26, 2006 at the UK Patent Office, the subject matter of which is incorporated herein by reference.

TECHNICAL FIELD

The present invention relates to an apparatus and method for use of a cosmetic enhancement and, more particularly, to an apparatus and method for use of an eyelash adornment.

BACKGROUND OF THE INVENTION

Eyelash adornments have existed in the form of false eyelashes for many years. They are typically used as a beauty accessory, but also find application in stage, screen and modeling environments, where enhanced lash visibility is often desired for a variety of reasons.

False eyelashes take many conventional forms, and may be arranged in three broad classes.

The first class contains "unitary" lashes (generally sold in pairs), where a single assembly is provided for each eye. Such an assembly generally includes an elongate base portion and hair filaments formed from synthetic fibers or natural hair. The base portion defines a mounting portion from which the hair filaments extend and it therefore typically corresponds approximately to the shape of the edge of an eyelid (hereafter referenced as "a lash line", regardless of whether individual native lash filaments are present in that area). The mounting portion is generally temporarily affixed to the lash line using an adhesive strip, or a liquid or paste adhesive. Where used, the adhesive strip is often pre-fixed to the mounting portion by the manufacturer. The liquid/paste type adhesive may be applied as part of the affixation process.

While being the easiest type of lash to fit, unitary lashes present a number of practical problems. One of these problems is that the seemingly ergonomic shape of the mounting portion frequently fails to match the curvature of the lash line of a specific wearer, causing distortion of the lash and/or failure of adhesion. The length of the mounting portion may fail to match the length of the lash line of the wearer. In such a case, modification by cutting is often not possible, due to the structure of the lash, or is simply avoided by the wearer through fear of failure of the lash or an unsatisfactory result. Unitary lashes are also a universal solution and generally take no account of the specific needs of the wearer. In other words, while most unitary lashes will indeed visually enhance the eyes of a certain wearer, in other cases they could look unnatural and/or even detract from the natural appearance of the wearer.

The second class comprises what are generally known as "individual" lashes. These individual lashes are packaged in groups of, for example, forty or fifty pieces, a desired number of which can be affixed to the lash line one-by-one in a row. Despite their name, these individual lashes are not usually composed of a single lash filament. Instead, each individual lash will typically be made up of three or four connected lash filaments.

Individual lashes may function better in certain applications than unitary lashes, but also can be rather problematic to fit; it may be difficult to control the small individual lashes and place them in the desired location. Even when the desired location is achieved, arranging the individual lashes to be geometrically sympathetic with the natural lash line can be difficult. Individual lashes may not adhere adequately, which may occasion the use of a glue of such strength as to possibly cause health and safety concerns. Maintaining the necessary accuracy during the process of affixing twenty or more individual lashes can challenge the skills of even the most seasoned cosmetic professional; self-affixation to achieve desired results may be nearly impossible for many prospective wearers.

The third type of eyelash adornments are "corner" lashes, which are generally packaged in pairs and are intended to be used at the lateral corner of an eye. While corner lashes will fit the majority of eyes, they generally have a very specific shape, so might not fit well or look natural for every wearer. Corner lashes also do not generally integrate themselves well into the lash filaments of the natural lash line, as there is no bridge, adjoining, or camouflage-type feature at the edge of the corner lash that aids in blending it into the natural eyelash.

SUMMARY OF THE INVENTION

In an embodiment of the present invention, an eyelash adornment apparatus for an eyelid is described. The eyelid has a natural lash line containing natural eyelashes. The apparatus includes a plurality of lash subassemblies. Each lash subassembly includes an elongated mounting portion and a plurality of elongated lash filaments. Each lash filament has a filament base and an oppositely disposed filament tip. The filament base is attached to the mounting portion with the filament tip extending from the mounting portion. The lash subassemblies are each adapted for affixation to the eyelid. A chosen one of the lash subassemblies, when affixed to the eyelid, is operative to provide at least one of a different visual impression than a visual impression provided by an other one of the lash subassemblies when affixed to the eyelid, and a different visual effect upon the natural eyelashes than a visual effect provided by the other one of the lash subassemblies when affixed to the eyelid.

In an embodiment of the present invention, an eyelash adornment kit is described. The kit includes at least two lash subassemblies. Each lash subassembly includes an elongated mounting portion and a plurality of elongated lash filaments. Each lash filament has a filament base and an oppositely disposed filament tip. The filament base is attached to the mounting portion with the filament tip extending from the mounting portion. The lash subassemblies are each adapted for affixation to the eyelid. A chosen one of the lash subassemblies, when affixed to the eyelid, is operative to provide at least one of a different visual impression than a visual impression provided by an other one of the lash subassemblies when affixed to the eyelid, and a different visual effect upon natural eyelashes than a visual effect provided by the other one of the lash subassemblies when affixed to the eyelid. The eyelash adornment kit includes at least one ancillary item.

In an embodiment of the present invention, an eyelash adornment apparatus for an eyelid is described. The eyelid has a natural lash line containing natural eyelashes. The apparatus includes at least two and not more than five lash subassemblies. Each lash subassembly includes an elongated mounting portion having a mounting portion length in the range of about 3 mm to about 25 mm, and a plurality of elongated lash filaments. Each lash filament has a filament base and an oppositely disposed filament tip. The filament base is attached to the mounting portion with the filament tip extending from the mounting portion.

In an embodiment of the present invention, a method of adorning an eyelash of a wearer is described. The wearer has an eyelid. The eyelid has a natural lash line containing natural eyelashes. A plurality of lash subassemblies are provided. Each lash subassembly includes an elongated mounting portion and a plurality of elongated lash filaments. Each lash filament has a filament base and an oppositely disposed filament tip. The filament base is attached to the mounting portion with the filament tip extending from the mounting portion. At least one of the lash subassemblies is attached to the eyelid. A chosen one of the lash subassemblies is affixed to the eyelid and provides at least one of a different visual impression than a visual impression provided by an other one of the lash subassemblies when affixed to the eyelid; and a different visual effect upon the natural eyelashes than a visual effect provided by the other one of the lash subassemblies when affixed to the eyelid.

BRIEF DESCRIPTION OF THE DRAWINGS

For a better understanding of the invention, reference may be made to the accompanying drawings, in which.

DESCRIPTION OF EMBODIMENTS

Standard anatomical terms have been used to define the characteristics of the embodiments herein described and may take the conventional anatomical meaning unless otherwise defined.

"Dense", "density" and the like refer to the distribution density of the lash filaments, unless stated otherwise.

"Adjacent" structures may exhibit any degree of mutual contact or may instead be located near, but not in direct contact with, each other.

The descriptions of structures herein should, where appropriate, be taken as equally applicable to a mirror image of that structure for use in the opposite eye.

Some of the embodiments described herein take the form of a false eyelash, which is referenced hereafter as an eyelash adornment that is intended to extend substantially along the entire lash line length of either an upper or a lower eyelid and affect substantially the entire natural lash. Other embodiments take the form of eyelash adornments that do not extend fully along an eyelid in this manner (for example, they may be intended for only a certain part of the lash line) or eyelash adornments that affect the natural lash in some other limited manner (for example, by acting upon only the roots of the lash). Though an embodiment may be described as being used in one of these applications, there is no impediment placed upon the use of that embodiment in another application. Moreover, various embodiments of the eyelash adornment described herein may be suitable for use with the upper and/or the lower eyelid. For simplicity, however, the eyelash adornments should be presumed to be described for use with an upper eyelid unless stated otherwise or obvious from context.

Some of the embodiments are described herein as having certain effects upon the eyes of a wearer, or as being particularly suited to a certain application or to a certain wearer having described physical characteristics. The present invention is not limited to providing (or being required to provide) these certain effects or for use in these certain applications or for these certain wearers. Instead, one of ordinary skill in the art can choose the structures described with reference to one or more embodiments of the present invention to produce a desired effect for a particular wearer or application without limitation by the description herein.

Figure 37:
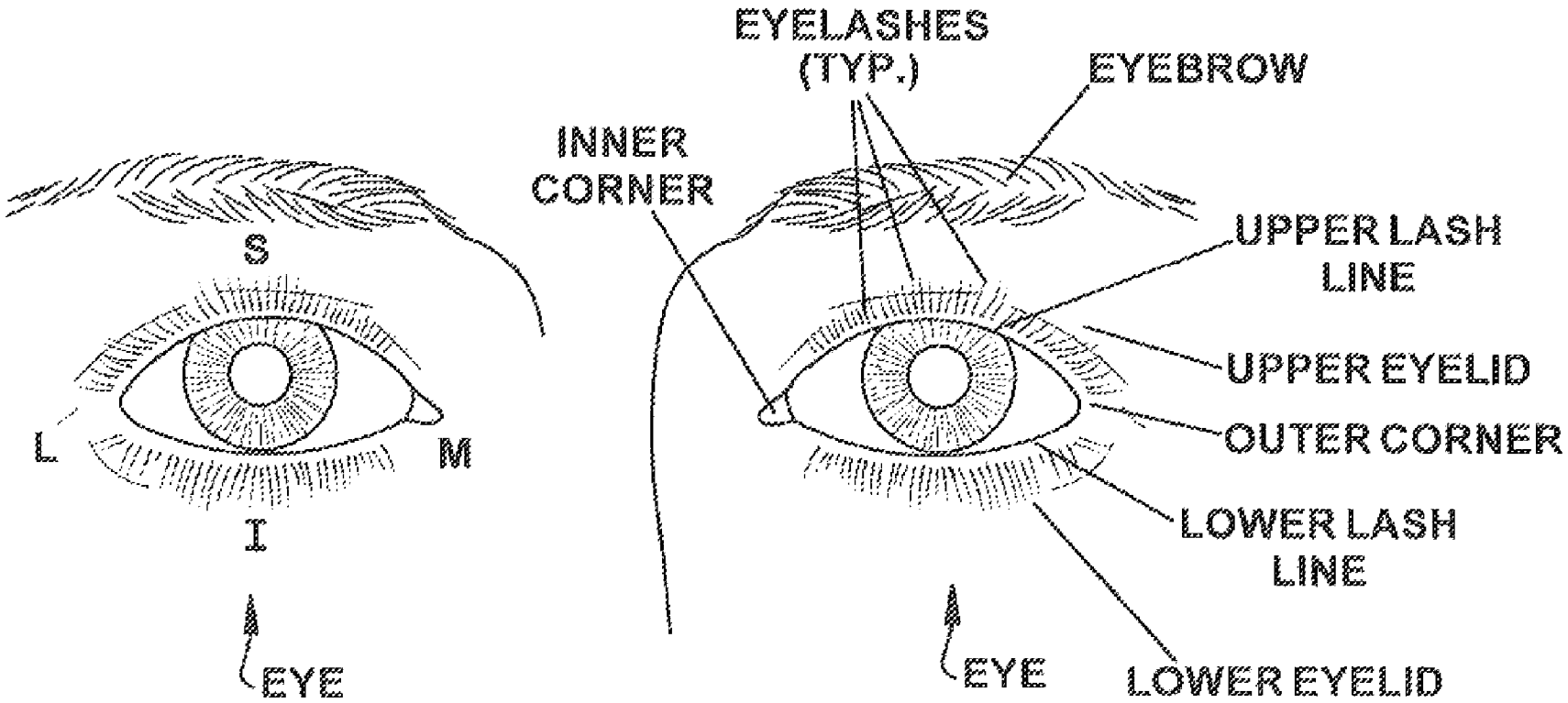
FIG. 37 is a front view of an environment in which any embodiment of the present invention may be used.

For purposes of orientation, FIG. 37 depicts an environment in which any embodiment of the present invention may be used. More specifically, FIG. 37 depicts the eye area of a potential wearer of an eyelash adornment, though no eyelash adornment is depicted in FIG. 37. The parts of the eye are labeled on the left eye in FIG. 37, while the directions which will be referenced hereafter are labeled on the right eye. The wearer's eyes each have a lower eyelid and an upper eyelid, with an eyebrow above the upper eyelid. Each eyelid has a lash line, from which emerge a plurality of individual lash filaments. Embodiments of the present invention will be described as being affixable to just a lash line for clarity, even though the lash line may not be clearly delineated and portions of the embodiments may actually be at least partially affixable to adjacent eyelid portions.

As is shown on the right eye in FIG. 37, the lateral (L) side of each eye is toward the outside of the face, while the medial (M) side is on the inside, toward the nose. The superior (S) side is toward the eyebrows, with the inferior (I) side located opposite, toward the lower portions of the face.

FIG. 1

Figure 1:
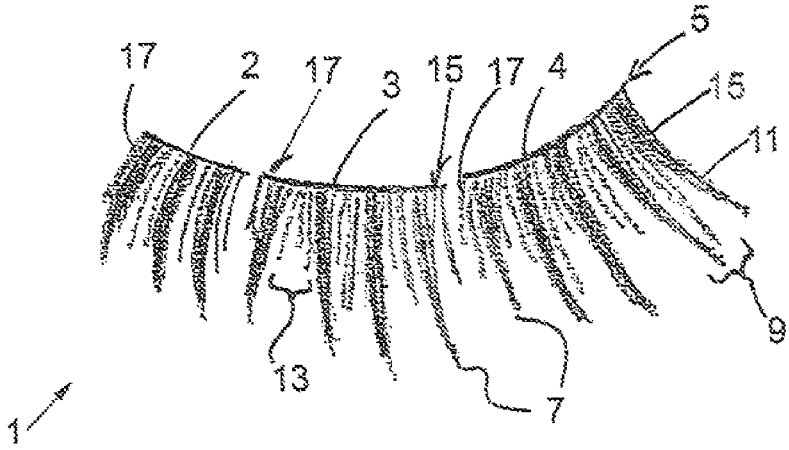
FIG. 1 is a schematic view of a first embodiment of the present invention.

In accordance with a first embodiment of the present invention, FIG. 1 depicts an eyelash adornment 1 formed from three lash subassemblies 2, 3, 4. A lash subassembly is an assembled unit designed to be incorporated with other units in a finished product; here, multiple lash subassemblies are incorporated into an eyelash adornment. Each lash subassembly 2, 3, 4 takes the form of an elongate base portion 5 and a series of lash filaments 7, which extend from the base portion 5 in a generally conventional manner. In use, the lash subassemblies 2, 3, 4 can be arranged side-by-side on the eyelid and so combine to form the adornment 1.

As a consequence of the adornment being provided by a plurality of relatively short lash subassemblies, the adornment as a whole can take account of the eyelid shape and facial characteristics of the wearer during fitting. This leads to greater comfort and a more secure fixation. Second, the use of a relatively small number of relatively sizeable subassemblies makes the fitting of the adornment fairly easy, as the lash subassemblies are not difficult to manipulate and the process is not prohibitively repetitive. Third, the lash subassemblies can be individually configured to provide very specific effects at their respective intended positions on the eyelid, thereby enabling the provision of an adornment that matches the aesthetic and physical requirements of the wearer very closely. Fourth, the lash subassemblies are interchangeable, allowing the selection of subassemblies having particular characteristics from within a large range, in order to design an adornment to achieve a particular aesthetic and/or physical effect upon the wearer's eyes and/or native eyelashes. It is also possible to mix-and-match the chosen subassemblies with other subassemblies for different effects. Fifth, the subassemblies can be combined in a wide variety of ways, including layering, overlapping and stacking, as well as simple linear arrangements such as those shown in the Figures.

Adornments according to any embodiment of the present invention can be selected to address physical characteristics of the wearer. These will include at least the set, shape and alignment of the eyes, and an appropriate choice of adornment can change or even improve the appearance of such characteristics by providing appropriate visual effects. For example, by appropriate choice of lash subassemblies, it is possible to address eyes which are (in relative terms): small, deep-set; narrow, droopy, protruding, widely-set, closely-set, round, downward-slanting, and upward-slanting. Other physical characteristics addressable by visual effects provided by embodiments of the invention reside in the eyelids. These include droopy eyelids (where the eyelid sags and rests upon the lashes) and crêpey or feathery eyelids (where the skin has an irregular texture). The embodiments described below respectively are intended to change the appearance of one or more of these characteristics, as shall be described further below.

Although three lash subassemblies 2, 3, 4 are present in the adornment 1 shown in FIG. 1, other embodiments will use different numbers. In some cases an adornment will use just two subassemblies; in other cases, as many as five lash subassemblies will be used. It has been found that deploying relatively few lash subassemblies restricts the extent to which the adornment can be made to affect the aesthetic and physical characteristics of the eye as desired, while using more subassemblies increases the complexity (and difficulty) of the fitting process. A convenient number of lash subassemblies for achieving a desired result with an adornment 1 could be, for example, between about two and five, e.g., three to four lash subassemblies. However, any number of lash subassemblies could be used.

The length of the mounting portions 5 of the lash subassemblies will vary in differing embodiments. There are a number of factors that influence this. For example, one factor is whether the adornment is to extend along the entire lash line length. In some cases the mounting portion 5 length will be further influenced by the lash line length and lateral/medial (L/M) width of the actual eye to which the adornment is to be fitted, but if the adornment is to be sold as a mass-market product with an expectation of little or no modification, then fit and aesthetic considerations will probably prevail. Another possible factor is the number of lash subassemblies that are to be used in the construction of the adornment. Yet another factor, for example, is the relative positions of the lash subassemblies when in use. Selecting the appropriate subassembly width(s) of the mounting portions will enable the individual subassemblies to address certain parts of the eye/eyelash in differing ways.

In practice each lash subassembly will have a mounting portion which is between about 3-25 mm long. Lash subassemblies which have mounting portions which are between about 5-17 mm, e.g., about 7-11 mm, provide a good balance between easy manipulation and adaptability to the eye/lash shape.

Where the adornment has two lash subassemblies that are intended to be arranged linear, either contacting or spaced apart, aligned relationship (hereafter referenced as "side-by-side"), having one of the mounting portions with a length of between about 10-17 mm, e.g., about 13-17 mm, has been found particularly suitable for addressing common eye characteristics.

Where the adornment has three lash subassemblies that are intended to be arranged side-by-side, mounting portions with a length of between about 7-11 mm have been found particularly suitable for addressing common eye characteristics.

Where the adornment has four lash subassemblies that are intended to be arranged side-by-side, mounting portions with a length of between about 7-9 mm have been found particularly suitable for addressing common eye characteristics.

Where the adornment has five lash subassemblies that are intended to be arranged side-by-side, mounting portions with a length of between about 5-7 mm have been found particularly suitable for addressing common eye characteristics.

Where the subassemblies forming an adornment are intended to be arranged in some other non-linear fashion (e.g. a stacked, layered, or overlapping relationship, in any direction/orientation), then the desired lengths may differ from what is stated above for a given number of lash subassemblies and can be readily determined by one of ordinary skill in the art.

The base portion 5 of each lash subassembly 2, 3, 4 is used as a mounting portion when fitting it to an eyelid. This process can be largely conventional in that a paste or liquid adhesive can be used, or an adhesive strip can also be use, which can be pre-fitted to the base portion 5 during the manufacturing process. One of ordinary skill in the art can readily provide affixation means between the adornment and the eyelid, and such will not be further discussed.

The lash subassemblies 2, 3, 4 described herein can all be manufactured using any one, or a combination, of a number of known techniques. In some such processes, the lash filaments are molded into plastic or elastomeric strips, which then serve as the mounting portion during use. In other processes, the filaments are knotted to each other and/or to a common line, which then forms the basis for the mounting portion, either on its own or after the addition of supplementary materials for additional structure. Other manufacturing processes make use of microbonding. It is even possible to co-mold the filaments and mounting portion in order to form an integral lash subassembly. Some manufacturing techniques enable the resulting lash subassembly to be cut/altered by the user, while maintaining structural integrity. In short, any suitable manufacturing technique can be chosen and used with any embodiment of the present invention.

Various materials may be used for the lash filaments and these include natural materials, such as hair or feathers, and synthetic fibers. Some of these (e.g. synthetic fibers) are only suitable for certain manufacturing techniques (e.g. co-molding). Aside from materials which simulate hair, other materials can be used with varying effect, including, for example, metal foil or any other material which can provide a desired natural or unnatural looking effect. The choice of material might also be influenced by the desired visual or functional effect and/or cost.

Manufacturing processes and materials do not form part of the present invention, and will already be well known to those of ordinary skill in the art, so will not be described further.

The individual lash subassemblies 2, 3, 4 shown in FIG. 1 may be fitted to the eye of the wearer one at a time, so that they combine together to achieve the desired effect. In many cases the lash subassemblies will be presented or selected individually, so that the assembly of the adornment effectively takes place on the eyelid. It is, however, equally viable for the lash subassemblies to be joined together prior to fitting. For example, mounting portions 5 of the lash subassemblies 2, 3, 4 that are to form the adornment 1 can be pre-glued to a common strip, and the strip used to mount the whole assembly on the eyelid together.

Similarly, while the lash subassemblies will commonly be presented as discrete components, they may also be supplied in a linked fashion (for example on a common thread, possibly as a consequence of the manufacturing process). In such a case, the lash subassemblies might be separated prior to fitting, but in some cases this might be unnecessary or undesirable (for example, where the linked lash subassemblies happen to define an adornment that would be suitable for use as is). In this latter case, embodiments of the present invention may still have desirable characteristics, possibly as a consequence of articulation between the conjoined subassemblies.

It should also be understood that the invention allows for modification of lash subassemblies prior to fitting, for example, by cutting. To facilitate modification, a template and/or style guide can be provided. To further assist in this process, lash subassemblies having certain base profiles may be provided, these base profiles being approximate to the intended final shape, but specifically intended to be easy to cut for further modification by the wearer.

An adornment in accordance with any embodiment of the present invention may be presented as a packaged article, with the lash subassemblies presented together, ready for fitting to the eyelid. In such a case, the adornments would typically be offered in pairs. This approach will be particularly suitable for the mass market, where the wearers will often make the purchase themselves and in doing so select adornments that have predetermined combinations of lash subassemblies giving specific characteristics.

Embodiments of the present invention also could be used in a system-based approach, wherein different lash subassemblies are presented as a range (comprising any number of different lash subassemblies), from which lash subassemblies having differing characteristics are individually selected in order to be combined into adornments meeting specific requirements. This approach is particularly suitable for use in a professional application, where a consultant is available to assist a wearer in the selection of a combination of lash subassemblies to create a desired effect. The lash subassemblies may, in such a case, be affixed to the wearer by the consultant and/or taken by the wearer for self-affixation at a later point in time.

A system-based approach is also suitable for use with computer-aided eyelash design, where images of different lash subassembly combinations can be superimposed upon an image of the wearer, so that various combinations of lash subassembly can be considered prior to making a choice. In such a process, the computer-aided design aspect can be operated by a consultant or by the wearer. Such a process can even be conducted remotely over a network and/or via the Internet. For example, an image of the wearer could be uploaded to a remote server, the computer-aided design process conducted online, and the chosen eyelash adornments purchased online for subsequent delivery via mail order or store pickup. This computer-aided system has particular benefits in that the wearer can make a selection from a vast range of potential lash subassemblies which can be supplied directly from a warehouse (thus eliminating the need for large store inventories), and the software can assist in making an appropriate selection (from among what might otherwise be a bewildering choice of potential lash subassemblies). In such a case, the resulting adornments could quite reasonably be classed as "custom-made".

Suitable components for forming adornments in accordance with the invention can be supplied to the wearer in a kit. The kit will typically contain a number of lash subassemblies presented in a case (e.g. a "compact"-style case) along with ancillary items, such as one or more of a mirror, adhesive, adhesive remover, scissors, tweezers, a lash grabber/manipulating tool, a lash application tool, a lash separator/comb, bonding mascara, camouflage eyeliner, and any other suitable items to assist in affixing the adornment. The mirror, adhesive, and adhesive remover are naturally used for fitting/removal and repairs/adjustments during the course of wear. The scissors can be used for effecting adjustments and/or repairs. The lash grabber/manipulation tool and tweezers are used for grasping the lash subassemblies. The lash separator/comb is for tidying the adornment. The bonding mascara may be used to help affix the lash subassemblies to the natural lashes of the wearer. The camouflage lash liner is applied to help disguise the junction of the mounting portions of the lash subassemblies and the eyelid.

The subassemblies supplied in such a kit could be of a limited number, such as to be suitable for forming a specific pre-determined adornment type. Alternatively, many subassemblies could be included, so as to enable the user to construct a variety of adornments by selecting and combining the subassemblies in various ways.

The range of subassemblies included within the kit can be "custom" in the sense that they have been selected to form the basis of the kit by the user or by someone else, with the specific requirements of the user in mind. Alternatively, a predetermined range of subassemblies could be selected by, for example, the manufacturer, a retailer, or a consultant. In this case, the range of subassemblies in the kit can be chosen to address particular wants or needs. For example, a kit can be presented as an "everyday" kit, with subassemblies designed to give relatively subtle effects; another kit can be designated a "party" kit and give more extreme options. Other kits can address specific market needs, with examples including "theater" kits, "fashion runway" kits, "photo shoot" kits, "costume" kits, and "film/TV" kits.

The kit might also include one or more templates to assist the wearer in modifying/styling the adornment. A style guide can also be included, showing different ways of combining, arranging, and/or modifying the subassemblies to achieve certain effects.

Individual lash subassemblies forming various embodiments of eyelash adornments will each be described in turn before describing combinations of lash subassemblies.

FIG. 1 illustrates a lash subassembly 4, a lash subassembly 3 and a lash subassembly 2. Each of the lash subassemblies 2, 3, 4 may be a rich black color, possibly with a slight sheen.

Each lash subassembly 2, 3, 4 has a generally even texture and displays a slight graduation in the mean length of its lash filaments 7 from one side to the other. More specifically, the tips of the lash filaments 7 define, in each case, a generally convex arcuate profile that slopes from one side of the subassembly to the other. The following description will repeatedly refer to the "profile" of a lash subassembly or group of lash subassemblies. Herein, "profile", unless stated otherwise, indicates an average or mean shape produced by the tips of the lash filaments, which trends in the stated form (e.g., concave, convex, sloping, variegated, etc.) but may have individual lash filaments which depart from the "profile" shape. A "profile", in other words, is an impression or approximation of the stated shape, rather than an exact tracing or outline thereof.

Each lash subassembly 2, 3, 4 shown in FIG. 1 also has its lash filaments 7 arranged in a series of adjacent groupings 9. Some of the groupings 9 take the form of relatively large groupings 11, in which the filaments are strongly convergent, so as to form a triangular shape. These are interspersed with rather more wispy intermediate groupings 13, in which the filaments are generally divergent. Alternate groupings 9 also have alternating long/short mean filament lengths. As a consequence of the alternating characteristics of the groupings 9, their respective filament tips collectively cause a crenellated pattern to overlie the general subassembly profile. Very generally, the crenellations are triangular in character.

The density of the lash filaments 7 is the same in each lash subassembly 2, 3, and 4 and is relatively high. The mean filament thickness is also relatively high across each lash subassembly 2, 3, 4.

From FIG. 1, it can be seen that the lash subassembly 4 has the longest mean filament length. Generally its filament length also graduates from a maximum in one side region 15, which would typically be located in the lateral corner of an eye when being worn, and then gradually narrows nearer the medial corner of the eye. The lash subassembly 4 also has the longest base portion 5 of the three lash subassemblies. The length of the base portion 5 may be, for example, 11 mm and therefore may extend along approximately ¼ to ½ of a natural lash line The mean length of the lash filaments of groupings 11 is generally longer than the length of an average natural eyelash. In use, when the lash subassembly 4 is applied to an eyelid, the pattern that forms against the skin along the brow bone when the eye is open is made up of elongated clusters of groupings 11 while the lash filaments 7 of intermediate groupings 13 blend into the natural lashes of the user. From a sagittal view (that is, a view taken substantially along the plane of the page in the orientation of the Figures), the lash filaments 7 curve downward, away from the base portion 5 and then upward again, similar to the curve of natural lashes that are not straight or unruly.

The lash subassembly 4 creates a visual impression of lashes having a more dense distribution and longer filament length than the natural eyelashes. Moreover, the graduation in the mean length of the filaments 7 from longer at the lateral side region 15 of the lash subassembly to shorter at the medial side region 17 can help to blend the exaggerated length of the filaments into the natural lash line.

The lash subassembly 4 may be placed at different positions along the upper or lower lash line and can create different visual effects depending on its position. For example, if the lash subassembly 4 is placed at the lateral corner of the upper or lower lash line, the density of its filaments 7 appears to enhance the characteristic of the natural lash line, making the L/M width and superior/inferior width (S/I width) of the eye seem greater. The exaggerated length of the lash filaments combined with their curve creates an effect where the lash filaments 7 extend both upwardly and laterally (i.e. diagonally from the eye perimeter), thereby exaggerating the relationship between the eyelashes and the eye, creating vertical emphasis at the lateral corner and again making the L/M and S/I width of the eye seem larger.

The resulting visual effect created by positioning the lash subassembly 4 in the lateral corner of the eye may differ according to the natural eye shape. For example, for eye shapes that extend horizontally at the lateral corner, the eye appears to have a stronger than natural horizontal appearance, which generally makes the L/M width of the eye seem larger and the length of the lash line seem larger. The exaggerated length of the lash filaments gives diagonal emphasis upward and slightly outward toward the lateral side of the eye area, making the eye L/M and S/I width of the eye seem larger. Such an arrangement generally creates an advantageous visual effect for deep-set, narrow/close-set, and/or small eyes.

If lash subassembly 4 is positioned just in from the lateral corner of either the upper or lower natural lash line, the density of lash filaments 7 emphasizes this area of the natural lash line before its orientation changes to meet the opposing eyelid at the lateral corner of the eye, causing the L/M width to appear larger. The exaggerated length of the filaments, combined with their curve, exaggerates the relationship between the eyelashes and the eye shape, creating vertical emphasis just in from the lateral corner, giving the S/I width a larger appearance that is independent of the characteristic of the corners the lash lines/eyelids, and making this area of the lash line seem more dominant than the lateral corner of the eye.

For eye shapes where the lateral part of the natural lash line has a downward inclination, or becomes more vertical, or where the skin of the brow bone is loose and rests very near the lash line, the lash subassembly 4 is unaffected by the natural eye shape which appears to have a longer lash line than it does naturally. Such an effect is generally considered flattering and an advantage for overly-round, protruding, and/or droopy eyes and/or droopy eyelids.

If the lash subassembly 4 is placed centrally along either the upper or lower lash line, the density of lash filaments 7 makes the L/M width of the eye seem larger just above/below the iris. The exaggerated length of the lash filaments 7 combined with their curve creates an effect where the lash filaments exaggerate the relationship between the eyelashes and the eye, thereby creating vertical emphasis, and giving the S/I width a larger appearance at the lateral corner of the iris.

At this position, the exaggeration of eye shapes having a horizontal characteristic is smaller than it would be if the subassembly was placed nearer the lateral corner. The exaggerated length of the lash filaments creates the appearance of upward and slightly lateral eye orientation, making the overall eye shape seem larger in S/I width at the lateral corner of the iris, but not as large in L/M width as it would appear if the lash subassembly was placed at the lateral corner.

For eye shapes where the lateral part of the natural lash line has a downward characteristic, or becomes more vertical, or where the skin of the brow bone is loose and rests very near the lash line, the lash subassembly 4 is unaffected by the natural eye shape which appears to have a longer lash line seem longer than it does naturally. Such an effect is generally considered flattering and an advantage for overly-round, protruding, and/or droopy eyes and/or droopy eyelids.

If the lash subassembly 4 is placed at the medial side of either the upper or lower lash line where the natural lashes are typically sparse, the density of lash filaments 7 gives the appearance of recession, exaggerating the lash line length and L/M width, and making the eye seem nearer to the bridge of the nose. The exaggerated length of lash filaments creates vertical emphasis, exaggerating the relationship between the eyelashes and the eye such that the eye appears to have a larger S/I width.

For eye shapes that have a horizontal characteristic at the medial corner, the eye appears to have a larger L/M width and therefore seems subtly nearer to the bridge of the nose. The exaggerated length of the lash filaments creates the appearance of diagonal emphasis upward and slightly outward toward the medial area of the eye, making the medial area of the eye seem slightly larger in terms of S/I width. Such an effect is generally an advantage for deep-set, protruding, wide-set, and/or small eyes as the natural lash line length and L/M width of the eye is exaggerated.

Given the similarity of lash subassembly 4 to the graduation in hair length of a natural eyelash, it can function very effectively when positioned at the lateral corner of the eye as a dominant lash subassembly For example, if an additional lash subassembly positioned just in from the lateral corner of the eye matches the filament length of lash subassembly 4 at the medial (shorter) side region 17 and either maintains that shorter filament length or continues the graduation towards an even shorter length, lash subassembly 4 seems to be prominent along the lash line length and therefore visually enhances the appearance of the S/I width of the eye. Because most eyelashes become sparser and shorter as they progress toward the medial portion of the eye, this same dynamic will again hold true for every additional lash subassembly positioned nearer the medial corner of the eye.

If lash subassembly 4 is placed at the lateral part of the lash line and an additional lash subassembly placed just in from the lateral corner of the eye maintains the density of lash filaments 7, an illusion of recession slightly exaggerates the length of the lash line. If the additional lash subassembly is slightly less dense, the intensity of the lash subassembly 4 then seems blended into the natural lash line, continuing to make the eye seem larger in terms of L/M width but with a subtle overall look. If the additional lash subassembly is significantly less dense, the intensity of the lash subassembly 4 becomes more obvious and may seem out of balance with the natural eyelashes.

Lash subassembly 4 also functions effectively when positioned a short distance from the lateral corner of the eyelid and an additional lash subassembly placed nearer to the lateral corner of the eyelid has filaments which are slightly shorter or less dense than lash subassembly 4. In such a case the additional lash subassembly blends lash subassembly 4 into the lateral corner of the lash line without competing for dominance. Lash subassembly 4 then provides a visual emphasis just in from the lateral corner. If the additional lash subassembly positioned at the lateral corner is just as prominent as lash subassembly 4, and has uniform filament length, it still enhances the vertical emphasis provided by lash subassembly 4 via the combined lash filament length which appears to enhance the S/I width. If filaments of the additional lash subassembly placed at the lateral corner are graduated in the same way as lash subassembly 4, this creates a sawtooth profile which may look unnatural, but may be desirable for stage and other performance-type applications.

Lash subassembly 4 also works effectively at this position if an additional lash subassembly positioned nearer the center of the eye matches the filament length of the medial (shorter) side region 17 and either maintains that shorter filament length or continues the graduation towards an even shorter length. Lash subassembly 4 then seems to be prominent along the lash line length and therefore visually enhances the appearance of the S/I width of the eye. Because most eyelashes become sparser and shorter as they progress toward the medial portion of the eye, this same dynamic will again hold true for every additional lash subassembly positioned nearer the medial corner of the eye.

If lash subassembly 4 is placed a short distance from the lateral corner of the lash line and an additional lash subassembly positioned nearer the medial part of the eye maintains its filament density, the result is an illusion of recession and prominent enlargement of the L/M width at the center of the lash line length. If the additional lash subassembly is slightly less dense, the intensity of the lash subassembly 4 seems to blend into the natural lash line, creating a subtle enhancement of the L/M width. If the additional lash subassembly is significantly less dense, the intensity of the lash subassembly 4 is obvious but also quite easily blends into the natural lash line.

Lash subassembly 4 functions effectively when positioned centrally along the lash line if the filament length of its lateral side region 15 is matched by the filament length of the medial side region of an additional lash subassembly positioned nearer the lateral part of the lash line and if this filament length is either maintained to the lateral corner of the eye or graduated with additional lash subassemblies such that it blends into the natural eyelashes. At this position and placed next to a longer and denser additional lash subassembly positioned nearer the lateral corner of the eye, lash subassembly 4 serves as a graduation between the exaggerated lateral lash subassembly and the medial part of the eye. Such an arrangement is particularly effective for stage and other performance-type applications.

Lash subassembly 4 also functions effectively at the center if of the eye, an additional lash subassembly positioned nearer the medial corner of the eye matches its lash filament length at the medial (shorter) side region 17 and either maintains that shorter length or graduates to an even shorter lash filament length such that lash subassembly 4 is prominent along the lash line length and therefore visually enhances the appearance of the S/I width of the eye. Because most eyelashes become sparser and shorter as they progress toward the medial portion of the eye, this same dynamic will again hold true for every additional lash subassembly positioned nearer the medial corner of the eye.

If at the central position an additional lash subassembly placed nearer the medial part of the eye maintains the filament density, the combined recession causes an illusion of pronounced enlargement of the L/M width at the medial corner, making the lash line length seem longer and slightly nearer to the bridge of the nose. If the additional lash subassembly positioned nearer the medial corner is slightly less dense than lash subassembly 4, the intensity of the lash subassembly 4 blends into the natural lash line, and it appears to be a subtle extension of the L/M width. If the additional lash subassembly positioned is significantly less dense than lash subassembly 4, the intensity of lash subassembly 4 is relatively visible but also may blend into the natural lash line.

Again, given its similarity to the graduation in lash filament length of the natural eyelashes, lash subassembly 4 functions effectively when positioned at the medial corner of the lash line if its lash filament length at the lateral side region 15 is matched by the length of the medial side region of an additional lash subassembly and then this filament length is either maintained to the lateral corner of the eye or graduated with additional lash subassemblies, such that the longest length is at the middle, just in from the lateral corner or at the lateral corner of the eye. If at this position the lash subassembly 4 is placed next to a longer and denser, more pronounced additional lash subassembly located centrally on the lash line, the lash subassembly 4 serves as a graduation from the extremely exaggerated center lash subassembly at the medial part of the eye. It is then possible to complete the ensemble with any number of equal, more, or less prominent additional lash subassemblies that would, respectively maintain, exaggerate, or blend in the lateral part of the lash line. Although such an arrangement may look unnatural, it may be desirable for stage and other performance-type applications.

Lash subassembly 3 is moderately dense and graduates from a longer to shorter lash filament length from the lateral side region 15 to medial side region 17. Lash subassembly 3 looks similar to the lash subassembly 4, and has the same base portion length (for example, 11 mm) but it has a slightly shorter lash filament length. This variation in lash filament length base portion length more adequately fits eyes that are smaller in size or for which lash subassembly 4 is too difficult to fit.

Lash subassembly 2 is moderately dense and graduates in lash filament length from longer at lateral side region 15 to slightly shorter at the medial side region 17. Lash subassembly 2 is similar to lash subassemblies 3 and 4, but has a less extreme graduation in lash filament length and a different base portion length, which may be, for example, 6 mm and can therefore extend along approximately ¼ to ⅓ of the natural lash line. The variation in lash filament length and subassembly width may better fit eyes that are smaller in size or for which lash subassemblies 3 and 4 are too difficult to fit.

FIG. 1 shows a first embodiment of the invention, which takes the form of an adornment 1, formed from a combination of the three lash subassemblies 2, 3, 4. The adornment 1 in this case forms a complete false eyelash, extending along the length of the natural lash line. From FIG. 1, it can be seen that the lash subassembly 4 has the longest mean filament length.

The center lash subassembly 3 continues the graduation in filament length, matching that of the lash subassembly 4 in its lateral side region 15 and reducing as it progresses towards its medial side region 17, adjacent to lash subassembly 2.

The lash subassembly 2 continues the graduation in filament length, matching that of the center lash subassembly 3 in its lateral side region 15 and reducing at its medial side region 17.

This first embodiment of the invention is particularly suitable for use with small, deep-set, and/or narrow eye shapes. As with other embodiments of the invention, the first embodiment is also highly beneficial when used with unique eye shapes that don't conform to the traditional shape of single strip lashes (i.e. where strip lashes are too long, too short, or don't curve in the same shape as the eye). The first embodiment of the invention is also suited for use with crêpey/feathered eyelids, because lash subassemblies 2, 3, 4 are fitted individually and they accommodate irregularity in the texture of the eyelid, a characteristic which is shared by the other embodiments of the present invention.

FIG. 2

Figure 2:
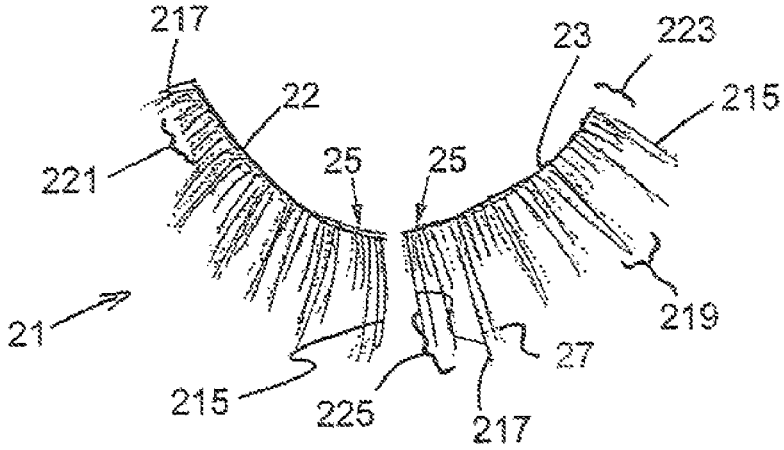
FIG. 2 is a schematic view of a second embodiment of the present invention.

FIG. 2 depicts an eyelash adornment in accordance with a second embodiment of the present invention. Description of common elements and operation similar to those previously described will not be repeated with respect to the second embodiment.

FIG. 2 illustrates a lash subassembly 23 and a lash subassembly 22. Each of the lash subassemblies 22, 23 is a soft brunette/black color, having a relatively delicate texture afforded by a relatively fine mean filament thickness.

The tips of the lash filaments 27 define, in each case, a generally convex arcuate profile that slopes from one side of the lash subassembly to the other. Each lash subassembly 22, 23 also has its lash filaments 27 arranged in a series of adjacent groupings 29. The groupings 29 each have a number of longer filaments 219 extending from amongst a number of shorter filaments 221. The longest filaments are generally longer than natural eyelashes. The filaments 219, 221 are very generally all parallel, rather than obviously convergent or divergent. The effect of having the shorter filaments 221 mixed with the longer filaments 219 is that there is a higher filament distribution density in a root region 223 of each lash subassembly than there is in its tip region 225. The consequence of this is that the each lash subassembly emboldens the appearance of the root area of the natural eyelash when in place, thereby adding definition to the eye line, by making the lash line seem denser.

Each lash subassembly 22 and 23 demonstrates continuity in the arrangement and placement of lash filaments 27, and a relatively natural allocation of lash filament density along the base portion. The pattern formed by either lash subassembly 22 or 23 against the skin along the brow bone when the eye is open is made up of soft sections of twenty-three or twenty-four parallel lash filaments 219 that emerge from the natural lashes while the shorter lash filaments 221 blend into the natural lashes.

From a sagittal view, the lash filaments 27 of lash subassembly 22 or 23 curve downwards, away from the base portion 25 and then upwards again, similar to the curve of natural lashes that are not straight or unruly. The base portion length of each lash subassembly 22, 23 may be, for example, 16 mm, which may extend along approximately ⅓ to ⅔ of the natural lash line length.

Each lash subassembly 22 and 23 generally creates the visual impression of a slightly denser distribution of lash filaments of longer length than the natural eyelashes.

For lash subassembly 23, the graduation in average length of lash filaments 27 from shorter at the lateral side region 215 to longer at the medial side region 217 slightly blends the exaggerated filament length into the natural eyelashes at the lateral corner of the eye. For lash subassembly 22, the graduation from longer at the lateral side region 215 to shorter at the medial side region 217 blends the exaggerated filament length into the natural eyelashes at the medial corner.

The lash subassemblies 22 and 23 may be placed at different positions along the upper or lower lash line. For example, if lash subassembly 23 is placed at the lateral corner of either the upper or lower lash line, the width of the lash subassembly 23 will address the natural lash line length from the lateral corner region of the eye through to some point just before or after the center region. The density of lash filaments 27 then gives the appearance of emboldening the natural characteristic of the lash line, elongating its appearance. The exaggerated length of the lash filaments 27 combined with their curve creates vertical emphasis from the lateral corner region through the center, making the eye seem larger in terms of S/I width.

For eye shapes that have a horizontal characteristic at the lateral corner, the exaggerated appearance of L/M and S/I widths is generally advantageous and flattering for deep-set, narrow/close-set, and/or small eyes and/or eyelids that are droopy at the center.

For eye shapes where the lateral part of the lash line is overly-round or has a downward orientation such that the lash line appears almost vertical, or where the skin of the brow bone is loose and rests very near the lash line, the lash subassembly 23 serves to slightly exaggerate that characteristic and makes the eye shape appear even more diagonally oriented or downward slanting. However, in some cases, the delicate texture of the lash subassembly 23 combined with the vertical emphasis at the medial end may still exaggerate the S/I width in a flattering manner.

If lash subassembly 23 is placed just in from the lateral corner of either the upper or lower lash line, the lash subassembly width will cover the lash line from this point to a point located between the center and medial part of the lash line. At this position, the density of lash filaments 27 gives the appearance of emboldening the lash line before it turns to meet the opposing eyelid at the lateral corner of the eye, thereby intensifying this area of the lash line such that it appears more pronounced than the lateral corner of the eye. The exaggerated length of the filaments 27 combined with their curve exaggerates the eye, creating vertical emphasis, just in from the lateral corner. These two effects combine in such a way as to enhance the L/M and S/I widths of the eye such that it seems larger and its orientation appears independent of the characteristics of corners of the lash lines/eyelids.

For eye shapes where the lateral part of the natural lash line is overly-round or becomes more vertical, or where the skin of the brow bone is loose and rests very near the lash line, the lash subassembly 23 is unaffected by the natural eye shape. The density of the lash filaments 27 exaggerates the horizontal shape of the lash line near the iris, distracting from the downward characteristic at the corners of the natural eye shape, and visually enhancing the L/M width. The length of the lash filaments 27 creates vertical emphasis, distracting from the downward characteristic at the corners of the natural eye shape, camouflaging loose skin and therefore visually enhancing the appearance of the S/I width. Such an effect is generally considered flattering and an advantage for overly-round, protruding, and/or droopy eyes and/or droopy eyelids.

Given the width of lash subassembly 23 and the slightly longer filament length and graduation at the medial side region 217, on some eye shapes the medial region of the iris may appear unnaturally exaggerated and slightly nearer to the bridge of the nose. This is because natural lash lines usually become slightly shorter and sparser at this part of the eye. However, on larger or wide-set eyes, this graduation in lash filament length of subassembly 23 may seem completely balanced and thus provide an effective vertical emphasis along the center and medial parts of the eye.

Given the width of the lash subassembly 23, if it is placed centrally on either the upper or lower lash line, it typically begins to cover the lash line at the center as well as the medial corner. The slight density of lash filaments 27 gives the appearance of enhancing the darkness of the lash line and through the dynamic of darker colors appearing to recede, makes the eye seem larger in terms of L/M width at the center and near the medial corner. The exaggerated length of lash filaments 27 combined with the curve of the hairs creates an emphasis upwardly and medially (vertically from the center of the eye and diagonally from the medial corner of the eye toward the bridge of the nose), making the eye seem larger in S/I width at the iris and through the medial corner of the lash line.

For eye shapes where the lateral part of the lash line has a downward orientation, or becomes more vertical, or where the skin of the brow bone is loose and rests very near the lash line, the lash subassembly 23 at this position is unaffected by the natural eye shape. The density of the lash filaments 27 exaggerates the horizontal shape of the lash line while the length of the lash filaments vertically emphasizes the lash line length above the iris and medial corner, distracting from the downward characteristic of the eye shape, camouflaging loose skin and therefore making the eye seem larger in terms of L/M and S/I width. Such an effect is generally considered flattering and an advantage for overly-round and/or droopy eyes and/or droopy eyelids.

When lash subassembly 23 is placed at the medial region of the lash line the visual effect is similar to the lash subassembly being placed centrally on the lash line given the width of the lash subassembly.

Given the slight graduation in lash filament length from shorter at the lateral side region 215 to longer at the medial side region 217 of lash subassembly 23, the lash subassembly 23 functions very effectively at the lateral corner of the eye as a subassembly that emboldens the lash line length and creates vertical emphasis along the entire lateral and center part of lash line. The lash subassembly 23 works effectively at this position if the lateral end region of an additional lash subassembly placed nearer the center/medial part of the eye matches the lash filament length at the medial side region 217 and the additional lash subassembly then graduates to an even shorter length, since most natural eyelashes become sparser and shorter in filament length as they progress to the medial portion of the eye. The same dynamic holds true for any additional lash subassembly(ies) positioned nearer the medial corner of the eye.

If lash subassembly 23 is placed at the lateral corner and if an additional lash subassembly(ies) placed nearer the center/medial part of the eye matches the lash filament length of the medial side region and either maintains that lash filament length or continues to graduate to an even longer length, the overall look tends not to be particularly natural but can be effective for narrowing wide-set eyes.

If an additional lash subassembly placed nearer the medial area of the eye maintains the density of lash filaments 27, an illusion of recession makes the eye seem larger in terms of L/M width and lash line length. If such an additional lash subassembly is slightly less dense, the intensity of the lash subassembly 23 then seems to be blended into the natural lash line, continuing its enlargement of the L/M width but with a subtle overall look. If the additional lash subassembly is significantly less dense, the intensity of the lash subassembly 23 becomes obvious but appears to increase the lash line length of the eye while flattering the natural lash line.

When placed just in from the lateral corner of the eye, lash subassembly 23 functions particularly effectively if an additional lash subassembly positioned nearer the lateral corner of the eye is slightly shorter and/or less dense/prominent, thereby functioning as a camouflage subassembly that blends lash subassembly 23 into the lateral corner of the lash line without competing for dominance. A similar visual effect is achieved if an additional lash subassembly positioned further nearer the medial/central part of the eye matches the lash filament length of medial side region 217 and maintains or gradually increases the lash filament length of the medial side region, thereby creating an appearance that is effective for narrowing wide-set eyes.

If the lateral side of an additional lash subassembly placed nearer the center/medial part of the eye matches the lash filament length of medial side region 217 of lash subassembly 23, and the additional lash subassembly then graduates to an even shorter filament length, lash subassembly 23 functions particularly effectively because natural eyelashes generally become sparser and shorter they progress toward the medial portion of the eye. The same dynamic again holds true for any additional lash subassembly(ies) positioned nearer the medial corner of the eye.

If an additional lash subassembly placed nearer the medial part of the lash line maintains the density of lash filaments 27, an illusion of recession makes the eye seem larger in terms of L/M width above/below the iris. If an additional lash subassembly placed nearer the medial part of the lash line is slightly less dense, the intensity of lash subassembly 23 seems to blend into the natural lash line, continuing enlargement of the L/M width but with a subtle overall look. If an additional lash subassembly is significantly less dense, the intensity of lash subassembly 23 tends to be slightly obvious but also blends into the natural lash, thereby making the eye seem larger in terms of L/M width at the medial corner and above/below the iris.

When positioned centrally above the eye, the slight graduation in lash filament length from shorter at the lateral side region 215 to longer at the medial side region 217 of lash subassembly 23 exaggerates the lash line length and creates vertical emphasis at the entire center and medial parts of the lash line.

If an additional lash subassembly positioned nearer the lateral corner of the eye matches the lash filament length at the lateral end region 215 of lash subassembly 23 and either maintains that length to the lateral corner or continues graduation to an even shorter lash filament length, the combined effect creates vertical emphasis at the medial end of the eye, appearing to narrow wide-set eyes.

Lash subassembly 23 functions particularly effectively at the center of the lash line if an additional lash subassembly positioned nearer the medial part of the eye functions as a camouflage subassembly, matching the lash filament length of the medial side region 217 and progressing to an even shorter length, as most natural eyelashes are sparser and shorter as they extend toward the medial portion of the eye.

The relative density of lash filaments in additional lash subassemblies will have a similar effect as to when lash subassembly 23 is positioned just in from the lateral corner.

If lash subassembly 23 is placed at the medial region of the lash line it will have a similar function to when positioned more centrally along the lash line.

Lash subassembly 22 illustrated in FIG. 2 has the same density and arrangement of lash filaments as lash subassembly 23 but with variation in the graduation of the filament length wherein its lateral side region 215 has filaments which are longer in length than at its medial side region 217.

The graduation in lash filament length from longer at the lateral side region 215 to shorter at the medial side region 217 serves slightly to blend the exaggerated lash filament length into the natural lash line at the medial side region 217 of the subassembly.

The visual effect created by lash subassembly 22 when placed at the lateral corner of the eye is similar to the visual effect created by lash subassembly 23, except that the graduation is in the opposite direction. Thus lash subassembly 22 creates vertical emphasis at its lateral side region 215 rather than its medial side region 217.

The visual effect created by lash subassembly 22 when placed just in from the lateral corner of the eye is similar to the visual effect created by lash subassembly 23 on the various eye shapes.

The visual effect created by lash subassembly 22 when placed centrally on the lash line is similar to the visual effect created by lash subassembly 23 on the various eye shapes. The exaggerated lash filament length combined with the curve of the lash filaments 27 creates an effect wherein the lash filaments extend vertically from the center of the eye shape and more diagonally from the medial corner toward the bridge of the nose, thereby creating vertical emphasis making the eye appear deceptively larger in S/I width.

For eye shapes where the lateral part of the lash line has a downward orientation, or becomes more vertical, or where the skin of the brow bone is loose and rests very near the lash line, the length of the lash filaments 27 of lash subassembly 22 creates vertical emphasis, allowing the lateral portion of the eye to appear more delicate, masking the overly-round characteristics of it, camouflaging loose skin and therefore making the eye seem larger in terms of S/I width. This visual effect is generally considered flattering and advantageous for overly-round and/or droopy eyes and/or droopy eyelids.

For eyes that are particularly wide-set, the positioning of lash subassembly 22 centrally on the lash line has a similar effect to positioning lash subassembly 23 centrally or just in from the lateral corner of the eye, except that graduation in lash filament length acts in the opposite direction thereby exaggerating the lateral rather than the medial side region.

Positioning lash subassembly 22 at the medial region of the lash line will have a similar effect to positioning the lash subassembly 22 centrally on the lash line due to its width extending from the central through to the medial region of the eye.

Given its similarity to the graduation in lash filament length of the natural eyelashes, lash subassembly 22 functions very effectively at the lateral corner to embolden the lash line length and create vertical emphasis along the entire lateral and center portion of the lash line. It functions particularly effectively at the lateral corner if an additional lash subassembly located at the center/medial part of the eye matches its lash filament length toward the medial (shorter) side region 217 and either maintains that shorter length or continues graduation toward an even shorter length. This is because most natural eyelashes become sparser and shorter as they progress toward the medial portion of the eye. The same dynamic again holds true for any additional lash subassembly(ies) positioned nearer the medial corner of the eye.

If placed at the lateral part of the lash line and if an additional lash subassembly located nearer the center/medial part eye maintains the density of lash filaments, an illusion of recession creates the appearance of significant enlargement of the eye's L/M width and lash line length. If the lash subassembly at the center/medial part of the eye is either slightly or significantly less dense than lash subassembly 22, it intensity then seems to blend into the natural lash line, continuing its enlargement of the eye's L/M width and lash line length but with a less prominent overall look.

Given its similarity to the graduation in lash filament length of natural eyelashes, lash subassembly 22 functions very effectively as a lash subassembly that appears to embolden the lash line length and create vertical emphasis just in from the lateral corner and center parts of the lash line.

Lash subassembly 22 works particularly effectively at this position if an additional lash subassembly positioned nearer the lateral corner of the eye is slightly shorter or less dense/prominent, blending lash subassembly 22 into the lateral corner of the lash line without competing for dominance. Lash subassembly 22 then creates vertical emphasis just in from the lateral corner of the eye, appearing to enlarge the eye's S/I and L/M widths via its filament length and density.

If an additional lash subassembly located at the lateral corner is just as prominent or even more prominent than lash subassembly 22, but uniform in lash filament length or slightly shorter, it still gives the appearance of enlarging the eye's L/M width provided by lash subassembly 22 while the graduation in filament length creates S/I emphasis.

If an additional lash subassembly placed at the lateral corner is also graduated from longer to shorter, it then creates a sawtooth profile extending from the lateral area of the lash line which looks highly unnatural, but may be desirable in performance and stage applications.

Lash subassembly 22 works particularly effectively just in from lateral corner if an additional lash subassembly positioned nearer the center of the eye matches its filament length at the medial (shorter) side region 217 and either maintains that shorter length or progresses to an even shorter filament length as most natural eyelashes become sparser and shorter near the medial portion of the eye. The same dynamic would again hold true for any additional lash subassemblies positioned nearer the medial corner of the eye.

If lash subassembly 22 is placed just in from the lateral corner of the lash line and an additional lash subassembly positioned nearer the medial part of the eye maintains the filament density, an illusion of recession and enlargement of the eye's L/M width at the center of the lash line occurs.

If an additional lash subassembly positioned nearer the medial part of the eye is slightly less dense then lash subassembly 22, the intensity of lash subassembly 22 blends into the natural lash line, continuing its apparent enlargement of the eye's L/M and S/I widths and lash line length but with a subtle overall look. If the additional lash subassembly is significantly less dense, the intensity of lash subassembly 22 may or may not blend into the natural lash line, depending upon the density and length of the natural eyelashes.

Given its similarity to the graduation in lash filament length of the natural eyelashes, lash subassembly 22 functions particularly effectively at the center of the lash line as a subassembly that emboldens the lash line length and creates vertical emphasis in the center and medial parts of the lash line Lash subassembly 22 functions effectively at this position if its filament length at the lateral side region 215 is matched and then either maintained to the lateral corner of the eye or graduated either to longer or shorter with additional lash subassemblies so as to integrate its density and filament length into the natural eyelashes.

If lash subassembly 22, when situated at this position, is placed next to a longer and denser, more prominent additional lash subassembly at the lateral corner, it serves as a graduation between the extremely exaggerated lash subassembly and the medial part of the eye. This arrangement might look unnatural, but may be desirable for stage and other performance-type applications.

If lash subassembly 22 is placed next to a shorter and significantly less prominent additional lash subassembly at the lateral corner of the eye, it creates vertical emphasis at the lateral edge of the iris. Although this may appear unnatural, given its low filament density, lash subassembly 22 it may also serve as an appropriate enhancement at the center of the relatively large eyes, appearing to enlarge the S/I width of the eye.

Lash subassembly 22 also works effectively at a central position if an additional lash subassembly located toward the medial corner of the eye matches its filament length towards the medial (shorter) side region 217 and either maintains that shorter length or continues graduation toward an even shorter filament length, as most eyelashes become sparser and shorter at the medial portion of the eye. The same dynamic would again hold true for any additional lash subassembly(ies) positioned nearer the medial corner of the eye.

If an additional lash subassembly located nearer the medial part of the eye maintains the filament density of lash subassembly 22, an illusion of recession and therefore significant enlargement of the eye's L/M width and lash line length occurs, making the eye seem slightly nearer to the bridge of the nose at the medial corner. If the additional lash subassembly is slightly less dense than lash subassembly 22, the intensity of this subassembly then seems to blend into the natural lash line, making the eye seem larger in terms of L/M width and lash line length but with a subtle overall look. If the additional lash subassembly is significantly dense, the intensity of lash subassembly 22 becomes more obvious but may quite easily blend into the natural lash line.

Positioned at the medial area of the lash line, lash subassembly 22 functions similarly to when it is placed at the center of the eye, due to its width covering most of the central and medial parts of the lash line length in both central and medial placements.

FIG. 2 shows a second embodiment of the invention, which takes the form of an adornment 21 formed from the two lash subassemblies 22, 23. The adornment 21 in the second embodiment of the invention forms a complete false eyelash with each lash subassembly 22, 23 extending along approximately ½ of the total subassembly width. The effect of having the shorter filaments 221 mixed with the longer filaments 219 is that there is a higher filament distribution density in the root region 223 of each lash subassembly than there is in its tip region 225. The consequence of this is that the adornment 21 emboldens the appearance of the root area of the natural eyelash when in place, thereby adding definition to the lash line length, by making it seem denser and therefore larger in terms of L/M width.

This second embodiment of the invention is particularly suitable for use with small, deep-set, and/or narrow eye shapes. When in place, the effect is such as to provide a change in visual emphasis from the lateral corner of the eye to the center of the lash line, which makes the S/I width appear larger and helps make the eye appear more round. Because this embodiment is formed from just two subassemblies, it is very quick and easy to fit, although it can still be arranged along the lash line in such a manner as to address the specific physical requirements of the intended wearer.

FIG. 3

Figure 3:
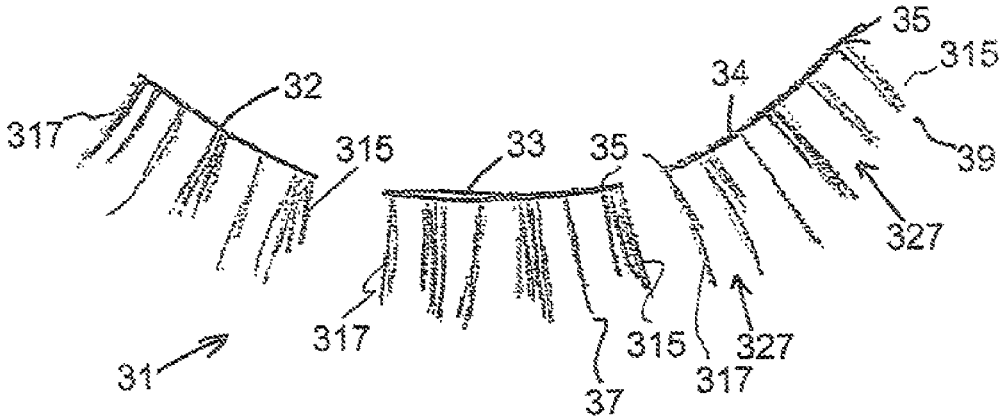
FIG. 3 is a schematic view of a third embodiment of the present invention.

FIG. 3 depicts an eyelash adornment in accordance with a third embodiment of the present invention. Description of common elements and operation similar to those previously described will not be repeated with respect to the third embodiment.

FIG. 3 illustrates three lash subassemblies 32, 33 and 34. Each of the lash subassemblies 32, 33, 34 is a soft black color, having a delicate texture afforded by a relatively fine mean filament thickness.

Each lash subassembly 32, 33, 34 has a generally continuous texture and displays a substantially constant length of its lash filaments 37 from one side to the other. The mean filament length also is substantially the same in each lash subassembly 32, 33, 34 which is generally shorter than most natural eyelashes. Each lash subassembly 32, 33, 34 also has its lash filaments 37 arranged in a series of groupings 39. In this case the groupings 39 are spaced at regular intervals along the base portion 35 of the lash subassembly 32, 33, 34 (i.e., there are gaps 327 between the individual groupings).

The lash filaments 37 are very generally all parallel, rather than obviously convergent or divergent. The filaments 37 also have a very short mean lash filament length. The consequence of this configuration is that the lash subassemblies embolden the appearance of the root area of the natural eyelashes when in place, thereby giving the impression of increased definition to the lash line, by making the lash line area seem denser. Thus the pattern that forms against the skin along the brow bone when the eye is open is that of the natural lashes, with a seemingly darker and denser lash line. From a sagittal view, the lash filaments 37 begin to curve downward, away from the base portion 35 Their restricted lash filament length prevents the possibility of an upward turn, so they seem to have a straighter profile. The respective lengths of the base portions 32, 33, 34 may be, for example, 8 mm, 9 mm, and 9 mm. Each subassembly therefore extends across approximately ¼ to ½ of the natural lash line.

As with most embodiments of the invention, the lash filaments 37 can be colored in many different ways. In this particular case they can also be colorless, pale, or brown in color to achieve a more subtle effect.

Lash subassemblies 32, 33 and 34 create a visual effect that appears to be a more dense distribution of lash filaments along the lash line length, seeming to enhance the L/M width of the eye while maintaining the existing length of the natural lashes. Such an arrangement provides a conservative yet highly effective way to enhance the overall look of the lash line while maintaining a completely natural appearance because the pattern that is formed when the eye is open is that of the natural lashes against the skin of the eyelid, thereby maintaining the pattern of the natural lashes.

Alternative embodiments having different arrangements of lash filaments are also effective if the lash filaments are of a similar length to lash filaments 37. If the length of the lash filaments is shorter than the length of natural lashes, this helps significantly to embolden the lash line and create the same visual effect regardless of the precise arrangement of the filaments.

If any of lash subassemblies 32, 33, or 34 are placed at the lateral corner of either the upper or lower lash line, the density of lash filaments 37 appears to enhance the characteristic of the natural lash line, emboldening the appearance of the lash line length and making the eye seem larger in terms of L/M width. For eyes that have a prominently horizontal orientation at the lateral corner, the eye then appears to have a stronger than natural horizontal characteristic, which makes the eye appear to be generally larger. Such an arrangement is generally an advantage for deep-set, narrow/close-set, and/or small eyes.

If the lash subassembly 32, 33, or 34 is placed just in from the lateral corner of either the upper or lower lash line, the resulting density appears to embolden the natural lash line in this area without altering the characteristic of the lash line where it turns to meet the opposing eyelid at the lateral corner of the eye, intensifying the lash line and making this area of the lash line seem longer and more dominant than the lateral corner of the eye. For eyes that have a prominently horizontal orientation at the lateral corner, the eye then appears to have a stronger than natural horizontal characteristic, but the lash line length seems less elongated than if the subassembly was placed at the lateral corner.

For eyes where the lateral part of the lash line has a downward characteristic, or a more vertical orientation, or where the skin of the brow bone is loose and rests very near the lash line, lash subassembly 32, 33, or 34 is unaffected by that shape and makes the eye seem larger in terms of L/M width than it does naturally. The density of the lash appears to exaggerate the lash line near the iris, distracting from the downward characteristic of the eye shape. Such an arrangement is generally considered flattering and an advantage for overly-round, protruding, and/or droopy eyes and/or droopy eyelids.

If lash subassembly 32, 33, or 34 is placed centrally on either the upper or lower lash line, the density gives the appearance of emboldening the lash line, making the eye seem larger in terms of L/M width just above/below the iris. For eye shapes where the lateral part of the lash line has a downward characteristic, or becomes more vertical, or where the skin of the brow bone is loose and rests very near the lash line, lash subassembly 32, 33, or 34 is unaffected by that shape and makes the eye seem larger in terms of L/M width than it does naturally, distracting from the downward characteristic of the eye shape. This arrangement is generally considered flattering and an advantage for overly-round, protruding, and/or droopy eyes and/or droopy eyelids.

If lash subassembly 32, 33, or 34 is positioned at the medial region of either the upper or lower lash line, its density gives the appearance of recession, visually exaggerating the appearance of the medial area of lash line and making the eye seem nearer to the bridge of the nose. For eye shapes that have a mostly horizontal characteristic at the medial corner, the eye then appears to have an enhanced L/M width which lies nearer to the bridge of the nose. Such an effect is generally an advantage for deep-set, wide-set, protruding, and/or small eyes.

The most effective placement of this type of lash subassembly would be among other similar subassemblies, so as to maintain the appearance of the length of the natural lashes. Lash subassembly 32, 33, or 34 can, however, be integrated into other combinations of lash subassemblies functioning strictly as a filament root emphasis or density enhancer that will appear to integrate and balance the density and varying lash filament lengths of other types of lash subassemblies.

Lash subassembly 32, 33, or 34 functions particularly effectively when positioned at the lateral corner of the lash line if an additional lash subassembly positioned nearer the center of the lash line is of a longer filament length and of a moderate to extreme density such that lash subassembly 32, 33, or 34 functions as a camouflage subassembly, blending the additional lash subassembly(ies) into the lateral corner of the eye. If lash subassembly 32, 33, or 34 is placed at the lateral corner of the eye and a longer subassembly with very light filament density is placed nearer the center of the eye, it provides a subtle enhancement of the eye's L/M width at the lateral corner of the eye due to its filament density.

Lash subassembly 32, 33, or 34 works particularly effectively just in from the lateral corner of the eye if an additional lash subassembly positioned nearer the lateral corner of the eye has filaments which are only slightly longer than or equal to the natural lashes, preferably graduating in lash filament length from longer at the lateral side region to shorter at the medial side region, This arrangement creates the appearance of a natural looking enhancement of the eye's L/M width where subassembly 32, 33, or 34 blends the lateral additional lash subassembly into the natural lashes.

If an additional lash subassembly located nearer the lateral corner of the eye has filaments that are obviously longer or denser than those of lash subassembly 32, 33, or 34, the combination may appear as an unbalanced prominent enhancement at the lateral corner, but give a look which may be desired in some applications.

If an additional lash subassembly located nearer the center of the eye has filaments that are very slightly longer than the natural lashes or slightly less dense, creating vertical emphasis at the center and/or medial corners of the lash line, lash subassembly 32, 33, or 34 blends that vertical emphasis into the natural lash line, making the eye seem larger in terms of L/M width but with a subtle overall look in such a way that may provide an advantage for wide-set eye shapes.

If an additional lash subassembly located nearer the center or medial part of the lash line is obviously denser and longer, the additional subassembly serves to create a highly unnatural balance to the center and medial part of the eye which tends to break the linear look of the lashes. This arrangement may be very effective for creating vertical emphasis at the center of the eye, in order to enhance eye shapes that are wide-set and/or droopy at the center of the eyelid.

Lash subassembly 32, 33, or 34 functions particularly effectively at the central region of the lash line if the filament lengths of additional lateral lash subassemblies are roughly the same or slightly longer than the natural lashes and graduated into shorter filament lengths so as to integrate the longer lateral lash filaments into the lash line at the center of the eye.

If lash subassembly 32, 33, or 34 is positioned centrally and placed next to obviously longer and denser, more prominent lash subassembly(ies), lash subassembly 32, 33, or 34 graduates the extremely exaggerated lash subassembly(ies) into the medial part of the eye.

If lash subassembly 32, 33, or 34 is placed between significantly less dense lash subassemblies, lash subassembly 32, 33, or 34 seems to embolden the lash line at the center of the iris. If placed between far more prominent subassemblies on either side, the balance of the eye would be disrupted, but this can prove to be a flattering effect for protruding eye shapes.

Lash subassembly 32, 33, or 34 functions particularly effectively at the center region of the lash line if an additional lash subassembly positioned nearer the medial corner of the eye has filaments that are not longer than the natural lashes. In such a case it emboldens the lash line from the center through the medial corner. The same dynamic holds true for every additional subassembly placed nearer the medial corner of the eye.

If an additional lash subassembly positioned nearer the medial part of the eye maintains the density of lash filaments, an illusion of recession and therefore moderate enlargement of the eye's L/M width at the medial corner occurs, making the eye seem nearer to the bridge of the nose.

Given the fine density and short length of lash filaments 37, lash subassembly 32, 33, or 34 functions very effectively at the medial corner of the eye. It may blend an additional lash subassembly of any size, shape, lash filament density, or length into the medial corner of the eye where the natural eyelashes are particularly short and sparse.

Lash subassembly 32, 33, or 34 functions particularly effectively at the medial corner of the lash line if its filament length is matched at the medial side region 317 of the additional lash subassembly and then graduated with additional lash subassemblies such that the longest lash filament length is either at the middle of the lash line, just in from the lateral corner or at the lateral corner of the eye.

When placed the medial part of the lash line and next to particularly longer and denser, more prominent additional lash subassemblies nearer the center of the lash line, lash subassembly 32, 33, or 34 can serve as a graduation between the extremely exaggerated additional lash subassemblies and the medial part of the eye. It is then possible to complete the adornment with an equal, more, or less prominent lash subassembly at the lateral corner that can maintain, exaggerate, or integrate the lateral part of the lash line. Such an arrangement may be desirable for stage and other performance-type applications.

Lash subassembly 32 has a shorter base length than lash subassemblies 33 and 34, making it easier to accommodate in the medial corner of the eye, especially where the medial area of the lash line changes orientation as it becomes nearer the tear duct and is consequently a difficult location for adhesion of the subassembly.

FIG. 3 shows a third embodiment of the invention, which takes the form of an adornment 31 formed from the three lash subassemblies 32, 33, 34. The adornment 31 is intended to extend along some portion of the entire natural lash line length and each lash subassembly 32, 33, 34 extends across approximately ⅓ of the total adornment width.

The consequence of the configuration of lash filaments 37 of lash subassemblies 32, 33 and 34 is that the lash subassemblies very much concentrate on emboldening the appearance of the root area of the natural eyelash, thereby adding definition to the lash line length by making it appear denser.

This third embodiment of the invention is particularly suitable for any eye shape with thin or sparse lashes, as it appears to embolden the lash line, enhancing the L/M width of the eye. In alternative embodiments of the invention, the lash subassemblies can also be clear, pale or brown in color, or any combination of these colors to achieve a more subtle effect. It will be understood that although three subassemblies are illustrated here for ease of application, variations of this embodiment can include differing numbers of lash subassemblies (preferably up to 5). Textures, widths, varieties, and combinations thereof can also vary, with the adornment extending along approximately 1/10 to ½ of the whole lash line. The effect is particularly beneficial to unique eye shapes that don't conform to the traditional shape of traditional single strip lashes, i.e., where single strip lashes would be too long, too short, or don't curve in the same shape as the eye. This type of adornment is particularly beneficial for loose or crêpey/feathered eyelids as the subassemblies are placed individually, accommodating irregularity in the texture of the eyelid.

FIG. 4

Figure 4:
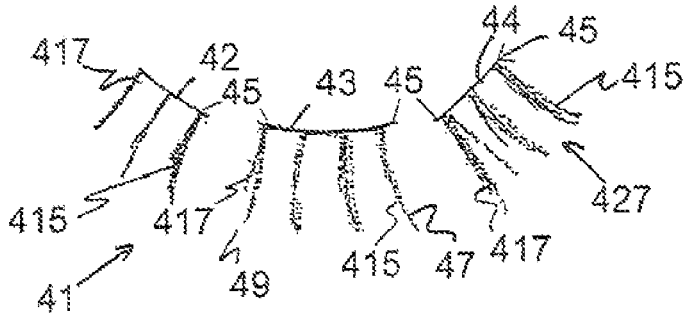
FIG. 4 is a schematic view of a fourth embodiment of the present invention.

FIG. 4 depicts an eyelash adornment in accordance with a fourth embodiment of the present invention. Description of common elements and operation similar to those previously described will not be repeated with respect to the fourth embodiment.

Lash subassemblies 42, 43, and 44 are illustrated in FIG. 4. Each lash subassembly 42, 43, 44 has a generally continuous texture and displays a substantially constant length of its lash filaments 47 from one side to the other, however, the medial lash subassembly 42, is slightly shorter in filament length at its medial side region 417 such that it more easily blends into short and sparse lashes at the medial area of the lash line. The mean filament length of the center lash subassembly 43 is subtly greater than those of the other two, such that it is suitable for use with natural lashes that are subtly longer than average.

Each lash subassembly 42,43, 44 has its lash filaments 47 arranged in a series of groupings 49. In this case the groupings are spaced at regular intervals along the base portion 45 of the lash subassembly 42, 43, 44 (i.e., there are gaps 427 between the individual groupings). The intervals (i.e. gap sizes) are the same in each lash subassembly 42, 43, 44. Each of the lash subassemblies 42, 43, 44 is a soft black color. In alternative embodiments they may be a clear, pale, or brown in color to achieve a more subtle effect. From a sagittal view, the lash filaments 47 curve upward, away from the base portion 45 and then downward again, similar to the curve of natural lashes on the bottom eyelid that are not straight or unruly. The respective lengths of the base portions of the subassemblies 42, 43, and 44 may be, for example, 6 mm, 9 mm, and 6 mm. They can each extend along approximately ⅕ to ½ of the natural lash line The pattern formed by lash subassembly 42, 43, or 44 against the skin along the brow bone when the eye is open depends upon the length and density of the natural lashes. For shorter and/or sparse lashes, there will be a slight elongation at the tips of the clusters and a corresponding increase in density down to the lash line. For average length and density lashes, there will be an alternating increase in density, creating a more dense effect, making the natural eyelashes look thicker.

Each lash subassembly 42, 43, 44 can create an alternating impression of a more dense distribution of hair within the lash line while maintaining the existing density and length of the natural lashes between clusters.

Each lash subassembly provides the appearance of a subtle increase in density among the natural eyelashes. The density of lash filaments 47 creates the appearance of a larger M/L width and the length of the lash filaments creates 47 a vertical emphasis, making the eye look larger in terms of S/I width. The lash subassemblies 42, 43, and 44 can consequently provide a conservative yet highly effective way to enhance the overall look of the lash line while maintaining a completely natural appearance. This is because the pattern that is formed when the eye is open is that of natural lashes viewed against the skin of the eyelid, the pattern being only slightly interrupted by lash subassemblies 42, 43, or 44. These lash subassemblies therefore maintain the natural pattern of the eyelashes while appearing to enhance the L/M and S/I widths of the eye.

If lash subassembly 42, 43, or 44 is placed at the lateral corner of either the upper or lower lash line, the subtle density gives the appearance of emboldening the appearance of the lash line and making the eye seem bigger in terms of L/M width. The length of the lash filaments 47 combined with their curve creates an effect wherein the filaments create vertical emphasis at the lateral corner, giving the eye the appearance of being larger in terms of S/I width.

For eye shapes that have a horizontal characteristic at the lateral corner of the lash line, the eye appears to have a more defined appearance. The density and length of the lash filaments creates subtle emphasis near the lateral side of the eye area, making the overall eye shape seem slightly larger in L/M and S/I width. Such an arrangement is generally an advantage for deep-set, narrow/close-set and/or small eyes.

For eye shapes where the lateral part of the lash line has a downward characteristic, or becomes more vertical, or where the skin of the brow bone is loose and rests very near the lash line, the filament density and length of lash subassemblies 42, 43, or 44 can exaggerate that shape and create a more diagonal or downward slanting appearance in the eye shape. Such an arrangement can be delicate enough to be flattering to mild versions of these eye shapes.

If lash subassembly 42, 43, or 44 is placed just in from the lateral corner of either the lower or upper lash line, the sparse filament density subtly emboldens the natural lash line before its orientation changes or turns to meet the opposing eyelid at the lateral corner of the eye, thereby exaggerating the L/M width of the eye and making this area of the lash line seem more dominant than the lateral corner of the eye.

For eye shapes where the lateral part of the lash line has a downward orientation, or becomes more vertical, or where the skin of the brow bone is loose and rests very near the lash line, lash subassembly 42, 43, or 44 functions independently of that shape. The density of the lash filaments exaggerates the length of the lash line, distracting from the downward characteristics of the eye shape. Such an arrangement is generally considered flattering and an advantage for round, protruding, and/or droopy eyes and/or droopy eyelids.

If lash subassembly 42, 43, or 44 is placed in a central region of either the upper or lower lash line, the alternating density gives the appearance of enhancing the prominence of the lash line while the filament length makes the eye appear slightly larger in terms of S/I width just above/below the iris.

For eye shapes where the lateral part of the lash line has a downward orientation, or becomes more vertical, or where the skin of the brow bone is loose and rests very near the lash line, lash subassembly 42, 43, or 44 is unaffected by that shape. The density of the lash exaggerates the eye's L/M width, distracting from the downward characteristic of the eye shape at the lateral and medial corners. Such an arrangement is generally considered flattering and an advantage for round, protruding, and/or droopy eyes and/or droopy eyelids.

If lash subassembly 42, 43, or 44 is placed in the medial region of either the lower or upper lash line, the density and length of the lash filaments 47 gives the appearance of emboldening the lash line length, exaggerating the appearance of the medial lash line and making the eye seem nearer to the bridge of the nose. For eye shapes that extend generally horizontally at the medial corner, the eye then appears larger in terms of L/M width and nearer the nose. Such an arrangement is generally an advantage for deep-set, wide-set, and/or small eyes.

Given their similarity to a natural lash line, lash subassemblies 42, 43, or 44 function very effectively at the lateral eye corner as a subtle subassembly next to other lash subassemblies. Lash subassemblies 42, 43, or 44 tend to function particularly effectively at the lateral corner if an additional lash subassembly positioned toward the center of the eye matches the filament length and either maintains that length or continues graduation toward a shorter filament length, since most eyelashes become sparser and shorter as they progress toward the medial portion of the eye. If a lash subassembly 42, 43, or 44 is placed at the lateral eye corner and a longer/denser additional lash subassembly is placed next to it, either just in from the lateral corner or nearer the center of the eye, the lash subassembly 42, 43, or 44 blends the longer/denser additional subassembly into the lash line at the lateral corner of the eye.

Given its similarity to the natural lash line, each lash subassembly functions very effectively if positioned just in from the lateral corner of the eye if an additional lash subassembly positioned nearer the lateral corner of the eye has shorter filaments and is less dense/prominent, functioning as a camouflage subassembly that blends lash subassembly 42, 43, or 44 into the lateral corner of the lash line without competing for dominance.

Each lash subassembly 42, 43, or 44 also functions particularly effectively if positioned just in from the lateral eye corner if an additional lash subassembly positioned nearer the lateral corner of the eye has longer filaments and is more prominent. In such a case, lash subassembly 42, 43, or 44 functions as a camouflage subassembly that blends the prominent subassembly into the natural eyelashes.

Each lash subassembly 42, 43, or 44 is also particularly effective just in from the lateral eye corner if an additional lash subassembly positioned nearer the center of the eye matches its filament length and either maintains that length or continues graduation toward an even shorter length, as most natural eyelashes become sparser and shorter near the medial portion of the eye. The same dynamic again holds true for any additional lash subassembly positioned nearer the medial corner of the eye.

If an additional lash subassembly positioned nearer the central or medial part of the eye has filaments that are either slightly longer or graduated to a longer length, lash subassembly 42, 43, or 44 blends the additional subtle or prominent subassemblies into the center of the lash line.

If an additional lash subassembly positioned nearer the central or medial part of the eye maintains the density and filament length, there appears to be a slight enlargement of the eye's L/M width at the center of the lash line.

If lash subassembly 42, 43, or 44 is placed just in from the lateral eye corner and an additional lash subassembly nearer the central or medial part of the eye has filaments that are shorter and/or less dense, the intensity of lash subassembly 42, 43, or 44 can quite easily blend into the natural lash line, continuing to make the eye seem slightly larger in terms of L/M width.

Given its similar appearance to that of the natural lash line, lash subassembly 42, 43, or 44 functions particularly effectively at the center of the lash line if its filament length and density is matched at both end regions of the lash subassembly and then either maintained or graduated with additional lash subassemblies so as to integrate its lash filament length at the medial and lateral corners of the eye.

At this position and placed next to a longer and denser, more prominent additional lash subassembly near the lateral part of the lash line, lash subassembly 42, 43, or 44 blends the exaggerated lash subassembly into the central part of the eye. If placed next to a shorter and less prominent additional subassembly at the lateral corner, the lash subassembly slightly emboldens the central region of the lash line. The lash subassembly would also work particularly effectively at the center region if an additional lash subassembly positioned toward the medial corner of the eye matches its filament length and either maintains that length or progresses toward an even shorter filament length as most eyelashes become sparser and shorter near the medial portion of the eye. The same dynamic again holds true for any additional lash subassemblies positioned nearer the medial corner of the eye.

If one of lash subassemblies 42, 43, or 44 is placed at a center region of the eye and more dense subassemblies are placed on either side of it with roughly similar filament lengths, it functions as a bridge between prominent eye lash subassemblies, blending the vertical emphasis at the lateral and medial corners of the lash line, which is appropriate for protruding and some extremely round eyes.

Given its ergonomic similarity to the natural lash line, lash subassembly 42, 43, or 44 functions particularly effectively at the medial corner of the lash line if its filament length is matched at the lateral end of the lash subassembly and then either maintained to the lateral corner of the eye or graduated with other lash subassemblies such that the longest filament length is at the middle, just in from the lateral corner or at the lateral corner of the eye. If placed at the medial part of the lash line next to a prominent lash subassembly, it blends the exaggerated additional subassembly into the medial part of the eye. It is then possible to complete the adornment with either an equal, more, or less prominent subassembly that would, respectively maintain, exaggerate, or integrate the lateral part of the lash line.

FIG. 4 shows a fourth embodiment of the invention, which takes the form of an adornment 41 formed from three lash subassemblies 42, 43, 44. The adornment 41 is intended to extend along some portion of the lash line length of a natural eyelash and each lash subassembly 42, 43, 44 may extend along approximately ⅓ of the total adornment width. This adornment 41 is intended primarily for use on a lower eyelid but may also be used on an upper eyelid.

This fourth embodiment of the invention is particularly suitable for use with deep-set, droopy eyes and any eye with thin, sparse, or short lashes by enhancing the appearance of the eye's L/M width without substantially altering the appearance of the natural eyelashes.

FIG. 5

Figure 5:
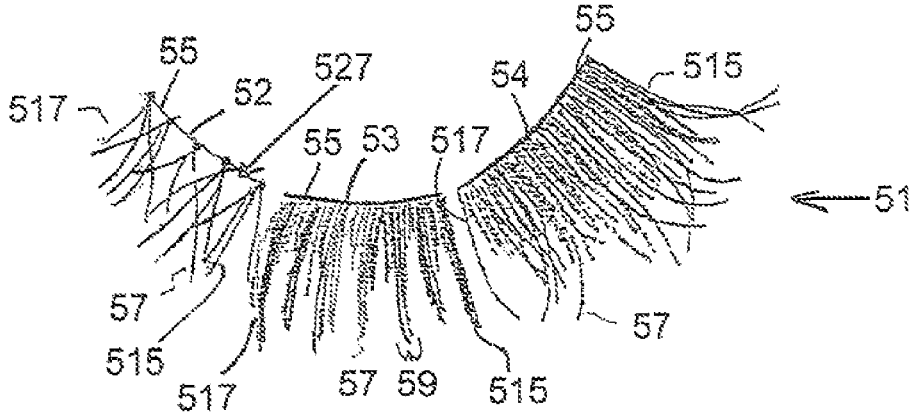
FIG. 5 is a schematic view of a fifth embodiment of the present invention.

FIG. 5 depicts an eyelash adornment in accordance with a fifth embodiment of the present invention. Description of common elements and operation similar to those previously described will not be repeated with respect to the fifth embodiment.

Lash subassemblies 52, 53 and 54 are illustrated in FIG. 5. The three lash subassemblies 52, 53, 54 are all black but have individual characteristics that vary significantly from each other. The lash subassembly 54 has pronounced visual intensity and provides prominent emboldening of a natural eyelash. It is also formed from lash filaments 57 that are relatively thick and have a relatively long mean filament length. The filaments 57 are distributed relatively densely along its base portion 55 and create the appearance of emboldening the lash line. The lash subassembly 54 demonstrates a continuity of a fairly dense arrangement and placement of filaments along the attachment section, the majority of which are parallel and of fairly even lengths, but every 30 hairs or so a particularly long segment of lash filaments 57 with a random curved shape at the tip emerges from the rows of filaments, collectively amounting up to a wispy, mildly chaotic finish along the edge of the distal ends of the lash filaments. The overall graduation in filament length is longer at the lateral side region 515 to shorter at the medial side region 517 of the lash subassembly 54. The pattern that forms against the skin along the brow bone when the eye is open looks more like a curtain of lashes rather than elongated clusters of lash filaments as they do in lash subassembly 4 of the first embodiment. From a sagittal view, the lash filaments curve downwards, away from the base portion 55 and then upward again, similar to the curve of natural lashes. The length of the base portion 55 may be, for example, 13 mm and therefore may extend along approximately ¼ to ½ of a natural lash line.

Lash subassembly 54 creates an impression of a far more dense distribution and longer filament length than the natural eyelashes. The slightly chaotic finish of the distal ends of the lash filaments along the edge of the of the lash subassembly 54 effectively imitate the lack of continuity that is often found in a natural lash line.

When located at various positions along the lash line and when combined with additional lash subassemblies lash subassembly 54 creates similar visual effects to lash subassembly 4 of the first embodiment.

The arrangement of lash subassembly 54 provides an option for wearers who prefer a hairier, more random and less controlled, non-spiky effect at the tips of the lashes wherein the pattern along the brow bone when the eye is open looks dense and elongate in length.

Lash subassembly 53 has much in common with the lash subassemblies of the first embodiment. The primary differences are that the triangular groupings 59 are shaped by filament length, rather than by filament convergence. In addition, there are no intermediate groupings. The mean filament length of the groupings increases from the slightly longer lateral side region 515 of the lash subassembly 53 towards its slightly shorter medial side region 517. The lash filaments are moderate in terms of mean filament length and density.

Lash subassembly 53 has lash filaments that demonstrate a continuity of the arrangement and placement of hair, slightly dense along base portion 55. The triangular groupings 59 are generally longer than an average natural eyelash, but are loosely formed such that the groupings are slightly random but with an overall continuity in shape and size. The pattern that forms against the skin along the brow bone when the eye is open is elongated clusters of lash filaments, but they are loosely formed and softly shaped. Similar to previous embodiments, from a sagittal view, the lash filaments curve downward, away from the base portion and then upward again, similar to the curve of natural lashes that are not straight or unruly. The length of the base portion 55 may be, for example, 10 mm and therefore may extend along approximately ¼ to ½ of a natural lash line length.

When located at various positions along the lash line and when combined with additional lash subassemblies, lash subassembly 53 offers similar visual effects to a lash subassembly 4 of the first embodiment of the invention, but with a less dense, less controlled, softer, and more random appearance at the tips of the lash filaments. The arrangement provides an option for wearers who prefer a softer, less controlled yet still softly spiky effect.

The lash subassembly 52 is delicate in texture and sparsely populated along a virtually invisible base portion 55. The lash filaments 57 are arranged in sparse groupings, which are generally divergent. The groupings are distributed at intervals along the base portion 55, with gaps 527 between. The lash filaments 57 graduate from longer at the lateral side region to shorter at the medial side region.

When lash 52 is in position, the pattern that forms against the skin along the brow bone when the eye is open is a slightly random, delicate placement of lash filaments that are longer than average lashes but are not necessarily perpendicular to the lash line. They tend to emerge from the lash line in a variety of directions, creating the appearance of longer than average eyelashes. In alternative embodiments, the lash filaments may also be clear, pale or brown in color to achieve a more subtle effect.

From a sagittal view, the hairs curve downward, away from the attachment section and then upward again, similar to the curve of natural lashes that are not straight or unruly. The length of the base portion 55 of subassembly 52 may be, for example, 9 mm and therefore may extend along approximately ⅕ to ½ of the natural lash line.

When located at various positions along the lash line and when combined with additional lash subassemblies, lash subassembly 52 creates similar visual effects to lash subassembly 4 of the first embodiment of the invention, but with a variation in the density of lash filament groupings and the pattern of the shorter lash filaments. It provides an option for wearers who prefer a softer, less dense, non-spiky effect but wish to benefit from the length and graduation of the lash filaments. This subassembly tends to be suited to smaller, more sparse, or shorter natural lashes.

FIG. 5 shows a fifth embodiment of the invention, which takes the form of an adornment 51 formed from the three lash subassemblies 52, 53, 54. The adornment is intended to extend along some portion of the lash line length of a natural eyelash and each lash subassembly 52, 53, 54 represents approximately ⅓ of the total adornment width.

When the three lash subassemblies 52, 53, 54 are assembled together to form the adornment 51, the visual effect of the adornment varies across the lash line length due to the differences in the individual lash subassemblies 52, 53, 54. The longest lash filament length and greatest density arises at the lateral corner of the eye, while shortest filament length and lowest density arises at the medial corner. Overall, the tip profiles of the three lash subassemblies together describe a convex curve. A dense black graduates to sparse black from the lateral to medial eye corners. The adornment 51 also intensifies the lash line at the medial corner of the eye while maintaining a natural appearance.

This embodiment is particularly suitable for use with deep-set and narrow eye shapes, and eye shapes where the medial corner of the lash line changes direction, with a downward characteristic as it progresses nearer the medial tear duct. This particular embodiment also serves to give the impression of increased S/I and L/M width at the lateral corner of the eye, while the medial corner stays natural-looking.

FIG. 6

Figure 6:
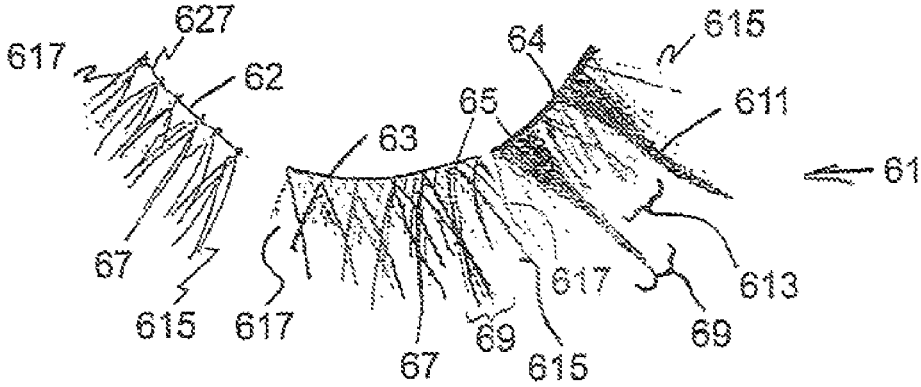
FIG. 6 is a schematic view of a sixth embodiment of the present invention.

FIG. 6 depicts an eyelash adornment in accordance with a sixth embodiment of the present invention. Description of common elements and operation similar to those previously described will not be repeated with respect to the sixth embodiment.

Lash subassemblies 62, 63 and 64 are illustrated in FIG. 6. The lash subassembly 64 is matte black, the longest in mean filament length and has the most dense filament distribution of the three lash subassemblies 62, 63, 64. This creates the impression of an emboldened lash line with a convergent tip profile. This lash subassembly 64 also has its lash filaments 67 arranged in a series of adjacent groupings 69. Some of the groupings 69 take the form of relatively large groupings 611, in which the filaments are strongly convergent, so as to form a triangular shape. These are interspersed with rather more wispy intermediate groupings 613, in which the filaments are generally divergent, crossing over each other into X-shaped patterns that are generally slightly shorter than the average natural lash. The large groupings 611 have a respectively larger mean filament length than the intermediate groupings 613. As a consequence of the alternating characteristics of the groupings 69, their respective filament tips collectively cause a crenellated pattern to overlie the general subassembly profiles. Very generally, the crenellations are triangular in character.

The pattern that forms against the skin along the brow bone when the eye is open is that of softly elongated spiky clusters of lash filaments that are longer than the natural lashes while the shorter tier of hairs blend into the natural lashes. From a sagittal view, the hairs curve downward, away from the attachment section and then upward again, similar to the curve of natural lashes that are not straight or unruly. The longest lash filaments 617 of the large groupings 611 are of relatively equal lengths and the lash filaments 617 of the shorter intermediate groupings 613 are also of relatively equal lengths, forming an almost double-tiered look. The length of the base portion 65 may be, for example, 10 mm and therefore may extend along approximately ¼ to ½ of a natural lash line.

The visual effect created upon the lash line is an impression of a denser distribution and longer filament length than natural eyelashes. The differentiation between the longer and shorter groupings serves to blend the exaggerated filament length into the natural lash line.

When located at various positions along the lash line and when combined with additional lash subassemblies, lash subassembly 64 creates similar visual effects to lash subassembly 4 of the first embodiment of the invention but with a variation on the density of both the longer groupings and the shorter groupings of lash filaments. Such an arrangement provides an option for wearers who prefer a softer, less prominent yet still softly convergent effect and more density at the roots of the natural eyelashes.

Lash subassembly 64 functions very effectively when positioned at the lateral corner of the eye as a dominant subassembly next to additional lash subassemblies. Lash subassembly 64 works particularly effectively at the lateral corner, if an additional lash subassembly positioned just in from the lateral corner of the eye is either slightly shorter in filament length or as long as the longest filament length of lash subassembly 64 and then either maintains that length or continues graduation toward an even shorter length, since eyelashes become sparser and shorter near the medial portion of the eye. The same dynamic holds true for any additional subassembly located nearer the medial corner of the eye. If an additional subassembly placed just in from the lateral corner of the eye is longer, a double extension of the lash line is created by the diagonal orientation of the longer clusters of lash subassembly 64 and the diagonal orientation of the longer additional subassembly placed next to it nearer the center of the eye. This double extension of the lash line gives the impression of several long clusters along the lash line and although it is rather extreme, it creates an interesting effect that may be desirable for stage and other performance-type applications.

If lash subassembly 64 is placed at the most lateral part of the lash line and an additional lash subassembly positioned just in from the lateral corner of the eye maintains its density, an illusion of recession makes the eye seem larger in terms of L/M width. If the additional lash subassembly is slightly less dense, the intensity of the lash subassembly 64 then blends into the natural lash line, continuing its enlargement of the eye's L/M width but with a subtle overall look. If the additional lash subassembly is significantly less dense, the intensity of the lash subassembly 64 can be dissipated by the contrast between the shorter tier and the longer clusters of hairs.

Lash subassembly 64 functions particularly effectively if positioned just in from the lateral corner of the eye if an additional lash subassembly positioned nearer the lateral corner of the eye has slightly shorter filaments and is less pronounced, thereby functioning as a camouflage subassembly, blending lash subassembly 64 into the lateral corner of the lash line without competing for dominance. Lash subassembly 64 then provides exaggeration just in from the lateral corner as its longer clusters create the appearance of a diagonal emphasis from the natural lash line, giving the impression of an increase in the eye's S/I width. If the additional lash subassembly is just as prominent as lash subassembly 64, but uniform in filament length or slightly shorter, it will still enhance the diagonal emphasis provided by lash subassembly 64. If the additional lash subassembly placed at the lateral corner is also graduated or spiky it creates the appearance of several diagonal extensions from the lash line and tends to look highly pronounced.

Lash subassembly 64 also works particularly effectively just in from lateral corner if an additional lash subassembly positioned nearer the center of the eye either has slightly shorter filaments or matches the filament length of its longer clusters and either maintains that length or continues graduation toward an even shorter length. This is because most eyelashes become sparser and shorter nearer the medial portion of the eye. The same dynamic would again hold true for any additional subassembly situated nearer the medial corner of the eye. If lash subassembly 64 is placed just in from the lateral corner and a longer, additional lash subassembly is placed next to it nearer the center of the lash line length, that longer additional lash subassembly creates vertical emphasis at the center and the long cluster of lash subassembly 64 then blends the longer subassembly at the center into the lash line at the lateral corner of the eye.

If lash subassembly 64 is placed just in from the lateral corner of the lash line and an additional lash subassembly positioned nearer the medial part of the eye maintains its density, an illusion of recession makes the eye seem larger in terms of L/M width at the center of the lash line. If the additional lash subassembly is slightly less dense, the intensity of lash subassembly 64 then blends into the natural lash line, continuing its enlargement of the L/M widths but with a subtle overall look. If the additional lash subassembly is significantly less dense, the intensity of this subassembly can quite easily blend into the natural lash line, thereby appearing to makes the eye seem larger in terms of L/M width.

Lash subassembly 64 functions particularly effectively at the center of the lash line if the filament length of its longer clusters is either matched or remains slightly longer than an additional lash subassembly placed nearer the lateral corner of the eye and the additional lash subassembly then graduates with other lash subassemblies so as to integrate the density and filament length of lash subassembly 64 nearer the lateral corner of the eye. If at this position lash subassembly 64 is placed next to a longer, denser, and more prominent additional lash subassembly, lash subassembly 64 serves as a graduation between the extremely exaggerated additional lash subassembly and the medial part of the eye. Such an arrangement may be desirable for stage and other performance-type looks.

Lash subassembly 64 works particularly effectively at a central region of the lash line if an additional lash subassembly positioned nearer the medial corner of the eye is either slightly shorter or matches its longest filament length and either maintains that length or continues graduation toward an even shorter length as most eyelashes become sparser and shorter near the medial portion of the eye. The same dynamic would again hold true for any additional subassembly located toward the medial corner of the eye.

If lash subassembly 64 is placed at the center of the lash line and an additional lash subassembly positioned nearer the medial part of the eye maintains its density, an illusion of recession and therefore significant enlargement of the L/M width of the eye at the medial corner occurs, making the eye seem slightly nearer to the bridge of the nose. If the additional lash subassembly is slightly less dense, the intensity of lash subassembly 64 then seems to be blended into the natural lash line, continuing its apparent enlargement of the L/M width but with a less obvious over all look. If the additional lash subassembly is significantly less dense, the intensity of lash subassembly 64 can be noticeable but can also quite easily blend into the natural lash line, thereby continuing to make the eye seem larger in terms of L/M width if blended into the lash line with the appropriate subassemblies at the lateral portion of the eye.

Lash subassembly 64 functions particularly effectively at the medial corner of the lash line if its filament length is matched or nearly matched and then either maintained to the lateral corner of the eye or graduated with other subassemblies such that the longest lash filament length is either at the middle, just in from the lateral corner or at the lateral corner of the eye. If at this position lash subassembly 64 is placed next to a longer, denser and more prominent additional lash subassembly at the center, lash subassembly 64 serves as a graduation into the extremely exaggerated center additional lash subassembly at the medial part of the eye. It is then possible to complete the adornment with an equally, more, or less prominent additional lash subassembly that would, respectively maintain, exaggerate, or integrate the lateral part of the lash line. Such an arrangement can be effective for stage and other performance-type looks.

The center lash subassembly 63 is soft black in color with a delicate appearance. Its lash filaments 67 are sparsely distributed and it approximately matches the lash subassembly 64 in terms of mean filament length. The filament length of this lash subassembly gradually reduces from its lateral side region 615 towards its medial side region 617, hence the filament tips describe a convex curve. The lash filaments 67 in this lash subassembly 63 are arranged in contiguous groupings 69, which are demarked by variations in filament length and thickness. Essentially, each grouping 69 has a series of filaments inclined in one lateral direction and another, overlapping series inclined in the opposite lateral direction, with a relatively thick filament at each end and shorter, finer filaments between. The longer filaments are, generally, longer than an average natural eyelash, creating a subtle look. The shorter lash filament lengths are slightly shorter than the average natural lash The pattern that forms against the skin along the brow bone when the eye is open is that of lash filaments that are longer than the natural lashes, emerging in diagonal directions from the lash line. The shorter tier of hairs blends into the natural lashes. From a sagittal view, the lash filaments 67 curve downward, away from the base portion 65 and then upward again, similar to the curve of natural lashes that are not straight or unruly. The length of the base portion 65 may be, for example, 12 mm and therefore may extend along approximately ¼ to ½ of a natural lash line.

Lash subassembly 63 creates similar visual effects to lash subassembly 64 4 of the first embodiment when placed at various positions and when combined with additional lash subassemblies. Lash subassembly 63 provides an option for wearers who prefer a softer, less dense, non-convergent effect but wish to benefit from the lash filament length and graduation.

The lash subassembly 62 is virtually clear, being formed from exceptionally fine filaments 67. The lash filaments 67 of lash subassembly 62 are of an average to longer length that are roughly equal to each other in overall density but graduate from longer at the lateral side region 615 to shorter and the medial side region 617. Lash subassembly 62 provides an intermittent/spaced lash line treatment, with gaps between clusters of lash filaments 627 attached to a virtually invisible lash line.

Lash filaments 67 of lash subassembly 62 diverge as they become farther away from the lash line and then realign and become parallel to each other. The pattern that forms against the skin along the brow bone when the eye is open depends upon the length and density of the natural lashes. For shorter and/or sparse lashes, there will be a slight exaggeration at the tips of the lash filaments and a corresponding subtle increase in density down to the lash line. For average length and density lashes, there will be an overall increase in density, creating a more full effect, making the natural lashes look thicker.

Lash subassembly 62 can be brown or black in color to achieve a more obvious effect. From a sagittal view, the hairs curve downward, away from the attachment section and then upward again, similar to the curve of natural lashes that are not straight or unruly. The length of the base portion 65 of lash subassembly 62 may be, for example, 8 mm and therefore may extend along approximately ⅕ to ½ of the natural lash line length.

Generally, the clear clusters of lash filaments of lash subassembly 62 increase the overall impression of density and length of the natural lashes in direct proportion to the amount of mascara or other opaque makeup that is applied to them. Lash subassembly 62 emboldens the natural lashes, its density makes the eye seem larger in terms of L/M width, and its filament length makes the eye seem larger in terms of S/I width. Lash subassembly 62 provides a conservative, yet highly effective way to enhance the overall look of the lash line while maintaining a natural appearance because of the pattern that is formed when the eye is open. This pattern replicates that of natural lashes against the skin of the eyelid which is only slightly altered by this lash subassembly 62 as it acquires the same texture as the natural lashes through the application of mascara or other makeup. Lash subassembly 62 thus maintains the pattern of the natural lashes.

The different visual effects created due to the positioning of lash subassembly 62 are similar to those of lash subassembly 2 of the first embodiment of the invention but provide an option for a softer texture in the pattern formed against the brow bone and also provide an option for customized color.

Given its ergonomic similarity to the graduation in lash filament length of the natural lash line, lash subassembly 62 functions particularly effectively at the lateral corner as a moderate subassembly next to additional lash subassemblies. Lash subassembly 62 also works particularly effectively at the lateral corner of the eye if an additional lash subassembly placed just in from the lateral corner of the eye matches the filament length of subassembly 62 at the medial (shorter) side region 617 and either maintains that shorter length or continues graduation toward an even shorter filament length, as most eyelashes become sparser and shorter near the medial portion of the eye. The same dynamic would again hold true for any additional subassembly placed toward the medial corner of the eye. If the additional lash subassembly has longer filaments, lash subassembly 62 either blends that additional lash subassembly into the natural lash line at the lateral corner or, depending upon the length and density of the natural lashes, it creates a double emphasis in filament length at the lateral corner of the eye. If the additional lash subassembly maintains the density, an illusion of recession makes the eye seem larger in terms of L/M width. If the additional lash subassembly is slightly less dense, the intensity of the lateral segment then seems to blend into the natural lash line, continuing to make the eye seem larger in terms of L/M width but with a subtle overall look. If the additional lash subassembly is significantly less dense, the intensity of the lash subassembly 62 is obvious and therefore stands out along the lash line, enhancing the eye but seeming out of balance with the natural lash line. A balance can be achieved, however, with an adequate application of mascara.

Given its similarity to the graduation in length of the natural eyelashes, lash subassembly 62 functions very effectively just in from the lateral corner of the eye. It works particularly effectively at this position if an additional lash subassembly positioned nearer the lateral corner of the eye has filaments that are slightly shorter and less dense/prominent, thereby functioning as a camouflage subassembly that blends lash subassembly 62 into the lateral corner of the lash line without competing for dominance. Lash subassembly 62 then creates the appearance of vertical emphasis through its graduation and density. If the additional lash subassembly is more prominent than lash subassembly 62, but uniform in filament length and slightly longer, it will still tend to enhance the vertical emphasis provided by lash subassembly 62 through the overall graduation at the lateral corner of the eye.

If an additional lash subassembly positioned nearer the center of the eye matches the length of subassembly 62 near the medial (shorter) side region 617 and either maintains that shorter filament length or continues graduation toward an even shorter length, this can be particularly effective, as most eyelashes become sparser and shorter near the medial portion of the eye. The same dynamic would again hold true for any additional subassembly placed nearer the medial corner of the eye.

If lash subassembly 62 is placed just in from the lateral corner of the lash line and an additional lash subassembly located towards the medial part of the eye maintains its density, an illusion of recession makes the eye seem larger in terms of S/I width above/below the iris and makes the eye seem larger in terms of L/M width at the center of the lash line.

If lash subassembly 62 is placed just in from the lateral corner of the lash line and an additional lash subassembly located nearer the center of the eye has filaments that are slightly less dense, the intensity of lash subassembly 62 then seems to blend into the natural lash line, making the eye seem larger in terms of L/M width but with a subtle overall look. If an additional lash subassembly positioned nearer the center of the eye is significantly less dense, the intensity of lash subassembly 62 can quite easily blend into the natural lash line, making the eye seem larger in terms of L/M width just outside and above the iris.

Given its ergonomic similarity to the graduation in filament length of the natural lash line, lash subassembly 62 functions particularly effectively at the center of the lash line if its filament length is matched at its lateral side region 615 and then either maintained to the lateral corner of the eye or graduated with additional lash subassemblies so as to integrate its density and filament length into the adornment.

If at this position lash subassembly 62 is placed next to a lash subassembly having filaments that are longer, denser, and more prominent at the lateral corner, it serves as a graduation between the extremely exaggerated lateral additional lash subassembly and the central/medial part of the eye, thereby blending the lateral additional lash subassembly into the natural lash line If at this position lash subassembly 62 is placed next to a shorter and significantly more subtle additional lash subassembly at the lateral corner of the eye, it creates the appearance of vertical emphasis and slight enhancement of the S/I width.

If an additional lash subassembly located towards the medial corner of the eye matches the filament length of lash subassembly 62 at the medial (shorter) side region 617 and either maintains that shorter length or progresses to an even shorter lash filament length, this can be particularly effective, as most eyelashes are sparser and shorter near the medial portion of the eye. The same dynamic holds true for any additional subassembly nearer the medial corner of the eye.

If lash subassembly 62 is placed at the center of the lash line and an additional lash subassembly located towards the medial part of the eye maintains its filament density, an illusion of recession makes the eye seem larger in terms of L/M width but slightly nearer to the bridge of the nose.

If an additional lash subassembly located towards the medial corner has filaments that are slightly less dense, the intensity of lash subassembly 62 blends into the natural lash line, making the eye seem slightly larger in terms of L/M width but with a subtle overall look. If an additional lash subassembly is significantly less dense, the intensity of lash subassembly 62 will tend to blend easily into the natural lash line.

Lash subassembly 62 also functions particularly effectively at the medial corner of the lash line if its filament length is matched at its lateral side region by an additional lash subassembly and then this length is either maintained to the lateral corner of the eye or graduated with other additional lash subassemblies, such that the longest filament length is at the middle, just in from the lateral corner or at the lateral corner of the eye. When placed at the medial part of the lash line and next to a longer and denser, more prominent additional lash subassembly located nearer the center, lash subassembly 62 blends the extremely exaggerated central additional lash subassembly into the medial part of the lash line. It is then possible to complete the adornment with an equal, more, or less prominent additional lash subassembly that, respectively maintains, exaggerates, or integrates the lateral part of the lash line. Such an arrangement may be desirable for stage and other performance-type applications.

At the medial part of the lash line and placed next to a shorter and significantly less prominent additional lash subassembly, lash subassembly 62 seems to create vertical emphasis with a subtle exaggeration in the L/M width of the eye near the bridge of the nose.

FIG. 6 shows a sixth embodiment of the invention, which takes the form of an adornment 61 formed from the three lash subassemblies 62, 63, 64. The adornment is intended to extend along some portion of the natural lash line length and each lash subassembly 62, 63, 64 extends across approximately ⅓ of the total adornment width. This particular embodiment is characterized by a substantial graduation in both texture and color, from one end region to another. Lash subassembly 62 serves to cause the adornment 61 to graduate from the density and the filament length of the center lash subassembly 63 into an invisible lash filament density and length building structure.

This adornment is particularly suitable for use with eyes that are deep-set, narrow, and/or droopy at the lateral corner. It is also effective for use with lash lines where the medial corner and bottom lashes are quite sparse, and/or where the medial corner has a downward orientation near the tear duct.

In use, this adornment creates a pronounced enhancement at the lateral corner of the eye without the intensity of a full, dense set of spiked lashes, therefore eliminating the resistance to adhesion created by dense lashes.

FIG. 7

Figure 7:
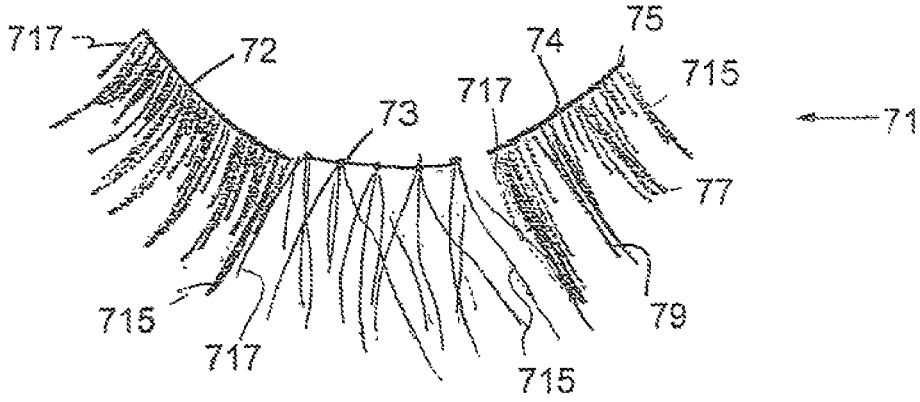
FIG. 7 is a schematic view of a seventh embodiment of the present invention.

FIG. 7 depicts an eyelash adornment in accordance with a seventh embodiment of the present invention. Description of common elements and operation similar to those previously described will not be repeated with respect to the seventh embodiment.

FIG. 7 illustrates a lash subassembly 74, a lash subassembly 73 and a lash subassembly 72.

The lash subassembly 74 has a relatively dense distribution of lash filaments 77, which have a relatively high mean thickness. The lash subassembly 74 is generally rich black in color with a very soft and slightly spiky look. The lash filaments 77 are arranged in adjacent groupings 79, which are each rendered triangular in profile as a consequence of the distribution of filament lengths. The overall tip profile of the lash subassembly 74 is a fairly severe straight-line slope from its lateral side region 715 to its medial side region 717. The triangular shape of the groupings 79 also imposes a series of triangular crenellations on this basic profile.

This lash subassembly 74 creates a relatively obvious effect in the part of the eye where it is situated in use. The pattern that forms against the skin along the brow bone when the eye is open is made up of elongated clusters of lash filaments, but they are loosely formed and slightly dense. From a sagittal point of view, the lash filaments 77 curve downward, away from the base portion 75 and then upward again, similar to the curve of natural lashes that are not straight or unruly. The shortest length of lash filaments 77 is located at the lateral side region 715 and the filament length increases nearer the medial side region 717. The length of the base portion 75 may be, for example, 10 mm and therefore extends across approximately ¼ to ½ of a natural lash line.

The effect upon the lash line of lash subassembly 74 is that it creates the impression of a moderately dense distribution and longer filament length than the natural eyelashes. The graduation from shorter at the lateral side region 715 to longer at the medial side region 717 blends the exaggerated lash filament length into the natural lash line at the lateral side region of the lash subassembly 74. The lash subassembly 74 creates the appearance of vertical emphasis at the center and medial parts of the lash line rather than standard graduation, which emphasizes the lateral end of the lash line.

Lash subassembly 74 can be placed at different positions along the lower or upper natural lash line and creates different visual effects depending on its position.

If placed at the lateral corner of the eye of either the upper or lower lash line, the density of lash filaments 77 gives the appearance of emboldening the lash line length and making the eye seem larger in terms of L/M width. The exaggerated length of the filaments combined with the curve of the lash filaments creates an effect where the lash filaments extend upward and outward from the lash line, exaggerating the S/I width of the eye.

For eye shapes that have a horizontal characteristic at the lateral corner, the filament density creates a more prominent appearance, which makes the eye seem larger in terms of L/M width. The exaggerated length of the lash filaments 77 creates vertical emphasis and enhances the S/I width. Such an effect is generally an advantage for deep-set, narrow/close-set, and/or small eyes.

For eye shapes where the lateral part of the lash line has a downward characteristic, or becomes more vertical, or where the skin of the brow bone is loose and rests very near the lash line, the density of lash subassembly 74 may slightly exaggerate that shape, making the lateral corner of the eye seem lower than the iris, reducing the appearance of the L/M width and making the eye appear smaller. However, the vertical emphasis created by the filament length at the medial side region 717 of the lash subassembly 74 may in some individual instances balance the downward orientation of the lateral side region 715, which can be effective for eyelids which are only mildly round, protruding, and/or droopy.

If lash subassembly 74 is positioned just in from the lateral corner of the eye of either the upper or lower lash line, the density of the lash filaments 77 gives the appearance of emboldening the natural lash line length before its orientation changes to meet the opposing eyelid at the lateral corner of the eye, thereby intensifying this area of the lash line such that is appears larger in terms of L/M width and more dominant than the lateral corner of the eye. The exaggerated filament length combined with the curve of the lash filaments 77 creates upward emphasis at the medial end, and diagonally outward at the lateral end thereby gives the eye the look of an exaggerated S/I width regardless of the characteristic of corners of the lash lines and/or eyelids.

For eye shapes that have a horizontal characteristic at the lateral corner, the eye appears to have an emboldened lash line length, although it appears smaller in lash line length than if the lash subassembly 74 is placed at the lateral corner. The exaggerated length of lash filaments creates the appearance of both vertical and diagonal emphasis, enhancing the eye's S/I width, but not quite as effectively as it would be if the lash subassembly 74 was placed at the lateral corner.

For eye shapes where the lateral part of the lash line has a downward characteristic, or becomes more vertical nearer the corners of the eye, or where the skin of the brow bone is loose and rests very near the lash line, lash subassembly 74 is unaffected by that shape and makes the eye seem larger in terms of L/M and S/I width than it does naturally. The density of the lash filaments 77 emboldens the lash line, distracting from the downward characteristic of the eye shape and creating the impression of a larger L/M width.

The length of the lash filaments 77 creates vertical emphasis and the appearance of larger S/I width by intensifying the filament length and allowing the lateral corner of the eye to appear more delicate, suppressing the downward or round characteristic of it and camouflaging loose skin. Such an effect is generally considered flattering and an advantage for round, protruding, and/or droopy eyes and/or droopy eyelids.

If lash subassembly 74 is placed centrally along either the upper or lower lash line, the slight density of lash filaments 77 appears to darken the lash line, making the eye seem larger in terms of L/M width. The exaggerated length of lash filaments 77 combined with their curve creates vertical emphasis, making the eye appear larger in terms of S/I width.

For eye shapes where the lateral part of the lash line has a downward orientation, or becomes more vertical, or where the skin of the brow bone is loose and rests very near the lash line, lash subassembly 74 at the central location is unaffected by that shape. The density of the lash filaments 77 exaggerates the lash line length while the length of the lash filaments 77 creates vertical emphasis, allowing the lateral portion of the eye to appear more delicate, suppressing the downward or round characteristic of it, camouflaging loose skin and therefore making the eye seem larger in terms of S/I width. Such an effect is generally considered flattering and an advantage for round and/or droopy eyes and droopy eyelids.

When positioned nearer the medial corner of the upper or lower lash line, the density of lash filaments 77 gives the appearance of recession, thereby exaggerating the appearance of the eye's L/M width and making the lash line seem nearer to the bridge of the nose. The exaggerated filament length combined with the curve of the lash filaments 77 creates vertical emphasis, making the eye seem larger in terms of S/I width.

Given its graduation in lash filament length from shorter at the lateral side region 715 to longer at the medial side region 717, lash subassembly 74 functions very effectively at the lateral area of the eye if an additional lash subassembly located nearer the center/medial part of the eye matches its filament length toward the medial (longer) side region 717 and continues graduation to an even shorter length since most eyelashes are sparser and shorter near the medial portion of the eye. The same dynamic again holds true for every additional lash subassembly nearer the medial corner of the eye.

If lash subassembly 74 is placed at the lateral corner and an additional lash subassembly located nearer the center/medial part of the eye matches its lash filament length and either maintains that length at the medial side region 717 or continues to graduate to an even longer filament length, the overall look would be effective for narrowing wide-set eyes. If an additional lash subassembly located toward the center/medial part of the eye maintains the density, an illusion of recession makes the eye seem larger in terms of L/M width. If the additional lash subassembly is slightly less dense, the intensity of the lash subassembly 74 seems to be integrated into the natural lash line, continuing to make the eye seem larger in terms of L/M width but with a subtle overall look. If the additional lash subassembly is significantly less dense, the intensity of the lateral segment might be slightly obvious but likely to remain flattering along natural lash line.

Given its graduation in lash filament length from shorter at the lateral side region 715 to longer at the medial side region 717, lash subassembly 74 also functions very effectively just in from the lateral corner of the eye if an additional lash subassembly located near the lateral corner of the eye either matches its filament length or is slightly shorter and/or less dense, blending lash subassembly 74 into the lateral corner of the lash line without competing for dominance. If the additional lash subassembly is as prominent as lash subassembly 74, the result is the same as placing lash subassembly 74 at the lateral corner of the eye rather than just in from the lateral corner.

Lash subassembly 74 works effectively just in from the lateral corner if an additional lash subassembly(ies) located nearer the medial part of the eye matches its lash filament length near the medial (longer) side region 717 and either maintains it or continues graduation to an even shorter filament length, creating vertical emphasis along the center and medial parts of the eye. Since most eyelashes are sparser and shorter near the medial portion of the eye, the same dynamic again holds true for every additional lash subassembly nearer the medial corner of the eye.

If the additional lash subassembly(ies) placed nearer the medial part of the eye matches the lash filament length of lash subassembly 74 at its medial side region 717 and graduates to an even longer filament length, the overall look appears larger in terms of S/I width and is effective for narrowing wide-set eyes. If the additional lash subassembly(ies) located toward the medial part of the eye maintains the density of lash filaments 77, an illusion of recession creates an obvious enlargement of the L/M width above/below the iris and makes the eye seem larger in terms of L/M width at the center and medial parts of the lash line. If the additional lash subassembly located nearer the medial region of the eye is slightly less dense, the intensity of lash subassembly 74 is then integrated into the natural lash line, continuing to make the eye seem larger in terms of L/M width but with a subtle overall look.

Given its graduation in lash filament length from shorter at the lateral side region 715 to longer at the medial side region 715, lash subassembly 74 functions effectively at the center of the eye if an additional lash subassembly(ies) nearer the lateral corner of the eye matches its length at the lateral side region 715 and either maintains that length or continues graduation toward an even shorter filament length at the lateral corner. This then creates vertical emphasis at the center of the lash line.

If an additional lash subassembly located at the medial corner of the eye matches the lash filament length of lash subassembly 74 at the medial (longer) side region 715 and either maintains that length or becomes longer, it creates vertical emphasis and the impression of larger S/I width, such that the lash line looks nearer to the bridge of the nose. If the additional lash subassembly(ies) located nearer the medial part of the eye matches and maintains its filament density, it creates the impression of a larger L/M width, such that the overall look is also effective for narrowing wide-set eyes.

The center lash subassembly 73 is very similar in structure to the lash subassembly 52 of the fifth embodiment while being slightly longer and causes a similar untraditional effect. Lash subassembly 73 may have a base portion length of, for example, 9 mm.

The dynamics of placing it at various positions along the lash line and using it with additional lash subassemblies are most effective when combined with additional lash subassemblies that are slightly longer than average.

The lash subassembly 72 is very similar in structure to the central lash subassembly 53 of the fifth embodiment, but with a slightly less dense filament thickness and a finer shape to the triangular groupings 79. Similar effects to those described for lash subassembly 53 are created when lash subassembly 72 is placed at different positions along the lash line and when combined with different additional lash subassemblies. Lash subassembly 72 may have a base portion length of, for example, 11 mm.

FIG. 7 shows a seventh embodiment of the invention, which takes the form of adornment 71 formed from the three lash subassemblies 72, 73, 74. The adornment is intended to extend along some portion of the lash line length and each lash subassembly 72, 73, 74 may extend along approximately ⅓ of the total adornment width. This particular embodiment may be characterized by a substantial graduation in both texture and color, from one side to another. Overall, the adornment 71 exhibits a relatively even distribution of mean filament length, with a slight reduction at each end.

This adornment is particularly suitable for use with protruding eye shapes, where the center of the eye is more bulbous than at the corners. This is because the visual emphasis of the adornment 71 emboldens the eye's medial and lateral corners, creating visual balance at the center of the protruding eye shape. At the same time, the relatively delicate center lash subassembly 73 located at the middle will simply blends the medial and lateral subassemblies into the natural eyelashes. The overall result will be a decrease in the visual focus on the center of the lash line and eyelid, creating the illusion of a more balanced, flatter appearance.

FIG. 8

Figure 8:
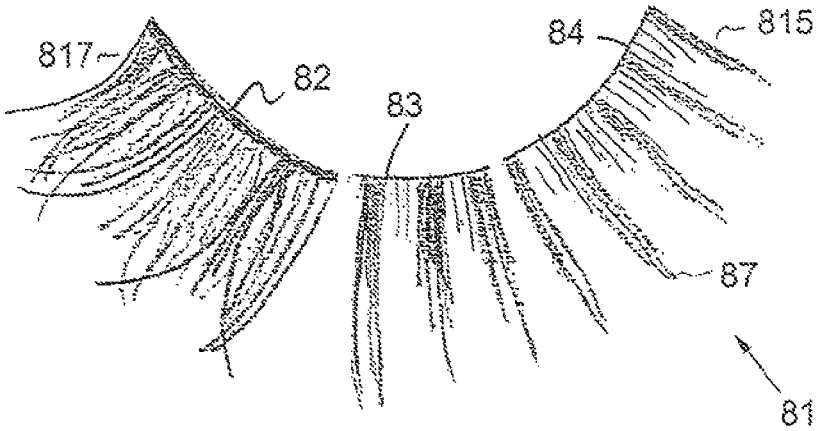
FIG. 8 is a schematic view of an eighth embodiment of the present invention.

FIG. 8 depicts an eyelash adornment in accordance with an eighth embodiment of the present invention. Description of common elements and operation similar to those previously described will not be repeated with respect to the eighth embodiment.

FIG. 8 illustrates a lash subassembly 84, a lash subassembly 83 and a lash subassembly 82. In this embodiment, the lash subassembly 83 and the lash subassembly 84 are both very similar in form to the lash subassembly 74 of the previous embodiment. Similar visual effects to those previously described for lash subassembly 74 are thus created when lash subassembly 83 or 84 is placed at different positions along the lash line and when combined with different additional lash subassemblies. The lash subassembly 82 is very similar in structure to the lash subassembly 54 of the fifth embodiment and therefore visually prominent relative to the other two lash subassemblies 83, 84. Similar visual effects to those previously described for lash subassembly 54 are created when lash subassembly 82 is placed at different positions along the lash line and when combined with different additional lash subassemblies. Lash subassemblies 82, 83 and 84 may have respective base portion lengths of, for example, 15 mm, 8 mm, and 12 mm.

FIG. 8 shows an eighth embodiment of the invention, which takes the form of an adornment 81 formed from three lash subassemblies 82, 83, 84. The adornment is intended to extend along some portion of the lash line length and each lash subassembly 82, 83, 84 extends across approximately ⅓ of the total adornment width.

This embodiment is particularly suitable for use with wide-set eyes, where the bridge of the nose may seem slightly flatter than average, (for example, the eyes of a wearer of Asian descent). It is also particularly suitable for any eye shape set into wide cheekbones. This embodiment is effective with these eye types because its intensity at the medial corner will seem to make the eyes appear nearer the nose, while the continuity of the center and lateral segments will balance the exaggeration.

FIG. 9

Figure 9:
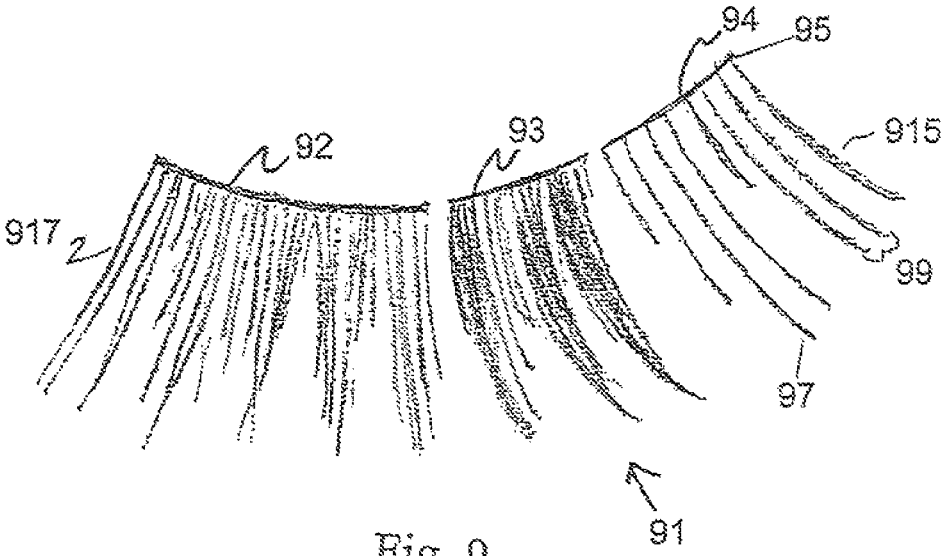
FIG. 9 is a schematic view of a ninth embodiment of the present invention.

FIG. 9 depicts an eyelash adornment in accordance with a ninth embodiment of the present invention. Description of common elements and operation similar to those previously described will not be repeated with respect to the ninth embodiment.

FIG. 9 illustrates a lash subassembly 94, a central lash subassembly 93 and a lash subassembly 92. The lash subassembly 94 is dark brown/soft black in color and comprises very fine lash filaments 97 distributed in very sparse groupings 99, at relatively large intervals. The filament groupings are tied to a very fine, almost invisible, base portion 95. The lash filament length of the groupings 99 varies, with a mostly even distribution and an occasional shorter grouping. The overall profile collectively defined by the filament tips is crenellated. The length of the base portion 95 may be, for example, 6 mm, may extend along approximately 30% of the total width of the adornment 91, and may extend along approximately ⅕ to ½ of the natural lash line.

The pattern that forms against the skin along the brow bone when the eye is open depends upon the filament length and density of the natural lashes. For shorter and/or sparse lashes, there will be an elongation at the tips of the longer clusters and a corresponding increase in density down to the lash line. For average length and density lashes, there will be only a slight increase in length and density, creating an exaggerated effect such that the natural lashes appear slightly longer and thicker. The lash filaments can also be clear, pale or brown in color to achieve a more subtle effect. From a sagittal view, the lash filaments 97 curve downward, away from the base portion 95 and then upward again, similar to the curve of natural lashes that are not straight or unruly.

The visual effects and dynamics created by lash subassembly 94 are similar to the visual effects and dynamics created by lash subassembly 44 of embodiment 4 but with less dense clusters. This provides an option for wearers who prefer a softer, less dense yet still quietly enhanced effect.

The center lash subassembly 93 has a base portion 95 length which may be, for example, 5 mm, and may extend along approximately ⅕ of the total adornment width. This lash subassembly is very similar to lash subassembly 2 of the first embodiment and thus similar visual effects to those described for lash subassembly 2 are created when lash subassembly 93 is placed at different positions along the lash line and when combined with different additional lash subassemblies.

The lash subassembly 92 is soft black in color and has a mean filament distribution density that lies between those of the other two subassemblies. This lash subassembly 92 balances the other two subassemblies in that it has the longest base portion, extending along approximately ½ of the total width of the entire adornment, which may be, for example, 10 mm.

Its lash filaments 97 form parallel lash filament lengths that are, generally, longer than an average natural eyelash, but are loosely formed such that the groups of longer filaments are slightly random but with an overall continuity in shape and density and with no particular graduation in filament length. These longer groups of filaments are interspersed with several parallel shorter filaments that are shorter than average natural lashes and serve to increase the density of the natural lashes, creating an impression of a denser distribution and longer lash filament length than natural eyelashes and therefore appearing to increase the L/M and S/I widths of the eye. The pattern that forms against the skin along the brow bone when the eye is open is that of the longer parallel filaments. From a sagittal view, the hairs curve downward, away from the attachment section and then upward again, similar to the curve of natural lashes that are not straight or unruly. The length of the base portion may extend along approximately ¼ to ½ of a natural lash line.

If lash subassembly 92 is placed at the lateral corner of the upper or lower lash line, the density appears to embolden the natural lash line, making the L/M width of the eye seem bigger. The exaggerated lash filament length combined with their curve emphasizes the vertical characteristic of the eye at the lateral corner, making the eye seem larger in terms of S/I width.

For eye shapes that have a horizontal orientation at the lateral corner, the filament density makes the eye seem larger in terms of L/M width while the exaggerated length of the lash filaments 97 creates the appearance of vertical emphasis, making the overall eye shape seem larger in terms of S/I width. Such an effect is generally an advantage for deep-set, narrow/close-set, and/or small eyes.

If lash subassembly 92 is placed just in from the lateral corner of either the upper or lower lash line, the density of the lash filaments 97 gives the appearance of emboldening the natural lash line before it merges or turns to meet the opposing eyelid at the lateral corner of the eye, intensifying the lash line such that it seems more dominant than the lateral corner of the eye. The exaggerated length of the lash filaments 97 combined with their curve creates vertical emphasis just in from the eye's lateral corner making the eye appear larger in terms of S/I width, independent of the characteristic of corners of the lash lines/eyelids.

For eye shapes where the lateral part of the lash line has a downward orientation or becomes more vertical, or where the skin of the brow bone is loose and rests close to the lash line, lash subassembly 92 is unaffected by the natural lash line and can make the eye appear larger in terms of L/M and S/I width than it does naturally. The density and length of the of the lash filaments 97 embolden the lash line and create vertical emphasis, distracting from the downward characteristic of the eye shape and camouflaging loose skin. Such an effect is generally considered flattering and an advantage for round, protruding, and/or droopy eyes and/or droopy eyelids.

If lash subassembly 92 is placed centrally at either the upper or lower lash line, the density of the lash filaments 97 emboldens the lash line and makes the eye seem larger in terms of L/M width along the lash line. The exaggerated length of the lash filaments 97 combined with their curve exaggerates the S/I width of the eye and gives an overall larger appearance.

For eye shapes where the lateral part of the lash line has a downward orientation or becomes more vertical or where the skin of the brow bone is loose and rests close to the lash line, the length and density of the lash filaments 97 makes the eye seem larger in terms of S/I and L/M width, allowing the lateral portion of the eye to appear more delicate, suppressing the downward or round characteristic of it, camouflaging loose skin both at the center and the lateral corner of the eye. Such an effect is considered flattering and an advantage for round, protruding, and/or droopy eyes and/or droopy eyelids.

If lash subassembly 92 is placed at the medial region of the upper or lower lash line, the density of the lash subassembly emboldens the lash line at the medial corner, making the eye seem larger in terms of L/M width and nearer to the bridge of the nose. The exaggerated lash filament length combined with the curve of the lash filaments 97 creates vertical emphasis, making the eye seem larger in terms of S/I width.

For eye shapes that have a horizontal orientation at the medial corner the eye appears to be larger in terms of L/M width, making it seem nearer to the bridge of the nose. The exaggerated length of the lash filaments 97 creates emphasis towards the center of the eye, making eye seem larger in terms of S/I width. Such an effect is generally an advantage for deep-set, wide-set, and/or small eyes, as the natural lash line length and L/M width of the eye is exaggerated to its fullest.

Lash subassembly 92 functions very effectively at the lateral corner of the eye as a dominant lash subassembly next to additional lash subassemblies. It works effectively at this location if an additional lash subassembly located just in from the corner of the eye matches its lash filament length and either maintains that length or continues graduation to an even shorter filament length, since most eyelashes are sparser and shorter near the medial portion of the eye. The same dynamic holds true for every additional subassembly nearer medial corner of the eye.

If an additional lash subassembly located just in from the lateral corner of the eye is longer, the upward orientation of the filaments of lash subassembly 92 and the additional subassembly create the appearance of a double extension of the lash line. This result creates vertical emphasis both near the center and lateral portions of the lash line.

If the additional lash subassembly located just in from the corner of the eye maintains the filament density of lash subassembly 92, an illusion of recession makes the eye seem larger in terms of L/M width. If the additional lash subassembly is less dense, it blends the intensity of lash subassembly 92 into the natural lash line, continuing make the eye seem larger in terms of L/M width but with a subtle overall look. If the additional lash subassembly is significantly less dense, the intensity of the lash subassembly 92 stands out along the lash line creating a useful effect for stage and other performance-type requirements.

Lash subassembly 92 functions effectively just in from the lateral corner if an additional lash subassembly nearer the lateral corner of the eye is slightly shorter or less dense, blending the vertical emphasis created by lash subassembly 92 into the lateral corner or the lash line without competing for dominance. If the additional lash subassembly is just as pronounced as lash subassembly 92 but slightly shorter, it still enhances the vertical emphasis provided by the filament length lash subassembly 92. If the additional lash subassembly located at the lateral corner graduates such that it is longer in filament length at the lateral region, they combine to create a double filament extension from both lateral side regions of the subassemblies, which may be desirable for stage and other performance-type applications.

If an additional subassembly located nearer the center of the eye matches its lash filament length towards the medial side region 917 of lash subassembly 92 and either maintains that length or graduates from longer at the lateral side region to an even shorter filament length, the additional lash subassembly effectively blends lash subassembly 92 into the natural eyelashes. The same effect applies for every additional lash subassembly nearer the medial corner of the eye.

If the additional subassembly nearer the center of the eye is less dense, the intensity of lash subassembly 92 then seems to be integrated into the natural lash line, making the eye seem larger in terms of L/M and S/I width but with a subtle overall look.

Lash subassembly 92 functions effectively at the center of the lash line if its lash filament length is matched at the lateral side region 915 and then either maintained or blended into the natural eyelashes at the lateral corner of the eye. At this location and placed next to a more pronounced additional lash subassembly located at the lateral corner, lash subassembly 92 blends the extremely exaggerated lateral additional lash subassembly into the central and medial parts of the eye. Such an arrangement may be desirable for stage and other performance-type applications. If lash subassembly 92 is placed next to a shorter and subtle additional lash subassembly at the lateral corner of the eye, it creates vertical emphasis at the central region, appearing to increase the S/I width of the eye.

The lash subassembly 92 functions effectively at the center of the lash line if an additional lash subassembly situated nearer the medial corner of the eye matches its lash filament length and either maintains that length or becomes shorter, blending lash subassembly 92 into the medial area of the eye where most eyelashes become sparser and shorter. The same dynamic applies to each additional lash subassembly nearer the medial corner of the eye.

The lash subassembly 92 functions effectively at the center of the lash line if the additional lash subassembly nearer the medial part of the eye maintains its density, creating an illusion of recession and that makes the eye seem larger in terms of L/M width and therefore nearer the nose. If the additional lash subassembly is slightly less dense, the intensity of lash subassembly 92 blends into the natural lash line, continuing the appearance of enlargement of the eye's L/M width but with a subtle overall look. If the additional lash subassembly is significantly less dense, the intensity of lash subassembly 92 is prominent but can blend into the natural lash line.

Lash subassembly 92 functions effectively at the medial corner of the lash line if its lash filament length is matched at its lateral side region 915 and then either maintained by additional lash subassemblies nearer the lateral corner of the eye or graduated such that the longest filament length is between the middle and lateral corner of the eye. If placed next to a more pronounced additional lash subassembly, lash subassembly 92 blends the exaggerated additional lash subassembly into the medial part of the eye. The adornment can be completed with an equal, more, or less prominent subassembly that respectively maintains, exaggerates, or blends into the lateral part of the lash line. Such an arrangement may be desirable for stage or other performing-type applications.

FIG. 9 shows an ninth embodiment of the invention, which takes the form of an adornment 91 formed from the three lash subassemblies 92, 93, 94. The adornment is intended to extend along some portion of the lash line length.

This eyelash adornment is most suitable for use with round, downward-slanting, and/or slightly droopy eyes and/or eyelids—where the more favorable part of the eye for emphasis is not the lateral corner, but just in from the lateral corner. The emphasis in this position makes the eye appear to have a less downward, more horizontal orientation.

FIG. 10

Figure 10:
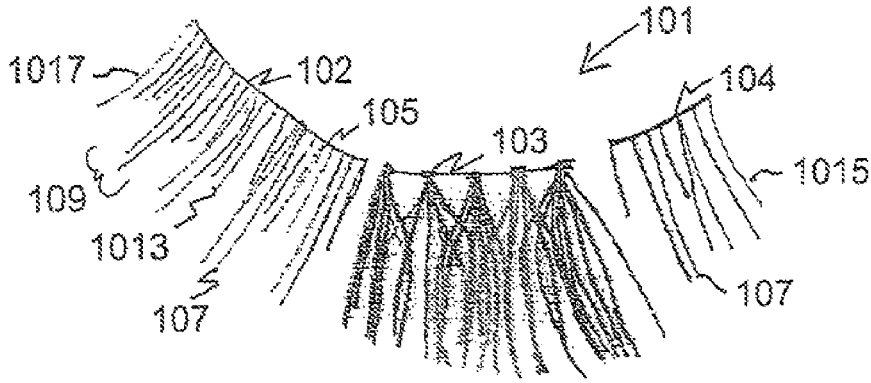
FIG. 10 is a schematic view of a tenth embodiment of the present invention.

FIG. 10 depicts an eyelash adornment in accordance with a tenth embodiment of the present invention. Description of common elements and operation similar to those previously described will not be repeated with respect to the tenth embodiment.

FIG. 10 illustrates three lash subassemblies 102, 103 and 104. The lash subassembly 104 is dark brown, and it is a smaller, more delicate version of the lash subassembly 94 of the ninth embodiment. Similar visual effects as previously described for lash subassembly 94 are thus created when lash subassembly 104 is placed at different positions along the lash line and when combined with different additional lash subassemblies. Lash subassembly 104 may have a base portion which is, for example, 5 mm long.

The lash subassembly 103 is soft black in color and functions in a similar manner to the lash subassembly 62 of the sixth embodiment, but with a much greater mean filament thickness. It is the most darkly colored of the three lash subassemblies 102, 103, 104 and it also has the greatest mean distribution density; it is, however, delicate at the attachment section, given the gaps between the knots of filament. This lash subassembly 103 emboldens the natural lash in terms of apparent filament length and density.

The lash filaments 107 within the clusters of lash subassembly 103 converge as they become farther away from the lash line and then diverge to become parallel to one another. The lash filaments appear to be similar in length with a slight graduation from longer at the lateral end 1015 to shorter at the medial end 1017.

The pattern that forms against the skin along the brow bone when the eye is open depends upon the length and density of the natural lashes. For shorter and/or sparse lashes there is a slight visual increase in eye lash length, an elongation of the tips of the lashes and a corresponding increase in filament density down to the lash line. For average length and density eyelashes there appears to be an overall increase in density, creating a more prominent effect that makes the natural lashes look thicker. The lash subassembly 103 may also be clear brown in color to create a subtle effect.

From a sagittal view, the lash filaments curve downwards away from the base portion 105 and then upward again similar to the curve of natural lashes that are not straight or unruly. The length of the base portion 105 of lash subassembly 103 may be, for example, 9 mm and can extend along approximately ⅕ to ½ of the natural lash line.

Lash subassembly 103 creates emboldens the natural lashes as the density of lash filaments makes the lash line length seem larger and the length of the lash filaments makes the eye seem larger in terms of S/I width. This subtle yet highly effective way of enhancing the overall look of the lash line maintains a relatively natural appearance because the pattern that is formed when the eye is open is that of the natural lashes against the skin of the eyelid. This pattern is only slightly altered by lash subassembly 103 which has virtually the same texture as natural lashes.

The effects created by lash subassembly 103 when placed at different positions along the upper or lower lash line are similar to the effects created by lash subassembly 4, but provides an option for a subtle pattern formed against the brow bone while maintaining the enhancement of filament density, graduation and slightly longer length.

The visual effects created when lash subassembly 103 is placed next to other lash subassemblies are similar to the effects created by lash subassembly 62 of the sixth embodiment, but this subassembly 103 provides an option for wearers who prefer a more pronounced effect at the tips of the lashes, due to its filament density, graduation and slightly longer length.

The lash subassembly 102 is soft black in color and has a slightly longer base portion 105 than the other two lash subassemblies 103, 104 at 11 mm. Its filament density lies between those of the other two lash subassemblies 103, 104. This lash subassembly has its lash filaments arranged in contiguous groupings 109, which alternate between having a relatively short lash filament length and having a relatively long length. The overall effect is that the filament tips define a profile that appears crenellated. This lash subassembly 102 appears to balance of the other two lash subassemblies in that its base portion 105 is the largest, representing more than one third of the total width of the adornment.

When placed in various positions along the lash line and with additional subassemblies, lash subassembly 102 functions similarly to lash subassembly 94 of the ninth embodiment but has a larger number of lash filaments tied onto the base portion 105 and a larger subassembly width 105. This provides an option for wearers who prefer a slightly denser appearance and longer filament length while maintaining the subtle effect. This provides an option for use on larger eyes with a greater ease of application due to the larger subassembly width.

The eyelash adornment 101 of FIG. 10 is suitable for use with round, downward-slanting, and/or slightly droopy eyes and/or eyelids, where the more favorable part of the eye for emphasis is not the lateral corner, but just in from the lateral corner. The emphasis in this position makes the eye appear to have a less downward orientation.

FIG. 10 shows a tenth embodiment of the invention, which takes the form of an adornment 101 formed from three lash subassemblies 102, 103, 104. The adornment is intended to extend along some portion of the lash line length.

FIG. 11

Figure 11:
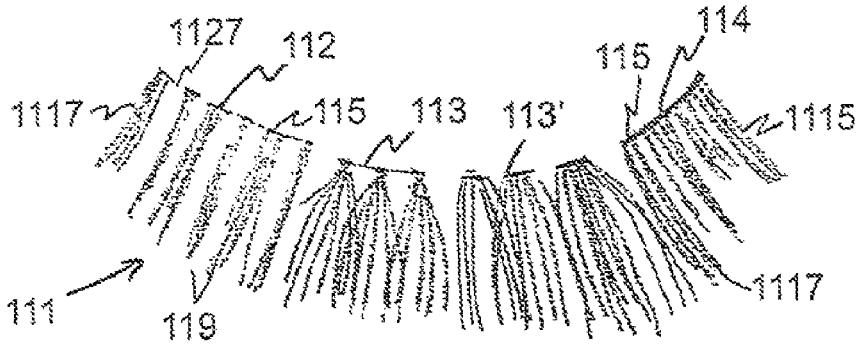
FIG. 11 is a schematic view of an eleventh embodiment of the present invention.

FIG. 11 depicts an eyelash adornment in accordance with an eleventh embodiment of the present invention. Description of common elements and operation similar to those previously described will not be repeated with respect to the eleventh embodiment.

FIG. 11 illustrates four lash subassemblies 112, 113, 113' and 144. The lash subassembly 114 is rich black in color with a soft slightly spiky look. It has the shortest mean filament length of the four lash subassemblies 112, 113, 113', 114 and appears the darkest. The length of its base portion 115 may be, for example, 6 mm.

The lash subassembly 114 demonstrates continuity in the arrangement and placement of lash filaments 117 being dense along the base portion 115 with alternating lengths of lash filaments. The lash subassembly 114 has parallel elongated clusters of lash filaments that are generally longer than an average natural eyelash and interspaced with shorter parallel lash filaments that are generally shorter than an average natural eyelash. The clusters are loosely formed such that they seem slightly random but with an overall continuity in shape and size with graduation from shorter at the lateral side region 1115 to longer at the medial side region of 1117 of the lash subassembly 114.

The pattern that forms against the skin along the brow bone when the eye is open is elongated clusters of lash filaments interspersed with the natural eyelashes. From a sagittal view the lash filaments curve downward away from the base portion 115 and then upward again, similar to natural lashes. The base portion 115 of lash subassembly 114 may extend along approximately ⅙ to ⅓ of a natural lash line.

The visual effects created by lash subassembly 114 are similar to lash subassembly 74 of the seventh embodiment but with a less dense placement of shorter lash filaments and a more subtle L/M width enhancement. Lash subassembly 114 provides options for wearers who prefer a smaller and less pronounced effect. It is easier to fit on smaller eyes than lash subassembly 74 and provides a more controlled shorter to longer graduation in filament length.

The medial center lash subassembly 113 is soft black in color and very similar to lash subassembly 92 of embodiment 9 but with a shorter base portion 115 (which may have a length of, for example, 4 mm) and a more even distribution of the length of parallel lash filaments. Similar visual effects as previously described for lash subassembly 92 are thus created when lash subassembly 113 is placed at different positions along the lash line and when combined with different additional lash subassemblies. Its base portion 115, may extend along approximately ¼ of the total width of the adornment 111 of FIG. 11. Lash subassembly 113 has a lash filament distribution density that is similar to its neighboring lash subassemblies 112, 113' in FIG. 11.

Lash subassembly 113 provides an option for wearers who have smaller eyes or prefer smaller lash subassemblies in terms of the subassembly width of the base portion of lash subassembly 113. It also provides a non-convergent even distribution of filament length for easier integration into the natural lash line.

The lateral center lash subassembly 113' is soft black in color and it is in many respects similar to lash subassembly 103 of embodiment 10 but with slightly larger clusters of lash filaments at the base portion 115. Similar visual effects as previously described for lash subassembly 103 are thus created when lash subassembly 113 is placed at different positions along the lash line and when combined with different additional lash subassemblies at different positions. Lash subassembly 113' may have a base portion length of, for example, 6 mm.

Lash subassembly 113' provides an option for wearers who prefer a version of lash subassembly 113 that is more dense at the lash line.

The lash subassembly 112 is soft black in color and extends across approximately ¼ of the total width of the adornment, as it may have a base portion length of, for example, 9 mm. This lash subassembly 112 has a very similar filament distribution density to the other lash subassemblies 113, 113', 114, but the filaments are arranged differently. In this case, they are arranged in groupings 119, wherein the filaments are substantially parallel and straight, with intervals 1127 between them. The graduation of the groupings 119 is from longer at the lateral side region to shorter at the medial side region. The pattern that forms against the skin along the brow bone when the eye is open depends upon the length and density of the natural lashes. For shorter and/or sparse lashes, there will be an elongation in the appearance of the length of the natural eyelashes and a corresponding increase in density down to the lash line. For average length and density lashes, there appears to be only a subtle increase in length and density, creating a slightly more dense effect in the natural lashes. In alternative embodiments of the invention the lash subassembly 112 can also be clear, pale, or brown in color to achieve a more subtle effect.

From a sagittal view, the lash filaments curve downward, away from the base portion and then upward again, similar to the curve of natural lashes that are not straight or unruly. The subassembly width of the base portion 114 extends across approximately ⅕ to ½ of the natural lash line.

Lash subassembly 112 creates similar visual effects to lash subassembly 4 of the first embodiment but provides an option for extremely subtle texture in the pattern formed against brow bone. This provides an option for wearers who prefer a softer, non-convergent effect at the tips of the lashes while maintaining the enhancement of alternating density, graduation, and slightly longer filament length.

FIG. 11 shows an eleventh embodiment of the invention, which takes the form of an adornment 111 formed from four lash subassemblies 112, 113, 113', 114. The adornment 111 is intended to extend along some portion of the lash line length. The mean length of the filaments 117 is substantially constant across the entire adornment, except there is a gradual reduction in filament length leading into each end of the adornment 111, corresponding to the location of the eye corners in use.

Due to the fact that the adornment 111 comprises four lash subassemblies, lash subassembly 113' lies nearer the lateral corner of the eyelid in this adornment rather than strictly at the center when it is worn. The mean length of its lash filaments is longer than that of the lash subassembly 114 and the filaments are also graduated in length, such that they are longer at the lateral side region 1115 and shorter at medial side region 1117. This lash subassembly 113' is the most prominent of the four and therefore appears to embolden the appearance of the natural lash in a region located just in from the lateral corner of the eye.

This embodiment of the invention is particularly suitable for use with round, downward-slanting, and/or slightly droopy eyes and/or eyelids where the more favorable part of the eye is not the lateral corner, but located just in from the lateral corner. The relatively constant lash filament distribution density across the whole adornment also helps to fill naturally sparse lash lines and/or bolster short lashes.

FIG. 12

Figure 12:
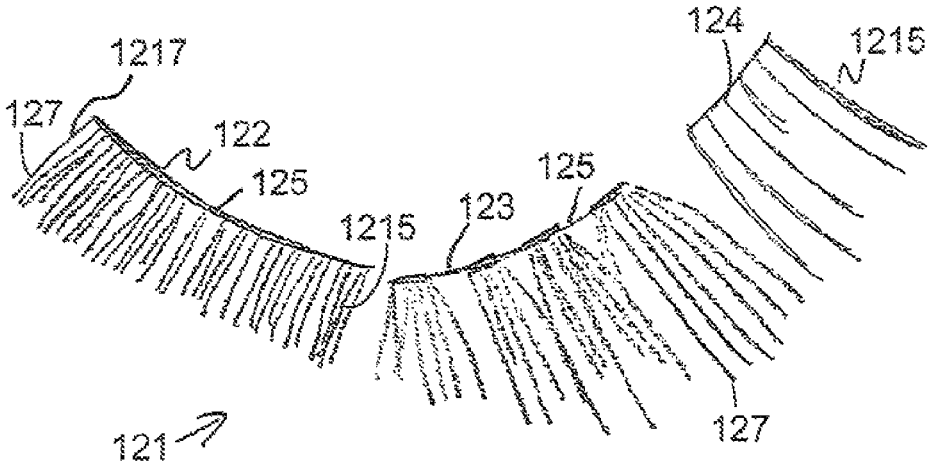
FIG. 12 is a schematic view of a twelfth embodiment of the present invention.

FIG. 12 depicts an eyelash adornment in accordance with a twelfth embodiment of the present invention. Description of common elements and operation similar to those previously described will not be repeated with respect to the twelfth embodiment.

Lash subassemblies 124, 123 and 122 are illustrated in FIG. 12. The lash subassembly 124 is soft black and broadly similar to the lash subassembly 94 of the ninth embodiment. It has the lowest filament distribution density of the three lash subassemblies and the longest mean filament length. This lash subassembly 124 has a delicate texture and may have a base portion length of, for example, 4 mm.

Lash subassembly 124 functions in a similar manner to lash subassembly 94 of the ninth embodiment. Similar visual effects to those previously described for lash subassembly 94 are thus created when lash subassembly 124 is placed at different positions along the lash line and when combined with different additional lash subassemblies.

The center lash subassembly 123 is soft black and similar to the lateral center lash subassembly 113' of the previous embodiment. This lash subassembly is the densest and darkest of the three, but still rather delicate at the base portion 125. The filament tips of the center lash subassembly 123 define a profile with a pronounced curve, which is initially convex (in the lateral region) but becomes concave (in the medial region). This lash subassembly may have a base portion length of, for example, 9 mm and provides a pronounced visual effect in the natural eyelash.

Lash subassembly 123 functions in a similar manner to lash subassembly 103 of the tenth embodiment but with slightly bigger clusters of lash filaments at the base portion 125. Similar visual effects as previously described for lash subassembly 103 are thus created when lash subassembly 123 is placed at different positions along the lash line and when combined with different additional lash subassemblies. This provides an option for wearers who prefer more density at the lash line version of lash subassembly 125.

The lash subassembly 122 is soft black and may have a base portion length of, for example, 11 mm. It has a mean filament distribution density that is between those of the other two lash subassemblies 123, 124. The lash filaments 127 on this lash subassembly 122 are relatively short, shorter than most natural lash filaments 127, meaning that this lash subassembly 122 is most effective in the roots of medial corner region of the natural lash when the adornment 121 is worn. The lash filaments of lash subassembly 122 are generally parallel and generally evenly spaced. The filament tips of this lash subassembly define a subtle curve which is initially concave in the lateral end region 1215, but becomes convex towards its medial end region 1217.

The pattern that forms against the skin along the brow bone when the eye is open is that of the natural lashes, but they will look darker and denser along the lash line. Lash subassembly 122 can also be clear, pale, or brown in color to achieve a more subtle effect.

From a sagittal view, the lash filaments begin to curve downward, away from base portion 125, but their shortened filament length prevents the possibility of an upward turn so they seem to have a straighter profile due to the restricted length. The length of the base portion 125 of lash subassembly 122 ranges from approximately ¼ to approximately ¾ of the natural lash line.

Lash subassembly 122 functions in a similar manner to lash subassembly 34 of embodiment 3 but is denser and larger in terms of base length. Similar visual effects to those previously described for lash subassembly 103 are thus created when lash subassembly 122 is placed at different positions along the lash line and when combined with different additional lash subassemblies. This provides an option for wearers who prefer more pronounced density at the lash line and provides a faster application for bigger eyes because of its larger base portion 125.

FIG. 12 shows a twelfth embodiment of the invention, which takes the form of an adornment 121 formed from the three lash subassemblies 122, 123, 124. The adornment is intended to extend along at least a portion of the lash line length. The mean filament length is greatest in the lash subassembly 124 and gradually decreases as the adornment progresses nearer the medial side region.

The soft density of the lash subassembly 124 appears to fill naturally sparse or short lash lines and the shortest filaments of lash subassembly 122 appear to embolden the root area of the lash line, bringing emphasis to the center of the adornment. The emphasis inward from the lateral corner of the adornment appears to make the eye appear less downward oriented, thus this embodiment of the invention is suitable for use with round, downward-slanting, and/or slightly droopy eyes and/or eyelids where the more favorable part of the eye is not the lateral corner, but just in from the lateral corner.

FIG. 13

Figure 13:
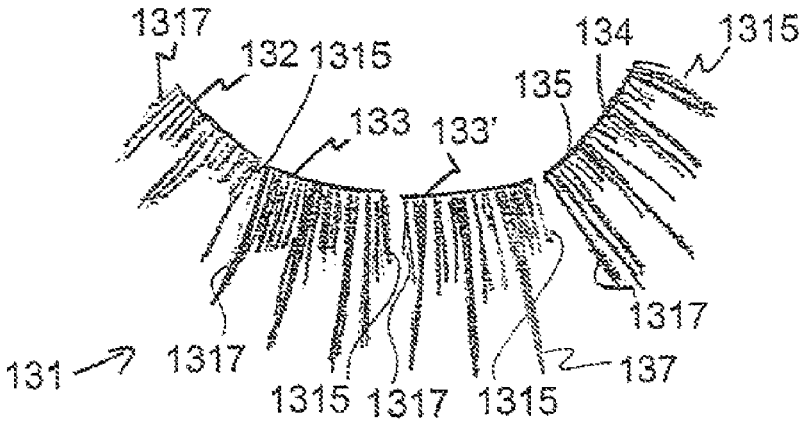
FIG. 13 is a schematic view of a thirteenth embodiment of the present invention.

FIG. 13 depicts an eyelash adornment in accordance with a thirteenth embodiment of the present invention. Description of common elements and operation similar to those previously described will not be repeated with respect to the thirteenth embodiment.

FIG. 13 illustrates four lash subassemblies 132, 133, 133' and 134. The lash subassembly 134 is glossy black, and similar to the lash subassembly 7 of the seventh embodiment, but it has a larger base portion 135 of, for example, 9 mm. This provides an easier application for wearers who have bigger eyes. Lash subassembly 134 functions in a similar manner to lash subassembly 74 and thus similar visual effects as previously described for lash subassembly 74 are created when lash subassembly 134 is placed at different positions along the lash line and when combined with different additional lash subassemblies.

This lash subassembly 134 has a mean lash filament length that is the shortest of the four lash subassemblies. The filament length increases generally from the lateral region 1315 of the said lash subassembly to the medial region 1317.

The two center lash subassemblies 133, 133' (lateral center 133' and medial center 133) are both glossy black in color and are similar to lash subassembly 3 of the first embodiment. Similar visual effects as previously described for lash subassembly 3 are thus created when lash subassemblies 133 or 133' are placed at different positions along the lash line and when combined with different additional lash subassemblies. They have equal mean lash filament lengths, with this being slightly longer than that of the other two lash subassemblies 132, 134. Both center lash subassemblies 133, 133' are equally bold and together they embolden the appearance of the natural lash near the center of the eye. Each of lash subassemblies 133, 133' may have a base portion length of, for example, 7 mm.

The lash subassembly 132 is glossy black with a very soft, subtle look. This lash subassembly has the shortest mean lash filament length of the four lash subassemblies, which decreases from its lateral side region 1315 to its medial side region 1317. Lash subassembly 132 is slightly dense along the base portion 135 with alternating lengths of parallel lash filaments, the longer of which are longer than average eyelashes while the shorter of which are, generally, shorter than average natural eyelashes. Both lengths of clusters are loosely formed such that the groupings are slightly random but with an overall continuity in shape and size. The pattern that forms against the skin along the brow bone when the eye is open is that of the longer clusters of lash filaments. From a sagittal view, the lash filaments curve downward, away from the base portion 135 and then upward again, similar to the curve of natural lashes that are not straight or unruly. The length of each base portion may be, for example, 6 mm and ranges from approximately ⅙ to approximately ⅓ of a natural lash line length.

Lash subassembly 132 functions in a similar manner to lash subassembly 2 of the first embodiment, but is less dense and shorter in terms of base portion length which may be, for example, 6 mm. This gives a less obvious, yet softly convergent appearance at the tips of the lashes. This lash subassembly provides an option for wearers who prefer a subtle yet still subtly elongated effect. Similar visual effects as previously described for lash subassembly 2 are created when lash subassembly 132 is placed at different positions along the lash line and when combined with different additional lash subassemblies.

FIG. 13 shows a thirteenth embodiment of the invention, which takes the form of an adornment 131 formed from the four lash subassemblies 132, 133, 133', 134. The adornment 131 is intended to extend along some portion of the lash line length. Each of the lash subassemblies 132, 133, 133', 134 extends across approximately ¼ of the total adornment width. Each of the lash subassemblies 132, 133, 133', 134 has a similar lash filament distribution density.

This eyelash adornment 131 is suitable for use with small, deep-set, and/or narrow eyes and/or droopy eyelids where the more favorable part of the eye is not the lateral corner, but the center of the eye. The even distribution of lash filament density across the entire adornment maintains continuity and provides a visual enhancement at the center of the eye as a consequence of the variation in the mean filament length. The change in lash exaggeration from the lateral corner of the eye to the center of the lash line makes the eye shape appear less horizontal and gives the impression that it is opened up by making it appear more rounded or larger in terms of S/I width near the center of the lash line. The density of the lashes also emboldens the lash line, enlarging the appearance of the eye's L/M width.

FIG. 14

Figure 14:
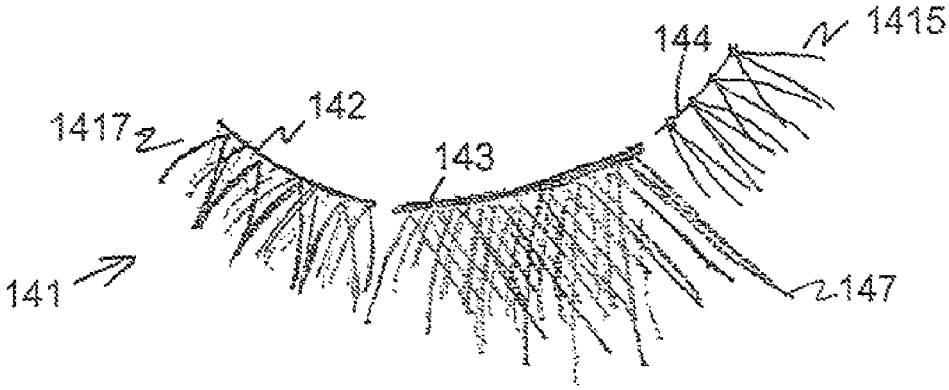
FIG. 14 is a schematic view of a fourteenth embodiment of the present invention.

FIG. 14 depicts an eyelash adornment in accordance with a fourteenth embodiment of the present invention. Description of common elements and operation similar to those previously described will not be repeated with respect to the fourteenth embodiment.

FIG. 14 illustrates three lash subassemblies 142, 143 and 144. Lash subassembly 144 functions in a similar manner to lash subassembly 62 of the sixth embodiment. Similar visual effects as previously described for lash subassembly 62 are created when lash subassembly 144 is placed at different positions along the lash line and when combined with different additional lash subassemblies.

The lash subassembly 144 is colorless, has the lowest lash distribution density of the three lash subassemblies and has a mean lash filament length that is between those of the other two lash subassemblies 142, 143. Its texture appears invisible in use and it is very delicate in structure, such that it simply emboldens the lash line by visually exaggerating the density of the natural eyelashes from the roots to the tips of the filament lengths at the lateral corner of the eye. This lash subassembly may have a base portion length of, for example, 5 mm.

Lash subassembly 143 functions in a similar manner to lash subassembly 63 of embodiment 6, but is slightly denser in texture. The lash subassembly provides an option for wearers who prefer a more prominent version of lash subassembly 63, and it is most suited either to big eyes and/or dense, long natural lash lines. Similar visual effects to those previously described for lash subassembly 63 are created when lash subassembly 143 is placed at different positions along the lash line and when combined with different additional lash subassemblies.

Lash subassembly 143 is rich brown in color and may have a base portion length of, for example, 13 mm.

Lash subassembly 142 functions in a similar manner to lash subassembly 63 of the sixth embodiment, but is less dense and is shorter in filament length and subassembly width. The lash subassembly provides an option for wearers who prefer less density at the lash line. Similar visual effects to those previously described for lash subassembly 63 are created when lash subassembly 142 is placed at different positions along the lash line and when combined with different additional lash subassemblies.

The lash subassembly 142 is soft black in color and may have a base portion length of, for example, 9 mm.

FIG. 14 shows a fourteenth embodiment of the invention, which takes the form of an adornment 141 formed from three lash subassemblies 142, 143, 144. The adornment is intended to extend along some portion of the entire lash line length.

When the adornment 141 is worn, lash subassembly 143 rests at some point along the center of the eyelid, presenting the greatest lash filament density of the three lash subassemblies. The filaments 147 are graduated in length, with the longest at its lateral side region 1415 and the shortest at its medial side region 1417. This lash subassembly 143 is the most prominent of the three and provides visual emphasis via filament length and density.

The lash filament density of lash subassembly 142 lies between those of the other two subassemblies 143, 144. Its tip profile continues the graduation in filament length from the center lash subassembly 143, and it dissipates the density of the center lash subassembly 143 as it progresses toward the medial corner of the eye.

In variations of this embodiment, lash subassemblies 144, 143 and 142 may extend along approximately 25%, approximately 40%, and approximately 35%, respectively, of the adornment width.

This embodiment of the invention is suitable for use with round, small, narrow, downward-slanting, and/or slightly droopy eyes and/or eyelids, where the more favorable part of the eye is not the lateral corner, but just in from the lateral corner. The seemingly invisible lash subassembly fills sparse lash lines and brings visual emphasis to the center of the eye. The change in emphasis to the center makes the eye seem to have a less downward orientation.

FIG. 15

Figure 15:
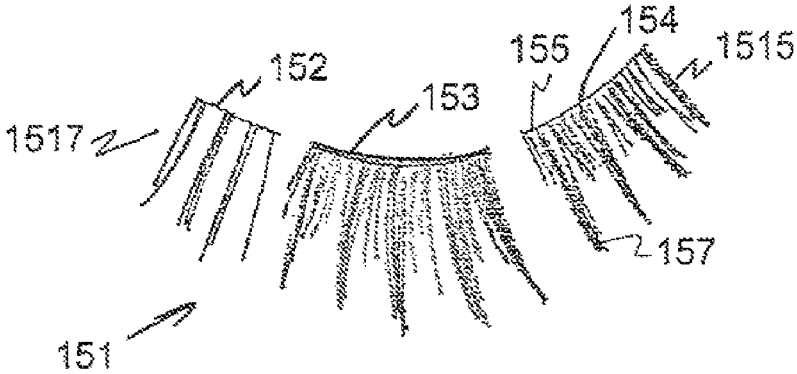
FIG. 15 is a schematic view of a fifteenth embodiment of the present invention.

FIG. 15 depicts an eyelash adornment in accordance with a fifteenth embodiment of the present invention. Description of common elements and operation similar to those previously described will not be repeated with respect to the fifteenth embodiment.

FIG. 15 illustrates three lash subassemblies 152, 153 and 154. The lash subassemblies 154, 153 have similar filament densities, but the lash subassembly 152 has a more subtle density.

Lash subassembly 154 is glossy black and has a shorter mean filament length than lash subassembly 153. Its mean filament length is virtually equal to that of the lash subassembly 152. Lash subassembly 154 may have a base portion length of, for example, 10 mm and it is structurally similar to the lash subassembly 74 of the seventh embodiment.

Lash subassembly 154 functions in a similar manner to lash subassembly 114 of the eleventh embodiment, but has a slightly longer base portion, and it is also similar to lash subassembly 74 of the seventh embodiment. This lash subassembly provides an option for wearers who prefer less filament density at the lash line. Similar visual effects to those previously described for lash subassembly 114 or 74 are created when lash subassembly 154 is placed at different positions along the lash line and when combined with different additional lash subassemblies.

Lash subassembly 153 is glossy black in color and has the longest mean filament length of the three lash subassemblies 152, 153, 154. This lash subassembly may have a base portion length of, for example, 11 mm and it is structurally the same as the lash subassembly 4 of the first embodiment. Similar visual effects to those previously described for lash subassembly 4 are thus created when lash subassembly 153 is placed at different positions along the lash line and when combined with different additional lash subassemblies.

The lash subassembly 152 is glossy black and it is the most delicate-looking of the three lash subassemblies 152, 153, 154. Structurally, this lash subassembly is similar to the lash subassembly 112 of the eleventh embodiment but it has a shorter base portion which may be, for example, 6 mm. This lash subassembly provides an option for wearers who have smaller eyes or prefer a more delicate appearance due to its smaller base portion 155. Similar visual effects to those previously described for lash subassembly 112 are created when lash subassembly 152 is placed at different positions along the lash line and when combined with different additional lash subassemblies. It has a mean lash filament length that is similar to that of the lash subassembly 154.

FIG. 15 shows a fifteenth embodiment of the invention, which takes the form of an adornment 151 formed from the three lash subassemblies 152, 153, 154. The adornment is intended to extend along a portion of the lash line length. In use, lash subassembly 153 lies at the center of the lash line and emboldens the appearance of the lash line length via subassembly width and filament shape at the center of the eye.

This embodiment is suitable for use with small, deep-set, and/or narrow eyes and/or droopy eyelids where the more favorable part of the eye is not the lateral corner, but the center of the eye. The relatively even filament density maintains continuity and provides vertical emphasis at the center via filament length. The shift in emphasis from the lateral corner of the eye to the center of the lash line makes the eye appear larger in S/I width and therefore more round.

In variations of this embodiment, lash subassemblies 154, 153 and 152 may extend along approximately 35%, approximately 40%, and approximately 25%, respectively, of the total adornment width.

FIG. 16

Figure 16:
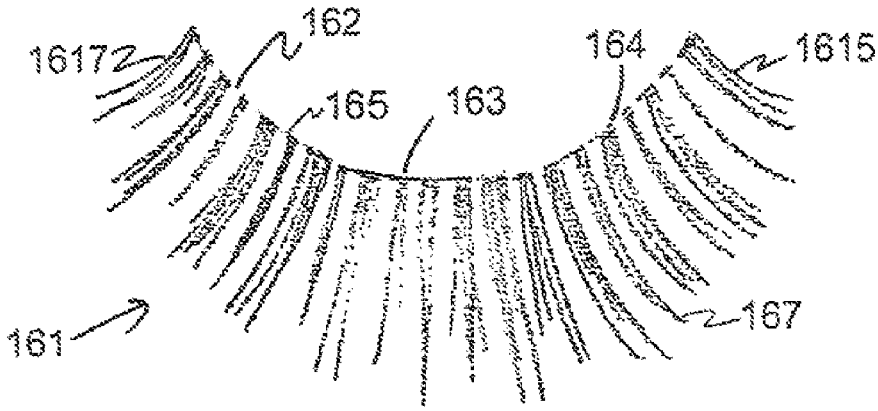
FIG. 16 is a schematic view of a sixteenth embodiment of the present invention.

FIG. 16 depicts an eyelash adornment in accordance with a sixteenth embodiment of the present invention. Description of common elements and operation similar to those previously described will not be repeated with respect to the sixteenth embodiment.

FIG. 16 illustrates three lash subassemblies 162, 163 and 164. The three lash subassemblies differ in terms of their filament length and their respective profiles. Lash subassembly 164 exhibits an increase in filament length from its lateral side region 1615 to its medial side region 1617. When arranged as shown in FIG. 16, lash subassembly 163 continues the profile established by the lash subassembly 164 and has the longest mean filament length of the three. The lash subassembly 162 is virtually the mirror image of the lash subassembly 164 and therefore exhibits a reduction in filament length progressing from its lateral side region 1615 to its medial side region 1617.

Lash subassembly 164 functions in a similar manner to lash subassembly 74 of the seventh embodiment but has a wider base portion 165 which may be, for example, 11 mm. This lash subassembly also has an alternating filament density down to the roots of the lash filaments and a subtle less convergent effect resulting from parallel filament clusters rather than converging lash clusters. Similar visual effects to those previously described for lash subassembly 74 are created when lash subassembly 164 is placed at different positions along the lash line and when combined with different additional lash subassemblies. The lash subassembly 164 provides an option for wearers who prefer less exaggerated, alternating density at the lash line rather than continuous density, and an elongated length of lash filaments. Lash subassembly 164 is suited to larger eyes and less dense lash lines.

Lash subassembly 163 may have a base portion length of, for example, 11 mm and functions in a similar manner to lash subassembly 92 of the ninth embodiment. The lash subassembly provides an option for wearers who prefer less extreme alternating density at the lash line with elongated length of lash filaments length and suits larger eyes and less dense eyelashes. Similar visual effects to those previously described for lash subassembly 92 are created when lash subassembly 163 is placed at different positions along the lash line and when combined with different additional lash subassemblies.

Lash subassembly 162 may have a base portion length of, for example, 11 mm and functions in a similar manner to lash subassembly 112 of the eleventh embodiment. Similar visual effects to those previously described for lash subassembly 112 are created when lash subassembly 162 is placed at different positions along the lash line and when combined with different additional lash subassemblies.

FIG. 16 shows a sixteenth embodiment of the invention, which takes the form of an adornment 161 formed from the three lash subassemblies 162, 163, 164. The adornment 161 is intended to extend along a portion of the lash line length. Each lash subassembly 162, 163, 164 may extend along approximately ⅓ of the total width of the adornment 161. Each of the lash subassemblies is similar in terms of basic structure.

In variations of this embodiment, lash subassemblies 164, 163 and 162 each may extend along approximately ⅓ of the entire adornment width.

This embodiment of the invention is suitable for use with small, deep-set, and/or narrow eyes and/or droopy eyelids where the more favorable part of the eye is not the lateral corner, but the center of the eye. The even filament density and its longer mean filament length across the adornment 161 provides a visual emphasis at the center of the eye. The shift in emphasis from the lateral corner of the eye to the center of the lash line makes the eye appear larger in terms of S/I width and therefore more round.

FIG. 17

Figure 17:
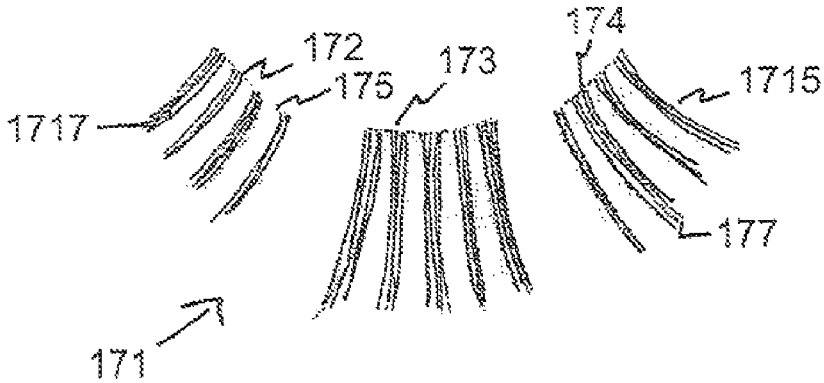
FIG. 17 is a schematic view of a seventeenth embodiment of the present invention.

FIG. 17 depicts an eyelash adornment in accordance with a seventeenth embodiment of the present invention. Description of common elements and operation similar to those previously described will not be repeated with respect to the seventeenth embodiment.

FIG. 17 illustrates lash subassemblies 172, 173 and 174. Lash subassembly 174 may have a base portion length of, for example, 6 mm and functions in a similar manner to lash subassembly 44 of the fourth embodiment, but is longer and more appropriate for bigger eyes. Similar visual effects to those previously described for lash subassembly 44 are created when lash subassembly 174 is placed at different positions along the lash line and when combined with different additional lash subassemblies.

Lash subassembly 173 may have a base portion length of, for example, 8 mm and functions in a similar manner to lash subassembly 43 of the fourth embodiment, but is longer and more appropriate for bigger eyes. Similar visual effects to those previously described for lash subassembly 43 are created when lash subassembly 173 is placed at different positions along the lash line and when combined with different additional lash subassemblies.

Lash subassembly 172 functions in a similar manner to lash subassembly 42 of the fourth embodiment, but is longer and more appropriate for bigger eyes. Similar visual effects as previously described for lash subassembly 42 are created when lash subassembly 172 is placed at different positions along the lash line and when combined with different additional lash subassemblies.

In variations of this embodiment, lash subassemblies 174, 173 and 172 each extend along approximately ⅓ of the entire width of the adornment.

FIG. 17 illustrates a seventeenth embodiment of the invention including lash subassemblies 172, 173 and 174 forming adornment 171, which resembles a smaller version of the sixteenth embodiment.

FIG. 18

Figure 18:
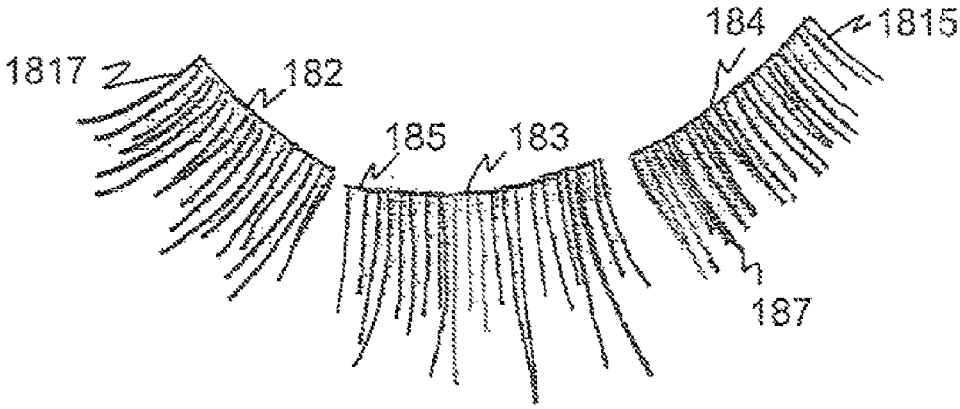
FIG. 18 is a schematic view of an eighteenth embodiment of the present invention.

FIG. 18 depicts an eyelash adornment in accordance with an eighteenth embodiment of the present invention. Description of common elements and operation similar to those previously described will not be repeated with respect to the eighteenth embodiment.

FIG. 18 illustrates lash subassemblies 182, 183 and 184. Lash subassembly 184 may have a base portion length of, for example, 11 mm and functions in a similar manner to lash subassembly 122 of the twelfth embodiment. Similar visual effects to those previously described for lash subassembly 122 are created when lash subassembly 184 is placed at different positions along the lash line and when combined with different additional lash subassemblies.

Lash subassembly 183 may have a base portion length of, for example, 11 mm and functions in a similar manner to lash subassembly 102 of the tenth embodiment. Similar visual effects to those previously described for lash subassembly 102 are created when lash subassembly 183 is placed at different positions along the lash line and when combined with different additional lash subassemblies.

Lash subassembly 182 may have a base portion length of, for example, 9 mm and functions in a similar manner to lash subassembly 102 of the tenth embodiment, but with shorter lash filaments and less of a contrast in length between longer and shorter lash filaments. Similar visual effects to those previously described for lash subassembly 102 are created when lash subassembly 182 is placed at different positions along the lash line and when combined with different additional lash subassemblies. Lash subassembly 182 provides an option for wearers who prefer shorter natural lashes such that the lash subassembly may be used with very little interruption in the natural pattern that is formed by the lashes along the brow bone when the eye is open.

FIG. 18 illustrates an eighteenth embodiment of the invention including lash subassemblies 182, 183 and 184 forming the eyelash adornment 181, which is essentially a smaller and more delicate version of the eyelash adornment the sixteenth embodiment.

In variations of this embodiment, lash subassemblies 184, 183 and 182 may each extend along approximately ⅓ of the entire width of the adornment.

FIG. 19

Figure 19:
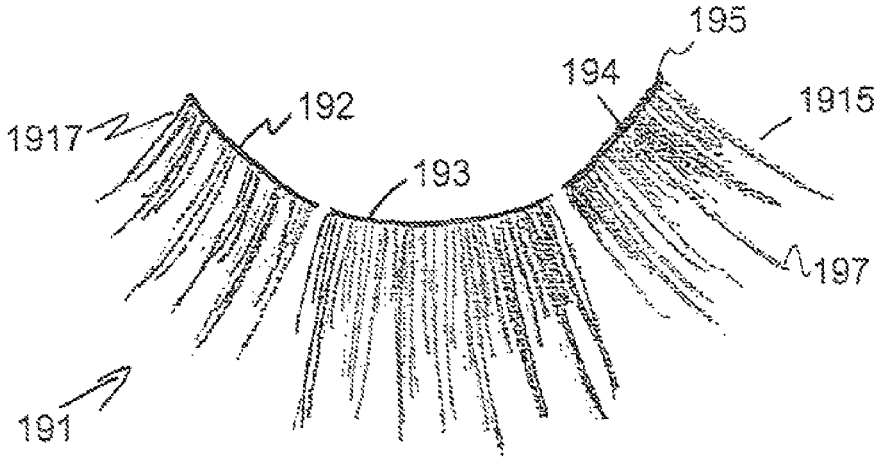
FIG. 19 is a schematic view of a nineteenth embodiment of the present invention.

FIG. 19 depicts an eyelash adornment in accordance with a nineteenth embodiment of the present invention. Description of common elements and operation similar to those previously described will not be repeated with respect to the nineteenth embodiment.

FIG. 19 illustrates lash subassemblies 192, 193 and 194. Lash subassembly 194 may have a base portion length of, for example, 8 mm and functions in a similar manner to lash subassembly 92 of the ninth embodiment. Similar visual effects to those previously described for lash subassembly 92 are created when lash subassembly 194 is placed at different positions along the lash line and when combined with different additional lash subassemblies.

Lash subassembly 193 may have a base portion length of, for example, 12 mm and functions in a similar manner to lash subassembly 92 of the ninth embodiment, but is longer and more appropriate for eyes with longer than average lashes. Similar visual effects to those previously described for lash subassembly 92 are created when lash subassembly 193 is placed at different positions along the lash line and when combined with different additional lash subassemblies.

Lash subassembly 192 may have a base portion length of, for example, 10 mm and functions in a similar manner to lash subassembly 53 of the fifth embodiment. Similar visual effects to those previously described for lash subassembly 53 are created when lash subassembly 192 is placed at different positions along the lash line and when combined with different additional lash subassemblies.

FIG. 19 shows a nineteenth embodiment of the invention made up of lash subassemblies 192, 193 and 194, which is essentially has denser and longer filaments than the sixteenth embodiment, but exhibits a more pronounced triangular shape in its filament groupings.

In variations of this embodiment, lash subassemblies 194, 193 and 192 may each extend approximately ⅓ of the entire width of the adornment.

FIG. 20

Figure 20:
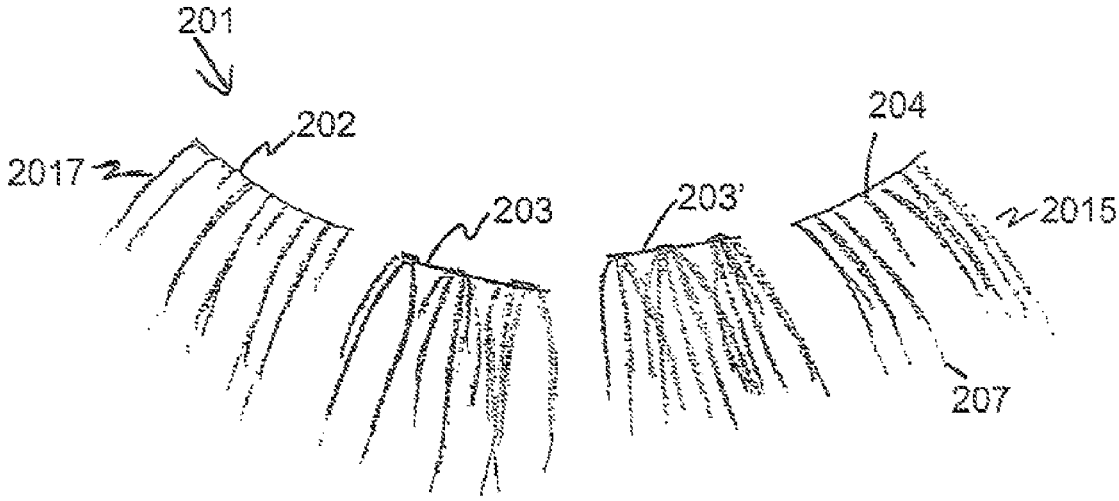
FIG. 20 is a schematic view of a twentieth embodiment of the present invention.

FIG. 20 depicts an eyelash adornment in accordance with a twentieth embodiment of the present invention. Description of common elements and operation similar to those previously described will not be repeated with respect to the twentieth embodiment.

FIG. 20 illustrates lash subassemblies 202, 203, 203' and 204. Lash subassembly 204 may have a base portion length of, for example, 6 mm and functions in a similar manner to lash subassembly 94 of the ninth embodiment. Similar visual effects to those previously described for lash subassembly 94 are created when lash subassembly 204 is placed at different positions along the lash line and when combined with different additional lash subassemblies.

Lash subassembly 203' may have a base portion length of, for example, 5 mm and functions in a similar manner to lash subassembly 103 of the tenth embodiment, but with less density at the lash line, creating a more subtle overall effect. Similar visual effects to those previously described for lash subassembly 103 are created when lash subassembly 203' is placed at different positions along the lash line and when combined with different additional lash subassemblies. Lash subassembly 203' provides a more natural lash subassembly for sparse lash lines.

Lash subassembly 203 may have a base portion length of, for example, 5 mm and functions in a similar manner to lash subassembly 103 of the tenth embodiment. Similar visual effects to those previously described for lash subassembly 103 are created when lash subassembly 203 is placed at different positions along the lash line and when combined with different additional lash subassemblies.

Lash subassembly 202 may have a base portion length of, for example, 7 mm and functions in a similar manner to lash subassembly 94 of the ninth embodiment. Similar visual effects to those previously described for lash subassembly 94 are created when lash subassembly 202 is placed at different positions along the lash line and when combined with different additional lash subassemblies.

FIG. 20 shows a twentieth embodiment of the invention including lash subassemblies 202, 203, 203', and 204. This embodiment resembles a more delicate version of the thirteenth embodiment, where the two center lash subassemblies have a slightly higher filament density than the medial and lateral lash subassemblies.

In variations of this embodiment, lash subassemblies 204, 203, 202 and 201 may each extend approximately ¼ of the entire width of the adornment.

FIG. 21

Figure 21:
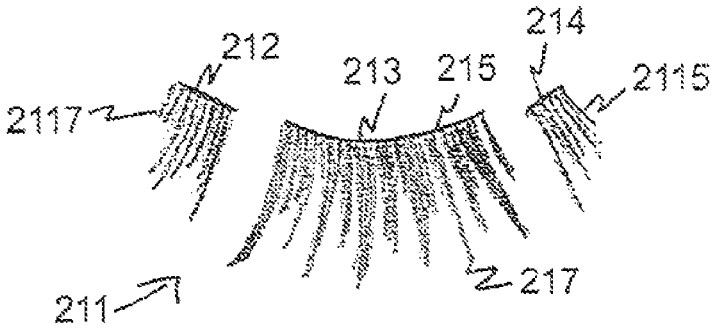
FIG. 21 is a schematic view of a twenty-first embodiment of the present invention.

FIG. 21 depicts an eyelash adornment in accordance with a twenty-first embodiment of the present invention. Description of common elements and operation similar to those previously described will not be repeated with respect to the twenty-first embodiment.

FIG. 21 illustrates three lash subassemblies 212, 213 and 214. The lash subassembly 214 is, in this case, soft black and delicate and it is formed from a series of evenly distributed, relatively fine lash filaments 217. Its general structure is similar to the medial subassembly 212 and its filament length graduates from shorter at its lateral side region 2115 to longer at its medial side region 2117.

Lash subassembly 214 may have a base portion length of, for example, 4 mm, but otherwise functions in a similar manner to lash subassembly 114 of the eleventh embodiment although it is slightly less dense. Similar visual effects to those previously described for lash subassembly 114 are created when lash subassembly 214 is placed at different positions along the lash line and when combined with different additional lash subassemblies. Lash subassembly 214 provides an option for wearers who prefer less density at the lash line and easier application on smaller eyes. It is effective for smaller and sparser lash lines.

Lash subassembly 213 is glossy black, dense, may have a base portion length of, for example, 13 mm, and has a structure similar to the center lash subassembly 92 of the ninth embodiment but with a more intense density. Similar visual effects to those previously described for lash subassembly 92 are created when lash subassembly 213 is placed at different positions along the lash line and when combined with different additional lash subassemblies. Lash subassembly 213 provides an option for wearers who prefer more intense density at the lash line and more extreme clusters of filaments in the pattern along the brow bone when the eye is open. The lash subassembly provides an easier application for bigger eyes and/or longer lashes due to its filament density. Its overall appearance is consequently more prominent than the other two lash subassemblies 212, 214 and it also has a longer mean lash filament length. This lash subassembly is particularly useful when it lies near the center of the lash line, providing emphasis via filament length, density and shape near the center of the eye.

The lash subassembly 212 may have a base portion length of, for example, 4 mm and is virtually the mirror image of the lash subassembly 214 in terms of structure. It functions in a similar way to subassembly 2 of the first embodiment but has less prominent filament clusters, making it more suitable for sparse lash lines and/or smaller eyes. Similar visual effects to those previously described for lash subassembly 2 are created when lash subassembly 212 is placed at different positions along the lash line and when combined with different additional lash subassemblies.

FIG. 21 shows a twenty-first embodiment of the invention, which takes the form of an adornment 211 formed from three lash subassemblies 212, 213, 214. The adornment is intended to extend along some portion of the lash line length.

In variations of this embodiment, lash subassemblies 214, 213 and 212 may respectively represent approximately 15%, approximately 65%, and approximately 20% of the entire width of the adornment.

This embodiment of the invention is suitable for use with small, deep-set, and/or narrow eyes and/or droopy eyelids where the more favorable part of the eye is not the lateral corner, but the center of the eye. The change in filament density and length helps create vertical emphasis and exaggerate the center of the eye while hiding droopy eyelids. The shift in emphasis from the lateral corner of the eye to the center of the lash line makes the eye appear larger in terms of S/I width and therefore more round.

FIG. 22

Figure 22:
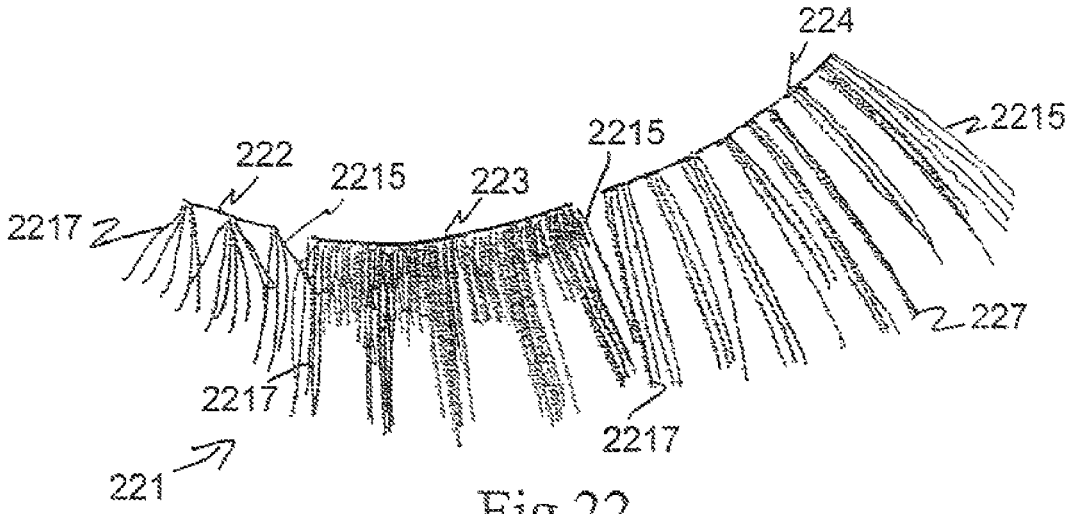
FIG. 22 is a schematic view of a twenty-second embodiment of the present invention.

FIG. 22 depicts an eyelash adornment in accordance with a twenty-second embodiment of the present invention. Description of common elements and operation similar to those previously described will not be repeated with respect to the twenty-second embodiment.

FIG. 22 illustrates lash subassemblies 222, 223 and 224. The lash subassembly 224 is soft, black and delicate and has a mean filament length that graduates from longer at its lateral side region 2215 to shorter at its medial side region 2217. Lash subassembly 224 may have a base portion length of, for example, 10 mm and is similar in structure and functions in a similar manner to lash subassembly 112 of the eleventh embodiment. Similar visual effects to those previously described for lash subassembly 112 are created when lash subassembly 224 is placed at different positions along the lash line and when combined with different additional lash subassemblies.

The center lash subassembly 223 is black and has a more intense appearance than that of the other two lash subassemblies 222, 224. The overall filament length of this lash subassembly 223 graduates from longer at its lateral side region 2217 to shorter at its medial side region 2215. This lash subassembly 223 may have a base portion length of, for example, 11 mm and is suitable for location near the center of the lash line, thereby providing an enhancement via filament density and shape at the center of the eye.

Lash subassembly 223 is similar in structure and functions in a similar manner to lash subassembly 53 of the fifth embodiment, but it is denser, it has a longer base portion and it is appropriate for larger eyes or longer than average lashes. Similar visual effects to those previously described for lash subassembly 53 are created when lash subassembly 223 is placed at different positions along the lash line and when combined with different additional lash subassemblies.

Lash subassembly 222 may have a base portion length of, for example, 4 mm and is similar in terms of structure and functions to lash subassembly 103 of the tenth embodiment, but it is shorter in terms of filament length and more appropriate for smaller eyes and eyelashes that are sparser than average. Similar visual effects to those previously described for lash subassembly 103 are created when lash subassembly 222 is placed at different positions along the lash line and when combined with different additional lash subassemblies.

The lash subassembly 222 is soft black. Being structurally similar to lash subassembly 103 of the tenth embodiment, it is consequently somewhat more subtle than lash subassemblies 223 and 224. This lash subassembly 222 also has a much shorter mean filament length than the center and lash subassemblies 223, 224, because it is intended to embolden the appearance of the root of the natural lash in the medial corner region of the eye. It also graduates in filament length from longer at its lateral side region 2215 to shorter at its medial side region 2217.

FIG. 22 shows a twenty-second embodiment of the invention, which takes the form of an adornment 221 formed from three lash subassemblies 222, 223, 224. The adornment is intended to extend along some portion of the line length.

This embodiment is suitable for use with deep-set and/or narrow eyes and/or droopy eyelids where the eye has a generally horizontal orientation at the lateral corner. The change in density and length of the lash filaments across the width of the adornment emphasizes the center of the lash line while exaggerating the L/M width at the lateral corner of the eye. The combination of the exaggeration in lash filament length at the lateral corner of the eye and the density at the center of the lash line makes the eye seem larger in both L/M and S/I width.

In variations of this embodiment, lash subassemblies 224, 223 and 222 may respectively represent just under approximately ½, just over approximately ⅓, and just under approximately ⅓, respectively, of the entire width of the adornment.

FIG. 23

Figure 23:
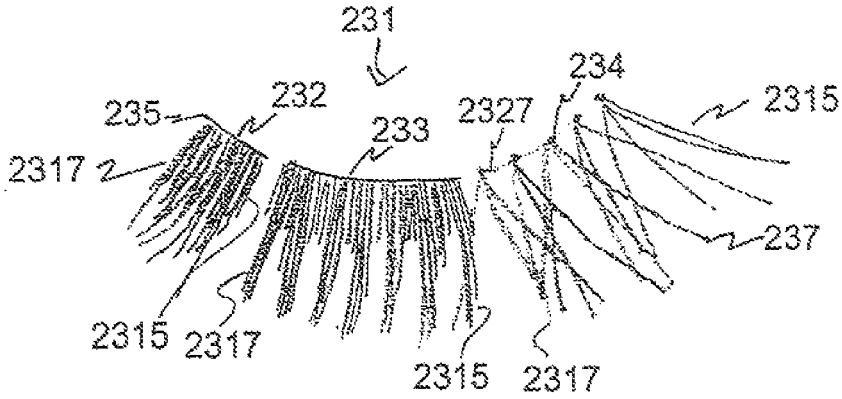
FIG. 23 is a schematic view of a twenty-third embodiment of the present invention.

FIG. 23 depicts an eyelash adornment in accordance with a twenty-third embodiment of the present invention. Description of common elements and operation similar to those previously described will not be repeated with respect to the twenty-third embodiment.

FIG. 23 shows lash subassemblies 232, 233 and 234. The lash subassembly 234 is soft black in color and comprises sparse groupings of lash filaments 237 that are delicately knotted to a clear base portion 235 with large gaps 2327 between each knot. The filament density is relatively sparse and the mean filament length is long. This lash subassembly 234 has the longest mean filament length of the three, and the length of the filaments 237 is graduated from longer at its lateral side region 2315 to shorter in its medial side region 2317. This lash subassembly 234 may have a base portion length of, for example, 7 mm.

Lash subassembly 234 has a similar structure and functions in a similar manner to lash subassembly 52 of the fifth embodiment. Similar visual effects to those previously described for lash subassembly 52 are created when lash subassembly 234 is placed at different positions along the lash line and when combined with additional lash subassemblies.

Lash subassembly 233 is rich black in color and more dense than the lash subassembly 234. It graduates in lash filament length, becoming shorter from its lateral side region 2315 towards its medial side region 2317. Lash subassembly 233 may have a base portion length of, for example, 10 mm.

Lash subassembly 233 has a similar structure and functions in a similar manner to lash subassembly 53 of the fifth embodiment. Similar visual effects to those previously described for lash subassembly 53 are created when lash subassembly 233 is placed at different positions along the lash line and when combined with different additional lash subassemblies.

Lash subassembly 232 is rich black, and has the highest filament density of the three subassemblies shown in FIG. 23 combined with the shortest mean filament length.

Lash subassembly 232 may have a base portion length of, for example, 4 mm and a similar structure and functions in a similar manner to lash subassembly 212 of the twenty-first embodiment but with a variation on the texture of the filament tips and the pattern formed against the brow bone when the eye is open. Similar visual effects to those previously described for lash subassembly 212 are created when lash subassembly 232 is placed at different positions along the lash line and when combined with different additional lash subassemblies.

FIG. 23 shows a twenty-third embodiment of the invention, which takes the form of an adornment 231 formed from the three lash subassemblies 232, 233, 234. The adornment is intended to extend along some portion of the lash line length. Within this embodiment, lash subassembly 232 matches the filament length where it meets the center lash subassembly 233, becoming shorter near the medial side region 2317. This lash subassembly has the most prominent filament density of the three, which creates visual emphasis near the medial part of the eye.

This embodiment is suitable for use with a wide-set eye shape, where the bridge of the nose may seem slightly flatter than average, but where the natural lashes are longer than average in filament length, are fairly thick in density and the shape of the eye is relatively large in L/M and S/I width. The embodiment is also particularly suitable for use with any eye shape set into wide cheekbones. In such a case, the intensity at the medial corner will make the eyes appear nearer to the bridge of the nose, while the exaggeration of the filament length of the lash subassembly will balance the effect.

In variations of this embodiment, lash subassemblies 234, 233 and 232 may each extend approximately ⅖, ⅖, and ⅕, respectively, of the entire width of the adornment.

FIG. 24

Figure 24:
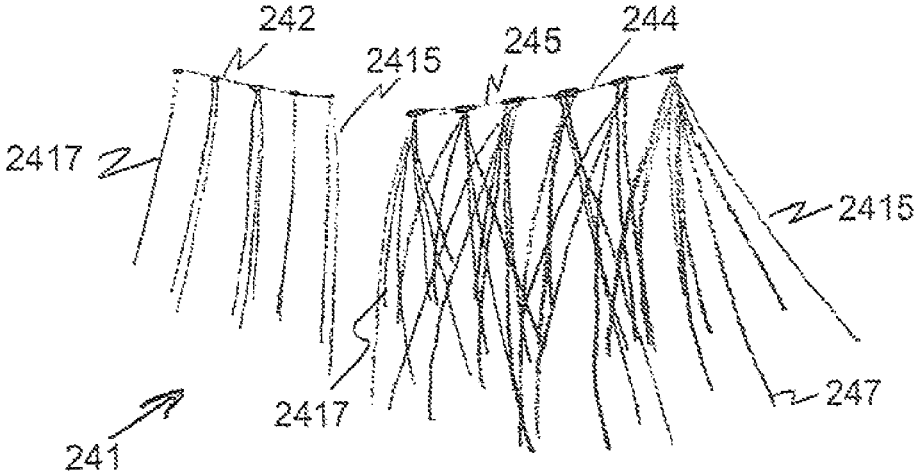
FIG. 24 is a schematic view of a twenty-fourth embodiment of the present invention.

FIG. 24 depicts an eyelash adornment in accordance with a twenty-fourth embodiment of the present invention. Description of common elements and operation similar to those previously described will not be repeated with respect to the twenty-fourth embodiment.

FIG. 24 illustrates lash subassemblies 244 and 242. The lash subassembly 244 is soft black, it has the longer mean filament length and it has a more dense filament distribution of the two lash subassemblies 242 and 244. This serves to create a partial graduation within the lash line from longer at the lateral side region 2415 to shorter at the medial side region 2417. This lash subassembly 244 has lash filaments 247 that are knotted at the base and attached along a clear base portion 245. The filaments emerge from each knot on the base portion 245 in a loosely divergent, slightly chaotic pattern, but the overall look is continuous. The length of the base portion 245 may be, for example, 8 mm.

Lash subassembly 244 has a similar structure and functions in a similar manner to lash subassembly 52 of the fifth embodiment, but has a higher density of lash filaments which embolden the appearance of lash lines that are longer or more dense than average natural eyelashes. Similar visual effects to those previously described for lash subassembly 52 are created when lash subassembly 244 is placed at different positions along the lash line and when combined with different additional lash subassemblies.

The lash subassembly 242 is soft black, more delicate in intensity and slightly shorter in filament length and subassembly width than subassembly 244. The lash filaments 247 of lash subassembly 242 are formed into delicate groups of parallel filaments knotted onto a clear base portion 245, and they graduate from longer at the lateral side region 2415 to shorter at the medial side region 2417. Lash subassembly 242 has an intermittent/spaced lash line, with gaps between clusters of lash filaments tied onto a virtually invisible lash line, which blends the lash subassembly 244 into the natural lashes. Lash subassembly 242 may have a base portion length of, for example, 4 mm.

Lash subassembly 242 has a similar structure and functions in a similar manner to lash subassembly 94 of the ninth embodiment. Similar visual effects to those previously described for lash subassembly 94 are created when lash subassembly 242 is placed at different positions along the lash line and when combined with different additional lash subassemblies.

FIG. 24 illustrates a twenty-fourth embodiment of the invention including lash subassemblies 242 and 244 forming adornment 241. The embodiment provides a corner lash shape, having a combined subassembly width of approximately ¼ to ⅔ of the natural lash line and demonstrating a graduation in filament length, density and arrangement.

The embodiment is particularly beneficial for deep-set, close, and/or small eyes, and/or eyes having small or sparse lash lines. The adornment provides the appearance of an increase in the eye's L/M and S/I width either just in from the lateral corner or at the lateral corner while the medial area stays natural looking, thereby enlarging the appearance of the eye. It is both effective and subtle in regard to the natural density and appearance of the natural lash line and can help to resolve the issue of traditional corner lashes which often fail to blend themselves into the length, texture and density of the natural lash line.

In variations of this embodiment, lash subassemblies 244 and 242 each represent approximately ½ to ⅓ of the subassembly width of the adornment.

FIG. 25

Figure 25:
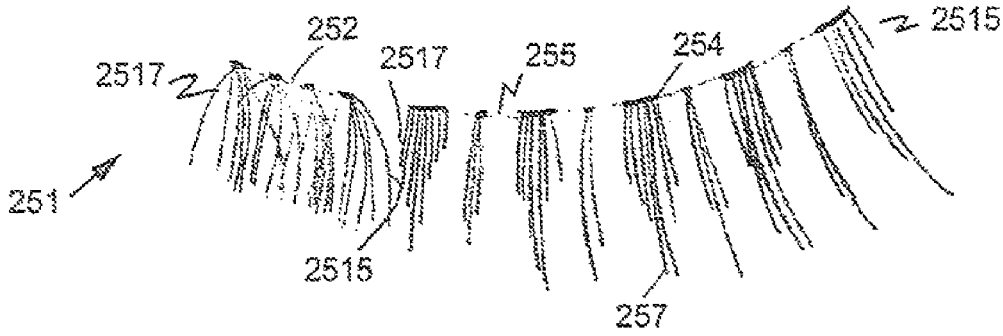
FIG. 25 is a schematic view of a twenty-fifth embodiment of the present invention.

FIG. 25 depicts an eyelash adornment in accordance with a twenty-fifth embodiment of the present invention. Description of common elements and operation similar to those previously described will not be repeated with respect to the twenty-fifth embodiment.

FIG. 25 illustrates lash subassemblies 254 and 252. The lash subassembly 254 is rich black, and alternates between small knotted clusters of two or three lash filaments 257 and sections of ten to fifteen lash filaments attached onto the base portion 255 along a clear attachment section. It has longer filaments and is the denser of the two subassemblies 254 and 252, and it is graduated in filament length from longer at the lateral side region 2515 to shorter at the medial side region 2517. The filaments emerge from the base portion 255 in a slightly convergent pattern that creates an alternation in density. The length of the base portion 255 may be, for example, 18 mm.

Lash subassembly 254 has a similar structure and functions in a similar manner to lash subassembly 43 of the fourth embodiment, but with alternating density for lash lines that are more naturally dense. Base portion 255 of lash subassembly 254 has a longer base portion than lash subassembly 43 and is therefore more suitable for bigger eye shapes. Similar visual effects to those previously described for lash subassembly 43 are created when lash subassembly 254 is placed at different positions along the lash line and when combined with different additional lash subassemblies.

The lash subassembly 252 is soft brown, more delicate in intensity with substantially shorter mean filament length and smaller subassembly width than lash subassembly 254. Lash subassembly 252 may have a base portion length of, for example, 5 mm. The lash filaments 257 of lash subassembly 252 are formed into delicate groups of filaments knotted onto a clear base portion 255, and they initially diverge from the base portion 255 and then become parallel and even in filament length, creating a more subtle effect blending lash subassembly 254 into the natural lash line. This lash subassembly 252 creates more of a root building effect, facilitating the illusion of density at the base of the natural lash line.

Lash subassembly 252 has a similar structure and functions in a similar manner to lash subassembly 62 of the sixth embodiment but is brown in color. Similar visual effects to those previously described for lash subassembly 62 are created when lash subassembly 252 is placed at different positions along the lash line and when combined with different additional lash subassemblies.

FIG. 25 illustrates a twenty-fifth embodiment of the invention including lash subassemblies 252 and 254 forming adornment 251. The embodiment provides a traditional lash shape, having two subassemblies with graduation in filament length, density and arrangement, covering a total of approximately ½ to the whole lash line length.

This embodiment is particularly effective for deep-set, close, and/or small eyes and/or small or sparse lash lines. The resulting adornment provides the appearance of an increase in the eye's L/M and S/I width from the lateral corner through the center of the eye via a visual increase in the filament density at the lash line that is subtly exaggerated compared to the density and appearance of the natural lash line. The medial portion remains almost unaffected. The smaller medial lash subassembly 262 is particularly beneficial for eyes in which the lash line takes a particular orientation toward the medial corner of the eye, creating difficulty in adhesion. This embodiment helps resolve the issue of traditional lashes which often fail blend into the length, texture and density of the natural lash line.

In variations of this embodiment, lash subassemblies 254 and 252 may respectively represent approximately ⅔ to ¾ and approximately ¼ to ⅓ of the entire width of the adornment.

FIG. 26

Figure 26:
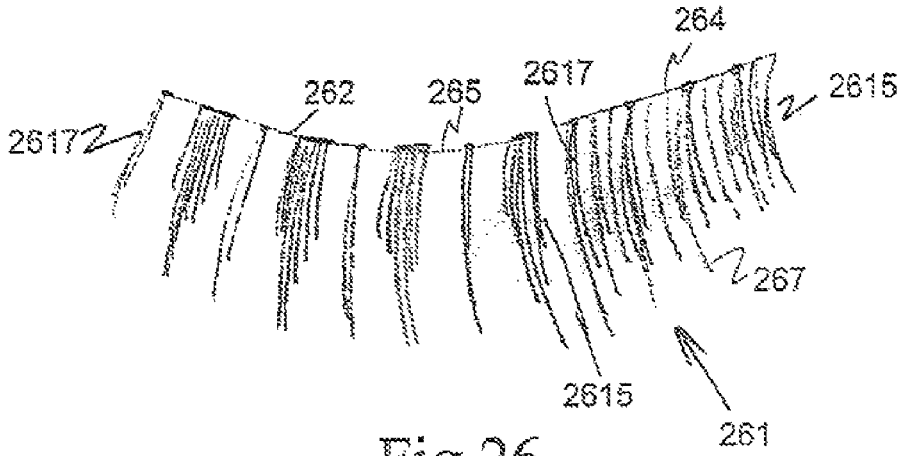
FIG. 26 is a schematic view of a twenty-sixth embodiment of the present invention.

FIG. 26 depicts an eyelash adornment in accordance with a twenty-sixth embodiment of the present invention. Description of common elements and operation similar to those previously described will not be repeated with respect to the twenty-sixth embodiment.

FIG. 26 illustrates lash subassemblies 264 and 262. Lash subassembly 264 is soft black, with lash filaments 267 that are graduated in filament length from shorter at the lateral side region 2615 to longer at the medial side region 2617, knotted at the base and attached along a clear base portion 265. Some of the filaments 267 that emerge from knots on the base portion 265 are slightly shorter than the mean filament length, but the overall look is continuous. The length of the base portion 265 may be, for example, 9 mm.

Lash subassembly 264 has a similar structure and functions in a similar manner to lash subassembly 114 of the eleventh embodiment, but with less dense clusters of lashes for creating a more pronounced effect upon sparse lashes or to blend more efficiently into denser lashes. Similar visual effects to those previously described for lash subassembly 114 are created when lash subassembly 264 is placed at different positions along the lash line and when combined with different additional lash subassemblies.

Lash subassembly 262 may have a base portion length of, for example, 18 mm and is similar in structure to lash subassembly 254 of the twenty-fifth embodiment, it thus has a similar structure and functions in a similar manner to lash subassembly 43 of the fourth embodiment but with alternating density for lash lines that are naturally dense. Similar visual effects to those previously described for lash subassembly 43 are created when lash subassembly 262 is placed at different positions along the lash line and when combined with different additional lash subassemblies.

FIG. 26 illustrates a twenty-sixth embodiment of the invention including lash subassemblies 262 and 264 forming adornment 261. The embodiment has a nontraditional shape and a nontraditional total width for a false eyelash assembly. The lash subassemblies have a highly unconventional distribution of filament density and texture and length, together the total adornment width ranges from approximately ¾ to the whole natural lash line length.

This embodiment is particularly useful for overly-round, downward-slanting, and/or slightly droopy eyes and/or eyelids, or any eyelid where the more favorable part of the eye is not the lateral corner, but just in from the lateral corner and the center of the lash line. The change in emphasis from the lateral corner of the eye then makes the eye appear to have a less downward orientation. The extended subassembly width and density of lash subassembly 262 creates vertical emphasis and disguises the skin on the brow bone and its proximity to the lash line length.

In variations of this embodiment lash subassemblies 264 and 262 respectively represent approximately ⅓ and approximately ⅔ of the entire width of the adornment.

FIG. 27

Figure 27:
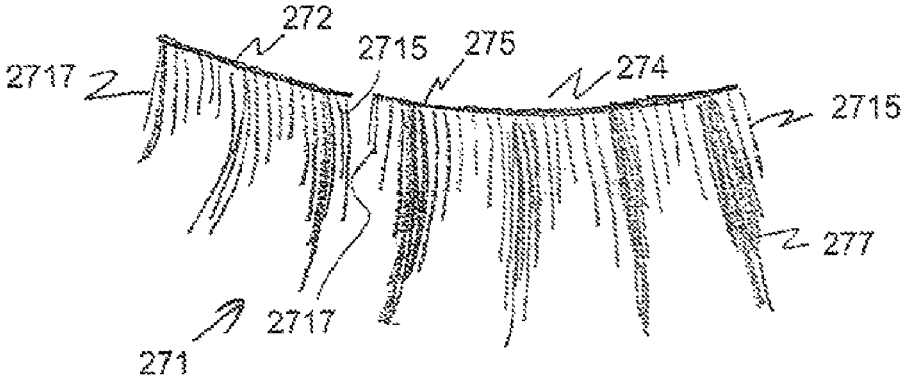
FIG. 27 is a schematic view of a twenty-seventh embodiment of the present invention.

FIG. 27 depicts an eyelash adornment in accordance with a twenty-seventh embodiment of the present invention. Description of common elements and operation similar to those previously described will not be repeated with respect to the twenty-seventh embodiment.

FIG. 27 illustrates lash subassemblies 274 and 272. The lash subassembly 274 is soft black, with a moderate effect. It has the longer mean filament length and subassembly width of the two lash subassemblies 272 and 274, although both alternate densities with lash filaments 277 that are formed into denser longer groups of filaments alternating with shorter, less dense sections of filaments between them along a shared attachment section 275. It is relatively even in filament length from the lateral side region 2715 to the medial side region 2717 and creates vertical emphasis in the natural lash line making the eye seem larger in terms of L/M and S/I width via its filament density and shape. The length of the base portion 275 may be, for example, 15 mm.

Lash subassembly 274 has a similar structure and functions in a similar manner to lash subassembly 4 of the first embodiment, but with a slight variation in filament density at the base portion and in the elongated clusters. Similar visual effects to those previously described for lash subassembly 4 are created when lash subassembly 274 is placed at different positions along the lash line and when combined with different additional lash subassemblies.

The lash subassembly 272 is soft black, similar in texture and density to the lateral subassembly 274, but slightly shorter in filament length and base portion length 275 when compared with lash subassembly 274. It graduates in filament length from longer at the lateral portion 2715 to shorter at the medial portion 2717. It may have a base portion length of, for example, 9 mm.

Lash subassembly 272 has a similar structure and functions in a similar manner to lash subassembly 2 of the first embodiment but again with a slight variation on lash filament density at the base portion and in its elongated clusters. Similar visual effects to those previously described for lash subassembly 2 are created when lash subassembly 272 is placed at different positions along the lash line and when combined with different additional lash subassemblies.

Both lash subassemblies 274 and 272 create an option for wearers who prefer subtle density at the lash line and they also allow easier application for bigger eyes due to their respective base portion lengths.

FIG. 27 illustrates a twenty-seventh embodiment of the invention including lash subassemblies 272 and 274 forming adornment 271. The adornment has a more traditional shape but with a total width that is smaller than a traditional false eyelash. The lash subassemblies 272 and 274 demonstrate a continuous texture and graduation in filament length, covering approximately ⅗ to the entire natural lash line length.

This embodiment is particularly beneficial for small, deep-set, round, and/or close-set eyes, and/or unique eye shapes that don't conform to the traditional shape of single strip lashes (i.e., they are too long, too short, or don't curve in the same shape as the eye). It is effective for loose or crêpey/feathered eyelids since the lash subassemblies can be placed individually, accommodating irregularity in the texture of the eyelid. The embodiment provides the appearance of an increase in the eye's L/M and S/I width from the lateral corner (or just in from the lateral corner) through the center area of the eye while the medial area is more natural looking. The smaller lash subassembly 272 is particularly suitable for eyes wherein the medial corner of the eye changes orientation, turning toward the medial tear duct (an area where adhesion of traditional strip lash is difficult to maintain).

In variations of this embodiment, lash subassemblies 274 and 272 respectively represent approximately ½ to ⅔ and approximately ⅓ to ½ of the entire width of the adornment.

FIG. 28

Figure 28:
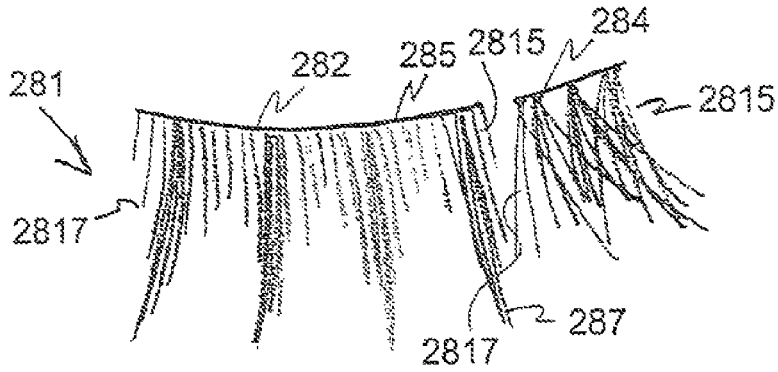
FIG. 28 is a schematic view of a twenty-eighth embodiment of the present invention.

FIG. 28 depicts an eyelash adornment in accordance with a twenty-eighth embodiment of the present invention. Description of common elements and operation similar to those previously described will not be repeated with respect to the twenty-eighth embodiment.

FIG. 28 illustrates lash subassemblies 284 and 282. Lash subassembly 284 is soft brown, with a shorter overall filament length and a less dense filament distribution relative to lash subassembly 282. The length of its filaments is relatively even, therefore it is suitable for blending lash subassembly 282 into the natural lash line its emboldening effect at the base of the lash filaments. This lash subassembly 284 has lash filaments 287 that are knotted at the base and attached along a base portion 285. The filaments emerge from each knot on the base portion 285 in a loosely divergent, slightly chaotic pattern, but the overall look is continuous. The length of the base portion 285 may be, for example, 5 mm.

Lash subassembly 284 has a similar structure and functions in a similar manner to lash subassembly 143 of the fourteenth embodiment, except that it is smaller and the arrangement of its lash filaments is more chaotic. Similar visual effects to those previously described for lash subassembly 143 are created when lash subassembly 284 is placed at different positions along the lash line and when combined with different additional lash subassemblies. This provides an option for wearers who prefer more density at the lash line and provides an easier application for smaller eyes due to its smaller base portion 285.

Lash subassembly 282 is similar to lash subassembly 274 of the previous embodiment. It has the longer mean filament length and subassembly width of the two lash subassemblies 282 and 284, and may have a base portion length of, for example, 15 mm.

FIG. 28 illustrates a twenty-eighth embodiment of the invention including lash subassemblies 282 and 284 forming adornment 281. The twenty-eighth embodiment provides a nontraditional shape and the total width of the adornment is less than the width of a traditional false eyelash assembly. The two lash subassemblies 282 and 284 have a highly unconventional distribution of filament density, texture and graduation in length, stretching from approximately ⅔ to the whole lash line length.

This embodiment is particularly beneficial for overly-round, downward-slanting, and/or and slightly droopy eyes and/or eyelids, or any eye where the more favorable part of the eye is not the lateral corner, but just in from the lateral corner and the center of the lash line. The change in emphasis from the lateral corner of the eye then makes the eye appear to be larger in terms of L/M and S/I width. The extended width of the lash subassembly 282 helps exaggerate the vertical emphasis and disguises the skin on the brow bone and its proximity to the eyelashes.

In variations of this embodiment, lash subassemblies 284 and 282 may respectively represent approximately ¼ to ⅓ and approximately ⅔ to ¾ of the entire width of the adornment.

FIG. 29

Figure 29:
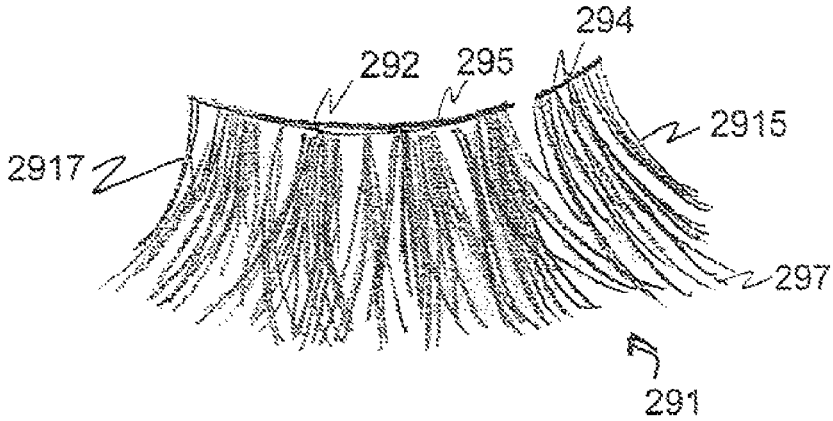
FIG. 29 is a schematic view of a twenty-ninth embodiment of the present invention.

FIG. 29 depicts an eyelash adornment in accordance with a twenty-ninth embodiment of the present invention. Description of common elements and operation similar to those previously described will not be repeated with respect to the twenty-ninth embodiment.

FIG. 29 illustrates lash subassemblies 294 and 292. Lash subassembly 294 is soft brown and it is relatively equal in filament length 297, density and texture to lash subassembly 292 but it is much smaller in terms of base portion length. Lash subassembly 294 is particularly suitable for joining the more dominant lash subassembly 292 and blending it into the natural lash line. This lash subassembly 294 has lash filaments 297 that emerge from the attachment section 295 into slightly divergent clusters, but with a generally parallel pattern. It is too small at the base portion 295 to display any substantial change in mean filament length from the lateral portion 2915 to the medial portion 2917 and therefore the overall look is continuous even though the filaments are of a variety of lengths. The length of the base portion 295 may be, for example, 4 mm.

Lash subassembly 294 has a similar structure and functions in a similar manner to lash subassembly 214 of the twenty-first embodiment, but is brown for more pale colored natural lashes. Similar visual effects to those previously described for lash subassembly 114 are created when lash subassembly 294 is placed at different positions along the lash line and when combined with different additional lash subassemblies.

The lash subassembly 292 is soft black, denser, and slightly longer in filament length and base portion 295 length than lash subassembly 294. The lash filaments 297 of lash subassembly 292 emerge from the base portion 295 into slightly divergent clusters, but an overall parallel pattern, and the lash subassembly 292 creates vertical emphasis to the natural lash line via its density, filament arrangement and length, which is generally continuous from the lateral side region 2915 to the medial side region 2917. Lash subassembly 292 may have a base portion of, for example, 15 mm.

Lash subassembly 292 has a similar structure and functions in a similar manner to lash subassembly 92 of the ninth embodiment but with gaps in the density at the base portion 295, creating a more subtle option for lash lines that are sparse to average. Similar visual effects to those previously described for lash subassembly 92 are created when lash subassembly 292 is placed at different positions along the lash line and when combined with different additional lash subassemblies.

FIG. 29 illustrates a twenty-ninth embodiment of the invention including lash subassemblies 292 and 294 forming adornment 291.

The embodiment provides a traditional shape but the total width of the adornment is less than the width of a traditional false eyelash assembly. The two lash subassemblies 292 and 294 have a conventional distribution of filament density, texture and graduation in length, covering approximately ½ to ¾ of the natural lash line length.

This embodiment is particularly effective for overly-round, downward-slanting, and/or slightly droopy eyes and/or eyelids, or any eyelid where the more favorable part of the eye is not the lateral corner, but just in from the lateral corner and the center of the lash line. The change in emphasis from the lateral corner of the eye then makes the eye appear to have a less downward orientation as the filament length of the lash subassembly 292 helps create vertical emphasis and disguises the skin on the brow bone and its proximity to the eyelashes.

In variations of this embodiment, lash subassemblies 294 and 292 may respectively represent approximately ⅕ to ¼ and approximately ¾ to ⅘ of the entire width of the adornment.

FIG. 30

Figure 30:
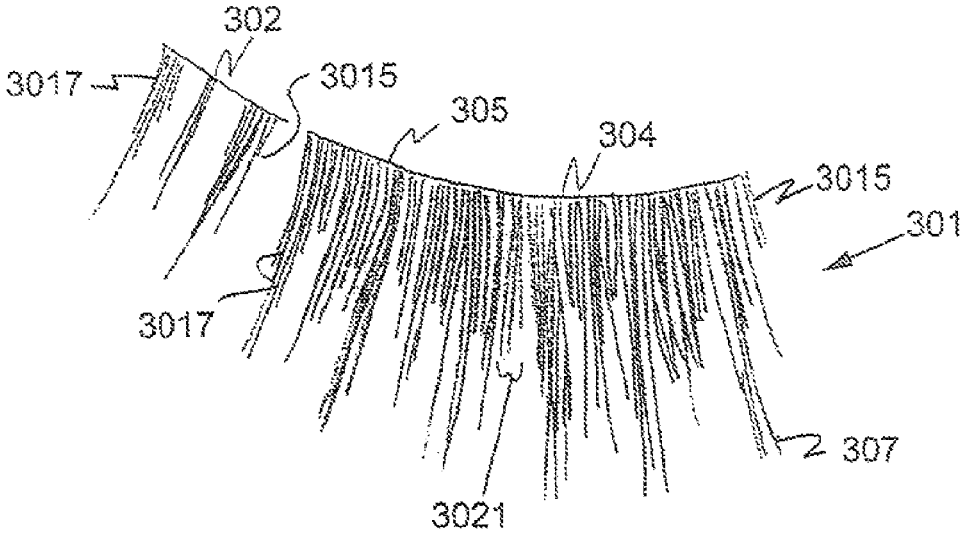
FIG. 30 is a schematic view of a thirtieth embodiment of the present invention.

FIG. 30 depicts an eyelash adornment in accordance with a thirtieth embodiment of the present invention. Description of common elements and operation similar to those previously described will not be repeated with respect to the thirtieth embodiment.

FIG. 30 illustrates lash subassemblies 304 and 302. Lash subassembly 304 is brown, and it has the longer mean filament length and the denser filament distribution of the two lash subassemblies 302 and 304. This lash subassembly 304 also has lash filaments 307 that are loosely formed into small series of longer parallel filaments interspersed with small series of both slightly shorter and substantially shorter parallel filaments 3021 attached evenly along the base portion 305. It is graduated in filament length from longer at the lateral portion 3015 to shorter at the medial portion 3017. The length of the base portion 305 may be, for example, 19 mm.

Lash subassembly 304 has a similar structure and functions in a similar manner to lash subassembly 92 of the ninth embodiment, but may be brown in color for a more subtle application to lighter colored or sparser lash lines. Similar visual effects to those previously described for lash subassembly 92 are created when lash subassembly 304 is placed at different positions along the lash line and when combined with different additional lash subassemblies.

The lash subassembly 302 is brown, more delicate in intensity, and slightly shorter in filament length and subassembly width than lash subassembly 304. The lash filaments 307 of lash subassembly 302 are formed into delicate groups of parallel filaments knotted onto a clear base portion 305, but have no particular graduation. Lash subassembly 302 has an intermittent/spaced lash line treatment, with gaps between clusters of 2-5 shorter filaments or 5-15 longer lash filaments tied onto an attachment section 305, acting as a camouflage subassembly that blends the lash subassembly 304 into the natural lashes. Lash subassembly 302 emboldens the roots of the natural eyelashes, facilitating the impression of added density in the natural lash line. Lash subassembly 302 may have a base portion length of, for example, 6 mm.

Lash subassembly 302 has a similar structure and functions in a similar manner to lash subassembly 44 of the fourth embodiment but again is brown in color for a more subtle application to lighter colored or sparser lash lines. Similar visual effects to those previously described for lash subassembly 44 are created when lash subassembly 302 is placed at different positions along the lash line and when combined with different additional lash subassemblies.

FIG. 30 illustrates a thirtieth embodiment of the invention including lash subassemblies 302 and 304 forming adornment 301. This embodiment provides a traditional shape but the total width of the adornment is less than the width of a traditional false eyelash assembly. The two lash subassemblies 302 and 304 have a graduation in filament length, density and arrangement covering a distance of approximately ½ to the whole lash line length. The adornment has its longest filament length and greatest density at the lateral corner while its shortest filament length and least density lies at the medial corner.

This embodiment is particularly beneficial for deep-set, close-set, and/or small eyes, and/or for eyes having small or sparse lash lines. It creates the appearance of an increase in the eye's L/M and S/I width from its lateral side region through the center of the adornment, while the medial portion stays natural-looking. The adornment is subtly exaggerated compared to the density and appearance of a natural lash line, but is most subtle at the medial portion, which also lends itself to eyes wherein the medial corner of the eye changes orientation, turning toward the medial tear duct (an area where adhesion of a traditional false eyelash strip is difficult to maintain). The embodiment helps to resolve the issue of traditional lashes failing to blend into the length, texture and density of the natural lash line.

In variations of this embodiment lash subassemblies 304 and 302 respectively represent approximately ⅔ to ⅘ and approximately ⅕ to ⅓ of the entire width of the adornment.

FIG. 31

Figure 31:
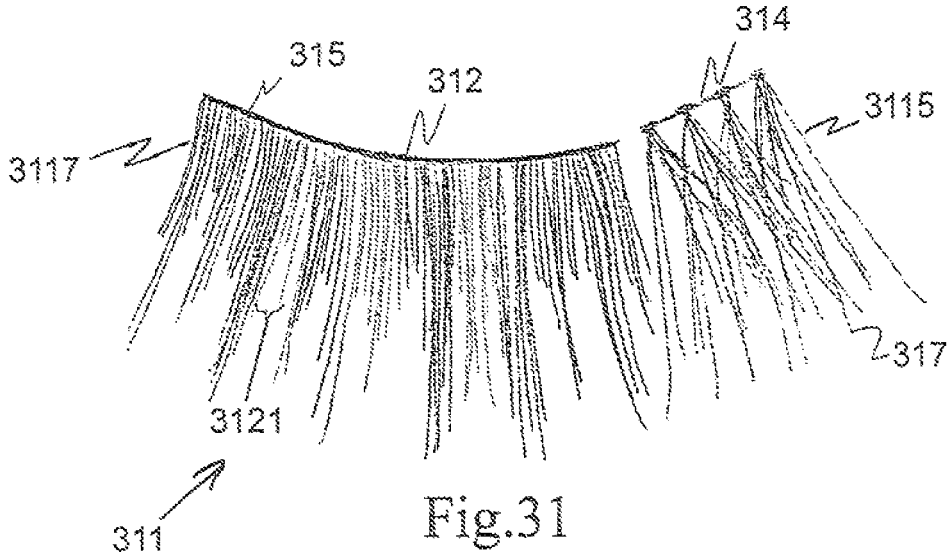
FIG. 31 is a schematic view of a thirty-first embodiment of the present invention.

FIG. 31 depicts an eyelash adornment in accordance with a thirty-first embodiment of the present invention. Description of common elements and operation similar to those previously described will not be repeated with respect to the thirty-first embodiment.

FIG. 31 illustrates lash subassemblies 314 and 312. Lash subassembly 314 is soft black and has a similar mean filament length and density of filament distribution to lash subassembly 312, but it is shorter in terms of the length of the base portion 315. This lash subassembly 314 has lash filaments 317 that are knotted at the base and attached along a clear base portion 315. The filaments emerge from each knot on the base portion 315 in a divergent pattern, but the overall look is continuous. The subassembly length of the base portion 315 may be, for example, 6 mm.

Lash subassembly 314 has a similar structure and functions in a similar manner to lash subassembly 244 of the twenty-fourth embodiment.

Lash subassembly 312 may be similar to lash subassembly 304 of embodiment 30 and may have a base portion length of, for example, 19 mm.

FIG. 31 illustrates a thirty-first embodiment of the invention including lash subassemblies 312 and 314 forming adornment 311. This embodiment has a traditional shape but a total width that is less than the width of a traditional false eyelash assembly. It includes two lash subassemblies with conventional distribution of filament density, texture and length, with a combined subassembly width of approximately ⅔ to the whole lash line length.

This embodiment is particularly effective for overly-round, downward-slanting, and/or slightly droopy eyes and/or eyelids, or any eyelid where the more favorable part of the eye is not the lateral corner, but just in from the lateral corner and the center of the lash line. The change of the largest lash subassembly in the assembly to the center portion of the eye makes the eye appear to have a less downward orientation. The extended filament length of the lash subassembly 312 helps exaggerate the vertical emphasis and disguises the skin on the brow bone and its proximity to the eyelashes.

In variations of this embodiment, lash subassemblies 314 and 312 may respectively represent approximately ⅕ to ⅓ and approximately ⅔ to ⅘ of the entire width of the adornment.

FIG. 32

Figure 32:
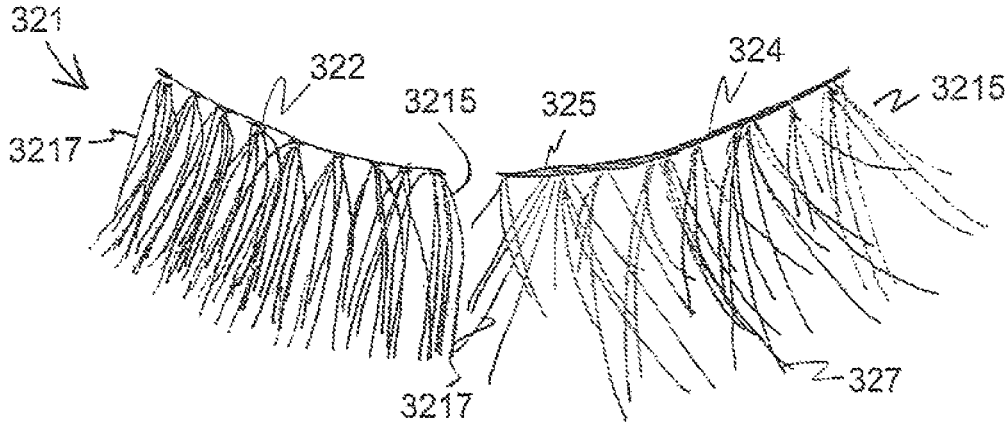
FIG. 32 is a schematic view of a thirty-second embodiment of the present invention.

FIG. 32 depicts an eyelash adornment in accordance with a thirty-second embodiment of the present invention. Description of common elements and operation similar to those previously described will not be repeated with respect to the thirty-second embodiment.

FIG. 32 illustrates lash subassemblies 324 and 322. Lash subassembly 324 is brown and it has the longer mean filament length of the two lash subassemblies 322 and 324. This lash subassembly 324 has lash filaments 327 that are gathered at the base portion 325 in alternating smaller (two to six lash filaments) and larger (ten to twenty lash filaments) clusters that diverge and overlap each other forming an X-shaped pattern. It is graduated in filament length from longer at the lateral portion 3215 to shorter at the medial portion 3217. The filaments are slightly chaotic, but the overall look is continuous. The length of its base portion may be, for example, 16 mm.

Lash subassembly 324 has a similar structure and functions in a similar manner to lash subassembly 284 of embodiment 28, but is longer in terms of filament length and larger in terms of subassembly width and therefore more suitable for larger eyes and for ease of quick application. Similar visual effects to those previously described for lash subassembly 284 are created when lash subassembly 324 is placed at different positions along the lash line and when combined with different additional lash subassemblies.

Lash subassembly 322 is brown, and matches the filament length of the last subassembly 324 at its lateral side region 3215 and becomes shorter at the medial side region 3217. The lash filaments 327 of lash subassembly 322 are gathered into small clusters at the attachment section 325 and then the filaments diverge and become relatively parallel. This lash subassembly is less dense and more regularly textured than the lash subassembly 324, creating a more subtle effect that is suitable for blending the appearance of lash subassembly 324 into the look of the natural lashes. This lash subassembly also creates a root building effect, facilitating the impression of density at the base of the natural lash line. It may have a base portion length of, for example, 14 mm.

Lash subassembly 322 has a similar structure and functions in a similar manner to lash subassembly 113 of the eleventh embodiment, but is brown in color for lighter colored or sparser lash lines. Similar visual effects to those previously described for lash subassembly 113 are created when lash subassembly 322 is placed at different positions along the lash line and when combined with different additional lash subassemblies.

FIG. 32 illustrates a thirty-second embodiment of the invention including lash subassemblies 322 and 324 forming adornment 321. The embodiment provides a traditional lash shape longer at the lateral corner and graduating to shorter at the medial corner. The total width of the adornment is less than the width of a traditional false eyelash assembly. The two lash subassemblies 322 and 324 have differing density and arrangement covering a distance of approximately ½ to the whole lash line.

This embodiment is particularly effective for deep-set, close-set, and/or small eyes, and/or for small or sparse lash lines. The filament length and density at the lateral corner through the center of the eye creates the appearance of larger L/M and S/I widths while the medial portion stays shorter and more even in arrangement, filling in the scarcity of the natural lash line from the center through the medial corner, which also aids in adhesion near the medial area of the lash line.

In variations of this embodiment, lash subassemblies 324 and 322 may respectively represent approximately ⅓ to ⅔ and approximately ⅓ to ⅔ of the entire width of the adornment.

FIG. 33

Figure 33:
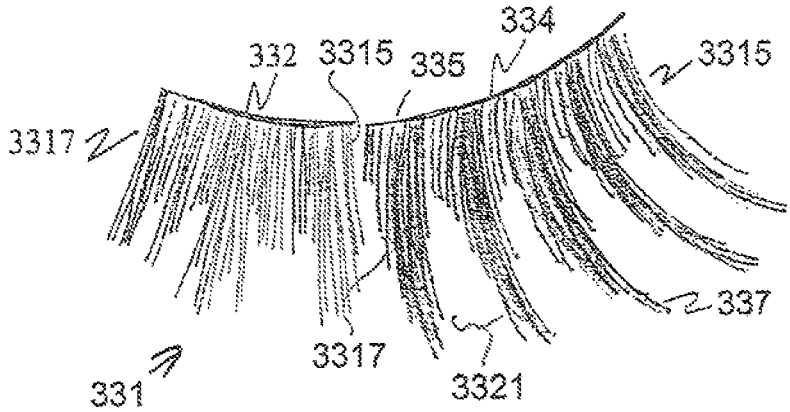
FIG. 33 is a schematic view of a thirty-third embodiment of the present invention.

FIG. 33 depicts an eyelash adornment in accordance with a thirty-third embodiment of the present invention. Description of common elements and operation similar to those previously described will not be repeated with respect to the thirty-third embodiment.

FIG. 33 illustrates lash subassemblies 334 and 332. Lash subassembly 334 is soft black and it has a longer mean filament length and a denser filament distribution than lash subassembly 332. This lash subassembly 334 also has lash filaments 337 that alternate between dense groups of longer filaments and less dense groups of shorter filaments 3321, creating a spiky effect. It is graduated in filament length from longer at the lateral portion 3315 to shorter at the medial portion 3317. The length of its base portion may be, for example, 13 mm.

Lash subassembly 334 has a similar structure and functions in a similar manner to lash subassembly 4 of the first embodiment, but with less strictly formed clusters for a less pronounced look. Similar visual effects to those previously described for lash subassembly 4 are created when lash subassembly 334 is placed at different positions along the lash line and when combined with different additional lash subassemblies.

Lash subassembly 332 is brown, more delicate in intensity, and shorter in overall filament length and base portion length than subassembly 334. The lash filaments 337 of lash subassembly 332 are formed into alternating longer and shorter groups of delicate parallel filaments, that slightly graduate from longer at the lateral side region 3315 to shorter at the medial side region 3317. Lash subassembly 332 is suitable for blending the lash subassembly 334 into the natural lashes while facilitating the impression of density at the base of the lash line 335. It may have a base portion length of, for example, 8 mm.

Lash subassembly 332 has a similar structure and functions in a similar manner to lash subassembly 112 of the eleventh embodiment but is brown in color and slightly smaller. Similar visual effects to those previously described for lash subassembly 112 are created when lash subassembly 332 is placed at different positions along the lash line and when combined with different additional lash subassemblies.

Both lash subassemblies 332 and 334 provide an option for wearers who prefer less density at the lash line and provide an easier application for smaller eyes due to the smaller subassembly width 335.

FIG. 33 illustrates a thirty-third embodiment of the invention including lash subassemblies 332 and 334 forming adornment 331. The embodiment provides a traditional lash shape having a total width less than the width of a traditional false eyelash assembly. The two lash subassemblies 332 and 334 demonstrate graduation in filament length, density and arrangement, covering a distance of approximately ½ to the whole lash line length.

This embodiment is particularly effective for deep-set, close-set, and/or small eyes and/or small or sparse lash lines. It provides vertical emphasis from the lateral side region through the center of the adornment while the medial portion stays natural looking. It creates more filament density at the lash line and length, appearing to enlarge the L/M and S/I widths of the eye. The visual effect slightly exaggerates the natural density of the lash line, and lends itself to adhesion on eyes wherein the medial corner takes a particular orientation toward the tear duct.

In variations of this embodiment, lash subassemblies 334 and 332 may respectively represent approximately ½ to ⅔ and approximately ⅓ to ⅗ of the entire width of the adornment.

FIG. 34

Figure 34:
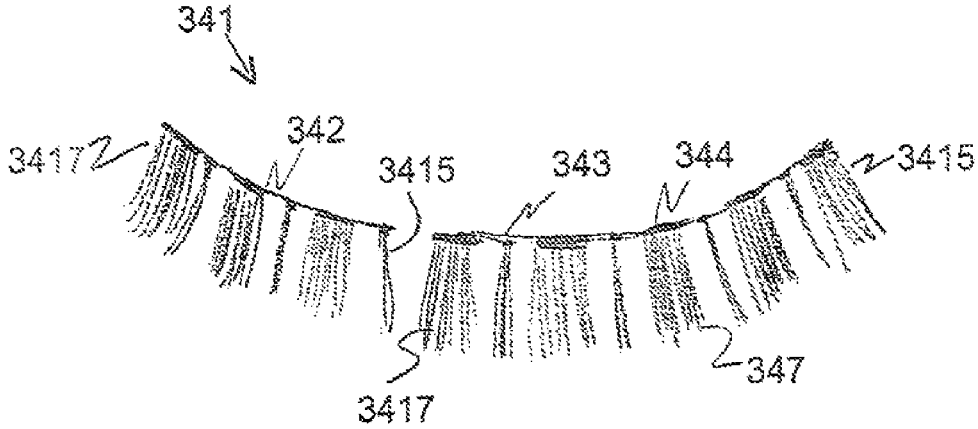
FIG. 34 is a schematic view of a thirty-fourth embodiment of the present invention.

FIG. 34 depicts an eyelash adornment in accordance with a thirty-fourth embodiment of the present invention. Description of common elements and operation similar to those previously described will not be repeated with respect to the thirty-fourth embodiment.

FIG. 34 illustrates lash subassemblies 344 and 342. Lash subassembly 344 and lash subassembly 342 both have a continuous yet alternating texture with intermittent gaps along the clear base portion 345 between clusters of lash filaments 347 that are soft black in color and substantially short in filament length. The clusters of lash filaments alternate in density between finer and denser, the denser clusters being approximately five times wider than the finer clusters. The overall effect of both lash subassemblies 344 and 342 is a root emphasis in the natural lash line that adds an exaggerated effect at the base of the natural lash line, making the natural lash line seem denser while maintaining the look of the natural eyelashes by maintaining the pattern that is formed along the brow bone when the eyes are open.

Lash subassembly 344 has a similar structure and functions in a similar manner to lash subassemblies 32, 33, or 34 of the third embodiment, but with more density and a larger base portion length for natural lashes that are more dense than average. Similar visual effects to those previously described for lash subassembly 32, 33, or 34 are created when lash subassembly 344 is placed at different positions along the lash line and when combined with different additional lash subassemblies.

Lash subassembly 344 may have a base portion length of, for example, 16 mm.

Lash subassembly 342 has a similar structure and functions in a similar manner to lash subassembly 344 but with has a smaller base portion length for smaller eyes and/or for eyes where the medial part of the eye has an orientation toward the tear duct. Lash subassembly 342 may have a base portion length of, for example, 10 mm.

FIG. 34 illustrates a thirty-fourth embodiment of the invention including lash subassemblies 342 and 344 forming adornment 341. This embodiment has a shortened lash filament length with the two subassemblies combining to cover approximately ½ to approximately ¾ of the length of the lash line.

This embodiment may be beneficial for any eye shape with thin or sparse lashes. It creates the appearance of density at the lash line, which enlarges the appearance of the eye's L/M width, creating the impression of vertical emphasis within the top lashes.

In alternative embodiments the adornment may be clear, pale or brown in color, or any combination of these colors to achieve a more subtle effect.

As with any embodiment of the present invention, although two subassemblies are illustrated here for ease of application, the thirty-fourth embodiment lends itself to any number of subassemblies, textures, widths, varieties and combinations thereof covering anywhere between approximately 1/10 to the whole lash line.

In additional variations of this embodiment, lash subassemblies 344 and 342 respectively represent approximately ¼ to approximately ⅕ of the total lash line.

The embodiment is effective for unique eye shapes that don't conform to the traditional shape of single strip lashes (i.e., they are too long, too short, or don't curve in the same shape as the eye). It is also effective for loose or crêpey/feathered eyelids as the lash subassemblies are placed individually, accommodating irregularity in the texture of the eyelid.

FIG. 35

Figure 35:
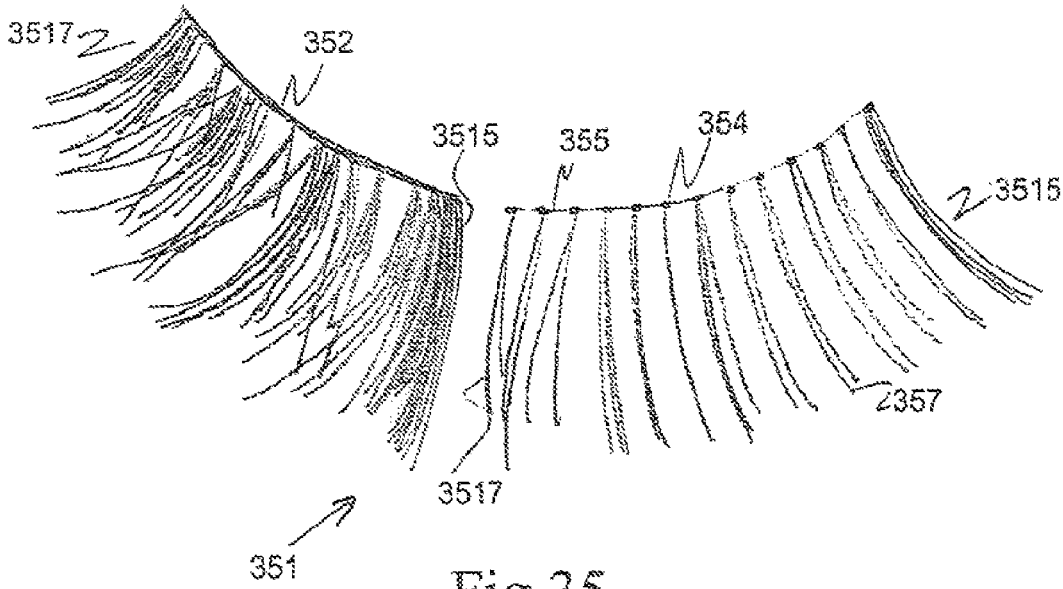
FIG. 35 is a schematic view of a thirty-fifth embodiment of the present invention.

FIG. 35 depicts an eyelash adornment in accordance with a thirty-fifth embodiment of the present invention. Description of common elements and operation similar to those previously described will not be repeated with respect to the thirty-fifth embodiment.

FIG. 35 illustrates lash subassemblies 354 and 352. Lash subassembly 354 is soft black with parallel lash filaments 357 that are knotted at the base and attached along a clear base portion 355 with gaps between each cluster of filaments. The density is sparse and there is no substantial graduation in filament length from the lateral portion 3515 to the medial portion 3517. The length of the base portion 355 may be, for example, 14 mm.

Lash subassembly 354 has a similar structure and functions in a similar manner to lash subassembly 112 of the eleventh embodiment, but has a longer base portion for easier application on larger eyes. Similar visual effects to those previously described for lash subassembly 112 are created when lash subassembly 354 is placed at different positions along the lash line and when combined with different additional lash subassemblies.

The lash subassembly 352 is rich black, dense, and slightly short in mean filament length, matching the length of lash subassembly 354 at the lateral side region 3515 and becoming slightly shorter at the medial side region 3517. The lash filaments 357 of lash subassembly 352 are slightly chaotic and divergent as they move away from the attachment section 355, but the overall look is continuous. Lash subassembly 352 is more extreme than lash subassembly 354 and may have a base portion length of, for example, 14 mm.

Lash subassembly 352 has a similar structure and functions in a similar manner to lash subassembly 292 of embodiment 29. Similar visual effects to those previously described for lash subassembly 292 or 92 are created when lash subassembly 352 is placed at different positions along the lash line and when combined with different additional lash subassemblies.

FIG. 35 illustrates a thirty-fifth embodiment of the invention including lash subassemblies 352 and 354 forming adornment 351. This embodiment has a traditional shape including two lash subassemblies having an unconventional distribution of texture and density. There is a relatively graduated distribution of filament length and the combined subassemblies cover from approximately ⅓ to the entire lash line length.

This embodiment is particularly beneficial for wide-set eye shapes where the bridge of the nose may seem slightly flatter than average, for example the eyes of persons of Asian descent. It helps to create the illusion of an eye shape which is still large in terms of L/M and S/I width but nearer to the bridge of the nose. It is suitable for any eye shape set into wide cheekbones. The intensity at the medial corner will seem to bring the eyes closer together while the exaggeration of the filament length of the lateral segment balances the exaggeration.

In variations of this embodiment, the lash subassemblies 354 and 352 may respectively represent approximately ½ to ⅔ and approximately ½ to ⅕ of the entire width of the adornment.

FIG. 36

Figure 36:
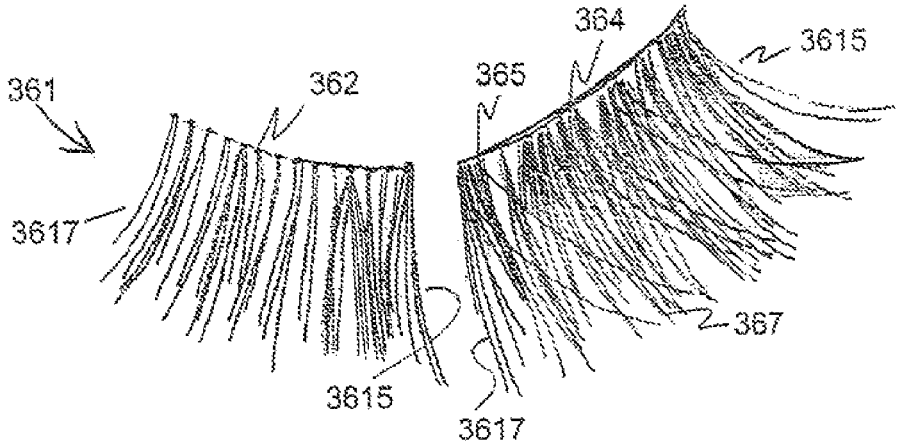
FIG. 36 is a schematic view of a thirty-sixth embodiment of the present invention.

FIG. 36 depicts an eyelash adornment in accordance with a thirty-sixth embodiment of the present invention. Description of common elements and operation similar to those previously described will not be repeated with respect to the thirty-sixth embodiment.

FIG. 36 illustrates lash subassemblies 364 and 362. Lash subassembly 364 is rich black, and has a longer mean filament length and a denser filament distribution than lash subassembly 362. This lash subassembly 364 has lash filaments 367 that are slightly chaotic and divergent as they move away from the attachment section 365, but the overall look is continuous. It is graduated in filament length from longer at the lateral portion 3615 to shorter at the medial portion 3617. The length of the base portion of lash subassembly 364 may be, for example, 12 mm.

Lash subassembly 364 has a similar structure and functions in a similar manner to lash subassembly 292 of embodiment 29. Similar visual effects to those previously described for lash subassembly 292 or 92 are created when lash subassembly 364 is placed at different positions along the lash line and when combined with additional lash subassemblies.

The lash subassembly 362 is soft black, more delicate in intensity, and slightly shorter in filament length and subassembly width than subassembly 364. The lash filaments 367 of lash subassembly 362 are formed into delicate groups of parallel filaments, with gaps between clusters of lash filaments knotted onto an attachment section 365, which graduate from slightly longer at the lateral side region 3615 to shorter at the medial side region 3617. This lash subassembly may have a base portion length of, for example, 10 mm.

Lash subassembly 362 has a similar structure and functions in a similar manner to lash subassembly 92 of the ninth embodiment. Similar visual effects to those previously described for lash subassembly 92 are created when lash subassembly 362 is placed at different positions along the lash line and when combined with different additional lash subassemblies.

FIG. 36 illustrates a thirty-sixth embodiment of the invention including lash subassemblies 362 and 364 forming adornment 361. This embodiment has a traditional shape including two lash subassemblies having a graduation in filament length density and arrangement. The adornment covers from approximately ½ to approximately the entire lash line length.

This embodiment is beneficial for deep-set, close-set, and/or small eyes, and/or for small or sparse lash lines. The embodiment provides emphasis at the lateral area of the adornment while the medial area is more subtle. It also creates density at the lash line, enlarging and the appearance of the L/M and S/I widths of the eye while appearing subtle with regard to the natural density of the natural lash line. This embodiment can help to resolve the issue of traditional lashes which often fail to integrate themselves into the length, texture and density of the natural lash line, and aids in ease of application.

In variations of this embodiment, lash subassemblies 364 and 362 may respectively represent approximately ½ to ⅔ and approximately ½ to ⅓ of the width of the entire adornment.

It will be understood that lash subassemblies, either in combination with one or more additional lash subassemblies or on their own, may be used to cover part of the lash line length rather than the full length of the eye line.

It will also be understood that in some embodiments of the invention the lash subassemblies may not be arranged side by side but may be arranged to overlap one another. For example in an alternative embodiment to the thirty-sixth embodiment previously described, lash subassemblies 362 and 364 may be arranged such that the base portion of lash subassembly 362 overlies at least a part of the base portion of lash subassembly 364, or vice versa. Such an overlying arrangement of lash subassemblies may apply to any of the embodiments previously described.

Furthermore, the lash subassemblies may be arranged to overlie each other in such a way that the total width of the respective base portions is longer than the length of the natural lash line when in use. It will be appreciated that in other embodiments the total width of the respective base portions may be less than or substantially equal to the length of the natural lash line when in use.

As will be clear from the above description, the invention allows a wide variety of physical features to be addressed, or purely decorative effects to be provided, by selecting lash subassemblies which individually, or in combination, provide specific visual effects on part or the whole of the eye or natural lash. The above embodiments are therefore merely examples of the limitless combinations of lash subassemblies that can be assembled in order to form eyelash adornments in accordance with the invention. In such adornments, some of the individual lash subassemblies may well be similar to those described above, but there will also be many variations of those described, as well as different combinations of the features of the different described lash subassemblies and others that are very different indeed. The variation between the different lash subassemblies create a number of options within a modular eyelash assembly, thus facilitating a custom fit by virtue of both slight and significant differences between lash subassemblies.

While aspects of the present invention have been particularly shown and described with reference to the preferred embodiment above, it will be understood by those of ordinary skill in the art that various additional embodiments may be contemplated without departing from the spirit and scope of the present invention. For example, though certain colors (e.g., black, brown, clear, etc.) and visual descriptor(s) (e.g., "soft", "delicate", "rich", "thick", "chaotic", "subtle", etc.) have been used with reference to various structures of the eyelash adornment, each structure may be provided with any color(s) and/or visual descriptor(s), singly or in combination, as desired for a particular application of the present invention; such design choices may be made for any embodiment of the present invention without regard to the naturalness of the resulting effect or any other consideration. The Figures do not indicate absolute or relative scales of any features of the depicted embodiments. Any structures of the eyelash adornments according to any embodiment of the present invention may be made with any suitable method, including, but not limited to, one-piece construction, multi-piece construction, knotting, molding, other affixation, or any combinations thereof, without deference to the manufacturing methods referenced herein. Each eyelash adornment may exhibit any desired simple or compound curves, curvilinear characteristics, rectilinear characteristics, or any combinations thereof when viewed from any direction; for instance, the lash filaments of any embodiment of the present invention may curve downward, from a sagittal view, in much the same manner as natural eyelashes curl or are commonly made to curl. The described use environments for the various embodiments of the present invention (e.g., theatrical applications) do not limit situations and embodiments in which the present invention could be used, but are merely examples. The specific values for lengths (absolute or relative) are presented merely as examples of suitable dimensions for certain applications of the present invention, and one of ordinary skill in the art can readily specify desired values, which may differ from those suggested, for a particular application. The adornments can be temporarily affixed (e.g., by using removable adhesive) for short-term use or can be more permanently affixed (e.g., by using a less readily removable adhesive or through other joining to the natural eyelashes or eye area structures) for more long-term use. The adornments can be one-time use, disposable products, or can be configured for repeated uses. The lash filaments may each have any suitable color, material, cross-sectional shape, construction, or any other traits as desired for a particular application of the present invention, and the lash filaments making up a single eyelash adornment need not be matched in any traits except as desired. A device or method incorporating any of these features should be understood to fall under the scope of the present invention as determined based upon the claims below and any equivalents thereof.

Other aspects, objects, and advantages of the present invention can be obtained from a study of the drawings, the disclosure, and the appended claims.

Having described the invention, I claim:

1. An eyelash adornment apparatus for an eyelid, the eyelid having a natural lash line containing natural eyelashes, the apparatus comprising:

first and second lash subassemblies for concurrent attachment to the eyelid, each lash subassembly comprising:

an elongated mounting portion; and a plurality of elongated lash filaments, each lash filament having a filament base and an oppositely disposed filament tip, the filament base being attached to the mounting portion with the filament tip extending from the mounting portion; and wherein, when the lash subassemblies are concurrently affixed to the eyelid, the plurality of elongated lash filaments of the first lash subassembly collectively have a different appearance than an appearance collectively provided by the plurality of elongated lash filaments of the second lash subassembly.

2. The eyelash adornment apparatus of claim 1, wherein at least one mounting portion has a mounting portion length in the range of about 3 mm to about 25 mm.

3. The eyelash adornment apparatus of claim 1, wherein at least one mounting portion has a mounting portion length in the range of about 5 mm to about 17 mm.

4. The eyelash adornment apparatus of claim 1, wherein at least one mounting portion has a mounting portion length in the range of about 7 mm to about 11 mm.

5. The eyelash adornment apparatus of claim 1, wherein each mounting portion has a mounting portion length, and the mounting portion lengths of the plurality of lash subassemblies are substantially equal.

6. The eyelash adornment apparatus of claim 1, wherein each mounting portion has a mounting portion length, and the mounting portion length of a chosen lash subassembly is different from the mounting portion length of at least one remaining lash subassembly of the plurality of lash subassemblies.

7. The eyelash adornment apparatus of claim 1, consisting of two lash subassemblies.

8. The eyelash adornment apparatus of claim 7, wherein the mounting portions of the two lash subassemblies each have a mounting portion length in the range of about 3 mm to about 25 mm.

9. The eyelash adornment apparatus of claim 7, wherein the mounting portions of the two lash subassemblies each have a mounting portion length in the range of about 10 mm to about 17 mm.

10. The eyelash adornment apparatus of claim 7, wherein the mounting portions of the two lash subassemblies each have a mounting portion length in the range of about 7 mm to about 11 mm.

11. The eyelash adornment apparatus of claim 1, consisting of three lash subassemblies.

12. The eyelash adornment apparatus of claim 11, wherein the mounting portions of the three lash subassemblies each have a mounting portion length in the range of about 7 mm to about 11 mm.

13. The eyelash adornment apparatus of claim 1, consisting of four lash subassemblies.

14. The eyelash adornment apparatus of claim 13, wherein the mounting portions of the four lash subassemblies each have a mounting portion length in the range of about 7 mm to about 9 mm.

15. The eyelash adornment apparatus of claim 1, consisting of five lash subassemblies.

16. The eyelash adornment apparatus of claim 15, wherein the mounting portions of the five lash subassemblies each have a mounting portion length in the range of about 5 mm to about 7 mm.

17. The eyelash adornment apparatus of claim 1, wherein each mounting portion has a mounting portion width, and the mounting portion widths of the plurality of lash subassemblies are substantially equal.

18. The eyelash adornment apparatus of claim 1, wherein, when affixed to the eyelid, at least one chosen lash subassembly is in direct linear contact with at least one other of the plurality of lash subassemblies.

19. The eyelash adornment apparatus of claim 1, wherein, when affixed to the eyelid, at least one chosen lash subassembly is in an overlapping relationship with at least one other of the plurality of lash subassemblies.

20. The eyelash adornment apparatus of claim 1, wherein, when affixed to the eyelid, at least one chosen lash subassembly is spaced apart from at least one other of the plurality of lash subassemblies.

21. The eyelash adornment apparatus of claim 1, extending along substantially the entire natural lash line when affixed to the eyelid.

22. The eyelash adornment apparatus of claim 1, wherein a total length of the mounting portions of the lash subassemblies, when affixed to the eyelid, are at least one of equal to, greater than, and less than an eyelid length of the eyelid.

23. The eyelash adornment of claim 1, wherein a chosen one of the lash subassemblies has a first mean lash filament length, an other one of the lash subassemblies has a second mean lash filament length, and the first mean lash filament length is different from the second mean lash filament length.

24. The eyelash adornment of claim 1, wherein a chosen one of the lash subassemblies has a first mean lash filament thickness, an other one of the lash subassemblies has a second mean lash filament thickness, and the first mean lash filament thickness is different from the second mean lash filament thickness.

25. The eyelash adornment of claim 1, wherein a chosen one of the lash subassemblies has a first lash filament color, an other one of the lash subassemblies has a second lash filament color, and the first lash filament color is different from the second lash filament color.

26. The eyelash adornment of claim 1, wherein a chosen one of the lash subassemblies has a first lash filament material, an other one of the lash subassemblies has a second lash filament material, and the first lash filament material is different from the second lash filament material.

27. The eyelash adornment of claim 1, wherein a chosen one of the lash subassemblies has a first mean lash filament distribution density, an other one of the lash subassemblies has a second mean lash filament distribution density, and the first mean lash filament distribution density is different from the second mean lash filament distribution density.

28. The eyelash adornment of claim 1, wherein a chosen one of the lash subassemblies has a mean lash filament length, defined between the mounting portion and the filament tip, and the natural lash line of a wearer includes a plurality of natural lashes having a mean natural lash length for the wearer and, when the chosen lash subassembly is affixed to the eyelid, the mean lash filament length is less than the mean natural lash length of the wearer.

29. The eyelash adornment of claim 1, wherein the filament tips of a chosen one of the lash subassemblies define a first tip profile, and the filament tips of an other one of the lash subassemblies define a second tip profile.

30. The eyelash adornment of claim 29, wherein the first tip profile is different from the second tip profile.

31. The eyelash adornment of claim 29, wherein at least one of the first and second tip profiles includes a convex curve.

32. The eyelash adornment of claim 29, wherein at least one of the first and second tip profiles includes a concave curve.

33. The eyelash adornment of claim 29, wherein at least a chosen one of the first and second tip profiles includes a substantially straight line.

34. The eyelash adornment of claim 33, wherein the substantially straight line of the chosen tip profile is located in an angular relationship with the mounting portion of the lash subassembly which defines the chosen tip profile.

35. The eyelash adornment of claim 29, wherein at least one of the first and second tip profiles includes a substantially crenellated section.

36. The eyelash adornment of claim 35, wherein at least a portion of the substantially crenellated section has a substantially triangular aspect.

37. The eyelash adornment of claim 1, wherein a plurality of lash filaments are spaced in a first lateral distribution along a length of a chosen lash subassembly and a plurality of lash filaments are spaced in a second lateral distribution along a length of an other lash subassembly, and the first lateral distribution is different from the second lateral distribution.

38. The eyelash adornment of claim 1, wherein a chosen one of the lash subassemblies includes a plurality of lash groupings, at least one lash filament defining each lash grouping.

39. The eyelash adornment of claim 38, wherein a plurality of lash groupings are affixed along the length of the mounting portion of the chosen lash subassembly.

40. The eyelash adornment of claim 38, wherein a chosen one of the lash groupings has at least one visual characteristic that is different from a visual characteristic of an other one of the lash groupings.

41. The eyelash adornment of claim 40, wherein the visual characteristic of at least one of the chosen and other ones of the lash groupings is at least one of mean filament length, tip profile shape, filament color, filament material, and filament cross-sectional shape.

42. The eyelash adornment of claim 38, wherein a first lash grouping defines a first tip profile, a second lash grouping defines a second tip profile, and at least one of the first and second tip profiles is substantially triangular.

43. The eyelash adornment of claim 42, wherein a lash grouping having a substantially triangular tip profile is affixed along the length of the mounting portion of the chosen lash subassembly adjacent a lash grouping having a substantially non-triangular profile.

44. The eyelash adornment of claim 39, wherein a first lash grouping has a first filament orientation, a second lash grouping, adjacent to the first lash grouping, has a second filament orientation, and the first filament orientation is different than the second filament orientation.

45. The eyelash adornment of claim 39, wherein a chosen one of the lash groupings extends from the mounting portion in a predetermined relationship to an other one of the lash groupings, and the predetermined relationship is at least one of a converging relationship and a diverging relationship.

46. The eyelash adornment apparatus of claim 1, wherein the first and second lash subassemblies are attached along the natural lash line in a sequence to address at least one condition selected from the group consisting of relatively small eyes, relatively deep-set eyes, relatively narrow eyes, relatively droopy eyes, relatively protruding eyes, relatively wide-set eyes, relatively closely-set eyes, relatively round eyes, relatively downward-slanting eyes, relatively upward-slanting eyes, relatively droopy eyelids, relatively crêpey eyelids, and relatively feathery eyelids.

47. The eyelash adornment apparatus of claim 1, wherein eyes of a person to whom the adornment is to be fitted are assessed, and the first and second lash subassemblies are attached along the natural lash line responsive to the assessment to address at least one condition selected from the group consisting of relatively small eyes, relatively deep-set eyes, relatively narrow eyes, relatively droopy eyes, relatively protruding eyes, relatively wide-set eyes, relatively closely-set eyes, relatively round eyes, relatively downward-slanting eyes, relatively upward-slanting eyes, relatively droopy eyelids, relatively crêpey eyelids, and relatively feathery eyelids.

48. The eyelash adornment apparatus of claim 1, wherein, when the first and second lash subassemblies are concurrently affixed to the eyelid, the first lash subassembly has at least one visual characteristic that is different from a corresponding visual characteristic of the second lash subassembly, the visual characteristic being selected from the group comprising: mounting portion length, mounting portion width, mounting portion thickness, arrangement of lash filaments on the mounting portion, mean filament length, mean lash filament thickness, tip profile shape, filament color, filament material, and filament cross-sectional shape.

49. An eyelash adornment kit, the kit comprising:

at least two lash subassemblies, each lash subassembly comprising:

an elongated mounting portion; and a plurality of elongated lash filaments, each lash filament having a filament base and an oppositely disposed filament tip, the filament base being attached to the mounting portion with the filament tip extending from the mounting portion, the lash subassemblies being each adapted for affixation to the eyelid; and wherein two of the lashes are first and second lash subassemblies, and when the first and second lash subassemblies are concurrently affixed to the eyelid, the plurality of elongated lash filaments of the first lash subassembly collectively have a different appearance than an appearance collectively provided by the plurality of elongated lash filaments of the second lash subassembly; and at least one ancillary item.

50. The eyelash adornment kit of claim 49, wherein the ancillary item is at least one of a mirror, adhesive, adhesive remover, scissors, tweezers, a lash grabber/manipulating tool, a lash application tool, a lash separator/comb, bonding mascara, camouflage eyeliner, a storage case, and a template for assisting the user in arranging the eyelash adornment.

51. The eyelash adornment kit of claim 49, wherein the first and second lash subassemblies are selected to address at least one condition selected from the group consisting of relatively small eyes, relatively deep-set eyes, relatively narrow eyes, relatively droopy eyes, relatively protruding eyes, relatively wide-set eyes, relatively closely-set eyes, relatively round eyes, relatively downward-slanting eyes, relatively upward-slanting eyes, relatively droopy eyelids, relatively crêpey eyelids, and relatively feathery eyelids.

52. The eyelash adornment kit of claim 51, wherein at least one ancillary item is a style guide including instructions for addressing at least one selected condition using a combination of chosen lash subassemblies.

53. An eyelash adornment system comprising a group of lash elements, each lash element comprising a respective mounting portion having a series of lash filaments extending therefrom, a selected subgroup of the lash elements being adapted for concurrent arrangement together on an edge of the eyelid to form an eyelash adornment, a first lash element of the subgroup of the lash elements being mutually visually different from a second lash element of the subgroup of the lash elements due to physical differences between the series of lash filaments of the first lash element, taken collectively, and the series of lash filaments of the second lash element, taken collectively, when the first and second lash elements are arranged together on the edge of the eyelid to cooperatively form the eyelash adornment.

* * * * *